US005391080A

United States Patent [19]

Bernacki et al.

[11] Patent Number: 5,391,080

[45] Date of Patent: Feb. 21, 1995

[54] SWIM INSTRUCTION, TRAINING, AND ASSESSMENT APPARATUS

[75] Inventors: Robert H. Bernacki, 4495 Benton Ct., Bloomington, Ind. 47408; Joel M. Stager, Bloomington, Ind.

[73] Assignee: Robert H. Bernacki, Bloomington, Ind.

[21] Appl. No.: 92,362

[22] Filed: Jul. 15, 1993

[51] Int. Cl.[6] ..... A63B 69/12

[52] U.S. Cl. ..... 434/254; 482/6; 482/8; 482/55; 482/901

[58] Field of Search ..... 434/254, 255, 247; 482/7, 6, 5, 4, 8, 1, 51, 55, 56, 63, 901, 903, 92

[56] References Cited

U.S. PATENT DOCUMENTS

| | | | |
|---|---|---|---|
| 2,825,224 | 3/1958 | Lindenauer et al. . | |
| 3,517,930 | 6/1970 | Jacobsen . | |
| 3,731,921 | 5/1973 | Andrews, Jr. . | |
| 3,848,467 | 11/1974 | Flavell | 73/379 |
| 3,861,675 | 1/1975 | Hopper . | |
| 3,988,020 | 10/1976 | Carter . | |
| 4,082,267 | 4/1978 | Flavell . | |
| 4,114,874 | 4/1978 | Mattila . | |
| 4,184,678 | 1/1980 | Flavell et al. | 482/6 |
| 4,302,007 | 11/1981 | Oprean et al. . | |
| 4,524,711 | 6/1985 | Ashrow . | |
| 4,529,192 | 7/1985 | Stites . | |
| 4,654,010 | 3/1987 | Havriluk | 482/55 X |
| 4,681,118 | 7/1987 | Asai et al. . | |
| 4,778,175 | 10/1988 | Wucherpfennig et al. . | |
| 4,804,326 | 2/1989 | Lennon . | |
| 4,869,497 | 9/1989 | Stewart et al. . | |
| 4,907,795 | 3/1990 | Shaw et al. . | |
| 4,910,447 | 3/1990 | Masters . | |
| 4,930,770 | 6/1990 | Baker . | |
| 4,934,694 | 6/1990 | McIntosh . | |
| 4,998,725 | 1/1991 | Watterson et al. . | |
| 5,002,268 | 3/1991 | Anderson . | |
| 5,011,137 | 4/1991 | Murphy . | |

FOREIGN PATENT DOCUMENTS

| | | |
|---|---|---|
| 2596663 | 10/1987 | France . |
| 2094647 | 9/1982 | United Kingdom . |
| 2102683 | 2/1983 | United Kingdom . |
| 624646 | 9/1978 | U.S.S.R. . |
| 842926 | 5/1981 | U.S.S.R. . |
| 874080 | 10/1981 | U.S.S.R. . |
| 943810 | 7/1982 | U.S.S.R. . |
| 1192840 | 11/1985 | U.S.S.R. . |
| 1222292 | 4/1986 | U.S.S.R. . |
| 1535554 | 1/1990 | U.S.S.R. . |
| WO81/01507 | 6/1981 | WIPO . |
| WO86/00024 | 1/1986 | WIPO . |

OTHER PUBLICATIONS

Y. Dote, "Servo Motors and Motion Control Using Digital Signal Processors", (1990), Prentice Hall, Englewood, N.J., pp. 17–20, 23–27, 62–69, 109, 112, 113.

L. Rabiner and B. Gold, "Theory and Application of (List continued on next page.)

*Primary Examiner*—Cary E. O'Connor
*Assistant Examiner*—Jeffrey A. Smith
*Attorney, Agent, or Firm*—Barnes & Thornburg

[57] ABSTRACT

An instructional, training, and assessment apparatus is provided for use in the activity of swimming. The apparatus includes a cable having a proximal end and a distal end, and a harness for coupling the distal end of the cable to a swimmer. A mechanism is coupled to the proximal end of the cable for winding and unwinding the cable to apply positive and negative forces to the swimmer as the swimmer swims laps in a pool. The apparatus of the present invention can also be used with a mechanism that applies only positive forces to the swimmer. A sensor is provided for generating an output signal responsive to a parameter measured by the sensor. The apparatus also includes a programmable controller responsive to the output signal from the sensor and to preprogrammed control parameters for controlling the forces applied by the winding and unwinding mechanism. The apparatus further includes a transmitter and sensor at the distal end of the cable for the transmission of the sensor output signal through the cable to a receiver located at the proximal end of the cable.

91 Claims, 29 Drawing Sheets

OTHER PUBLICATIONS

Digital Signal Processing", (1975), Prentice Hall, pp. 40–43, 88–90, 219–224.

Buckley Power and Stroke Benches, Brookline, N.H., brochure, Jan. 1993.

Fitness Systems, Inc., Independence, Mo., brochure, Sep. 1989.

Mestre Enr., Ste–Foy, Quebec, Canada, "Research and Development, Swimming", Sales pamphlet, May 1991.

Total Performance Inc., Mansfield, Ohio, "Power Rack" brochure, 1991.

VASA, Williston, Vt., "Swim Trainer" brochure, 1991.

B. Bingham, Electromyography, "Swimming Technique", (1993), vol. 29, No. 4, pp. 12–14.

C. Colwin, Swimming into the 21st Century, (1991), Leisure Press, Champaign, Ill.

D. Costill, "Computer Based System for the Measurement of Force and Power During Front Crawl Swimming", (1986), J. Swimming Res., vol. 2, No. 1, pp. 16–19.

D. Costill, E. Maglischo, and A. Richardson, "Handbook of Sports Medicine and Science: Swimming", (1992), Blackwell Scientific Publications, Oxford, England.

J. Counsilman, "Competitive Swimming Manual for Coaches and Swimmers", (1977), Counsilman Co. Inc., Bloomington, Ind.

J. Counsilman, "The Science of Swimming", (1968) Prentice–Hall, Inc., Englewood Cliffs, N.J.

A. Craig Jr. et al., "Velocity, stroke rate, and distance per stroke during elite swimming competition", (1985), Medicine and Science in Sports and exercise, vol. 17, No. 6, pp. 625–634.

R. Fry et al., "Overtraining in Athletes", (1991) Sport Medicine, vol. 12, No. 1, pp. 32–65.

P. Klentrou et al., "Physiologic and Physical Correlates of Swimming Performance", (1991), vol. 7, No. 1, pp. 13–18.

C. Kelly, "Stanford Towing", (1993), Swimming World, vol. 34, No. 4, pp. 13–18.

E. Maglischo, "Swimming even faster", (1993), Mayfield Publishing, Mountain View, Calif., pp. 100–107.

Mestre, Bladimiro, "New Teaching Aids to Measure Stroke Efficiency", (1992), Swim Canada, Jan., p. 9.

B. Ria et al., "Assessment of the Mechnical Power in the Young Swimmer", (1990), J. Swimming Res., vol. 6, No. 3, pp. 11–15.

A. Roberts, "Effectiveness of Biokinetic Training on Swimming Performance in Collegiate Swimmers", (1991), J. Swimming Res., vol. 7, No. 3, pp. 5–11.

D. Rohrs et al., "Evaluation of Anaerobic Power and Capacity in Competitive Swimmers", (1991), J. Swimming Research, vol. 7, No. 3, pp. 12–16.

R. Sharp et al., "Relationship between power and sprint freestyle swimming", (1982), Medicine and Science in Sports and Exercise, vol. 14, No. 1, pp. 53–56.

H. Toussaint et al., "Propelling Efficiency of Front--crawl swimming", (1988), J. of Appl. Physiol., vol. 65, No. 6, pp. 2506–2512.

Fig. 2C
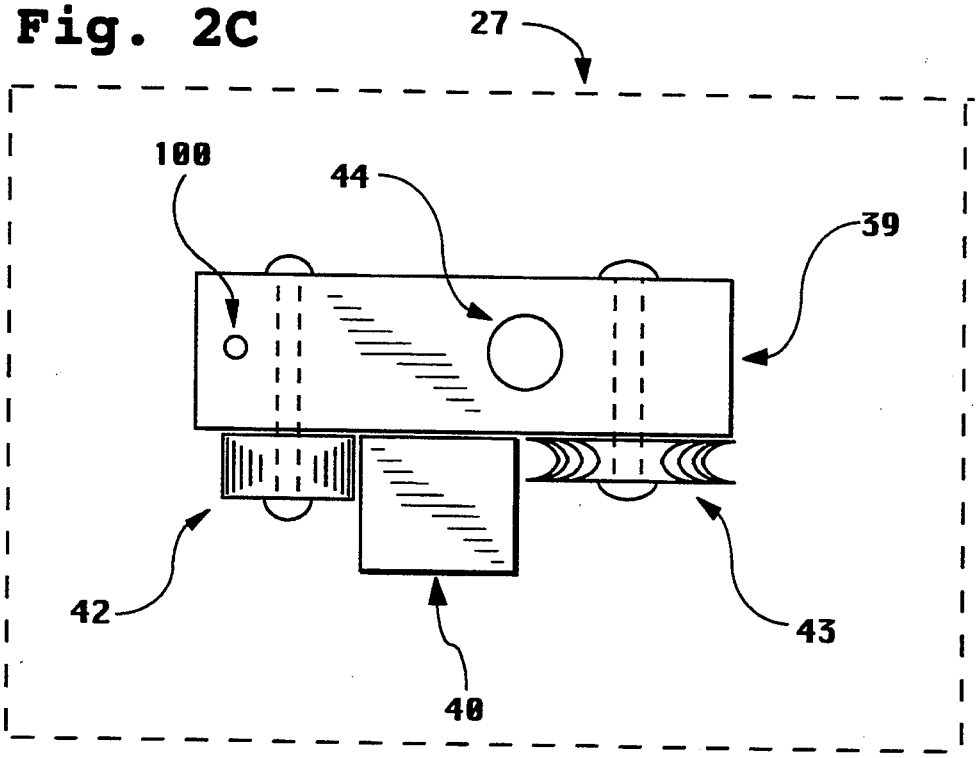
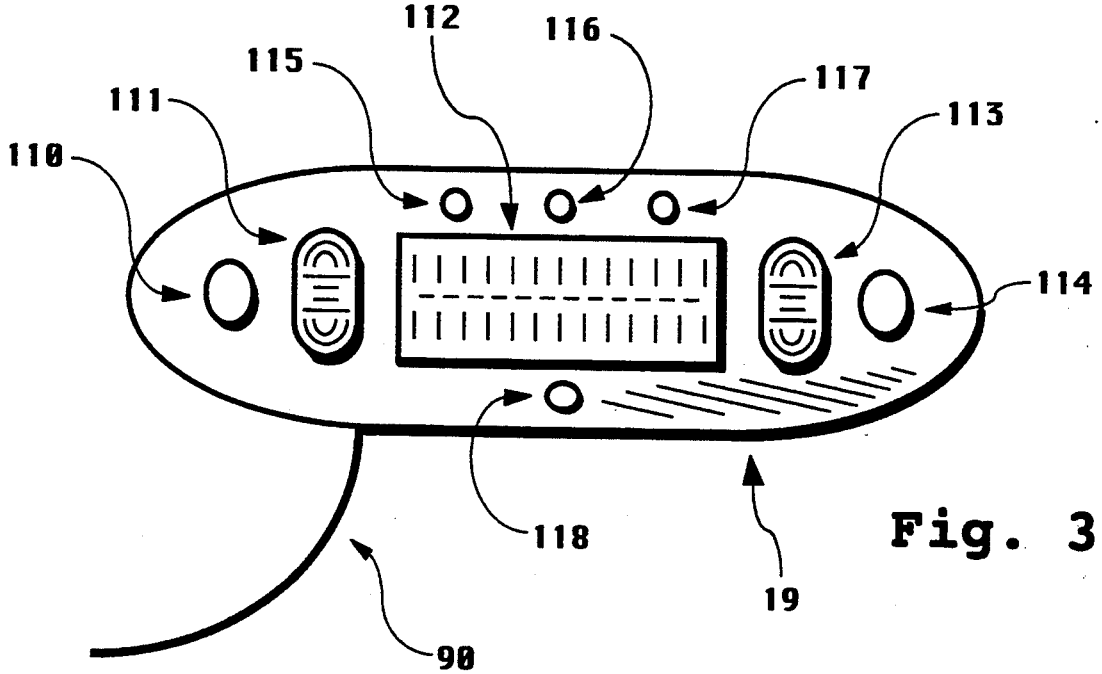
Fig. 3

Fig.6A
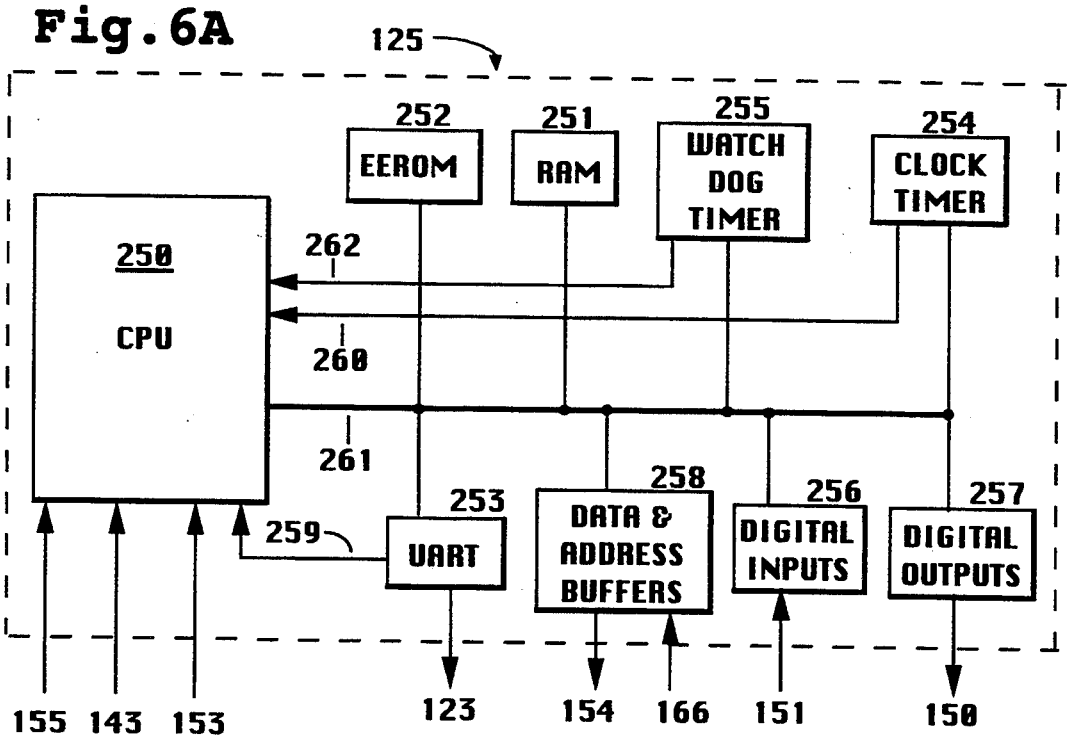
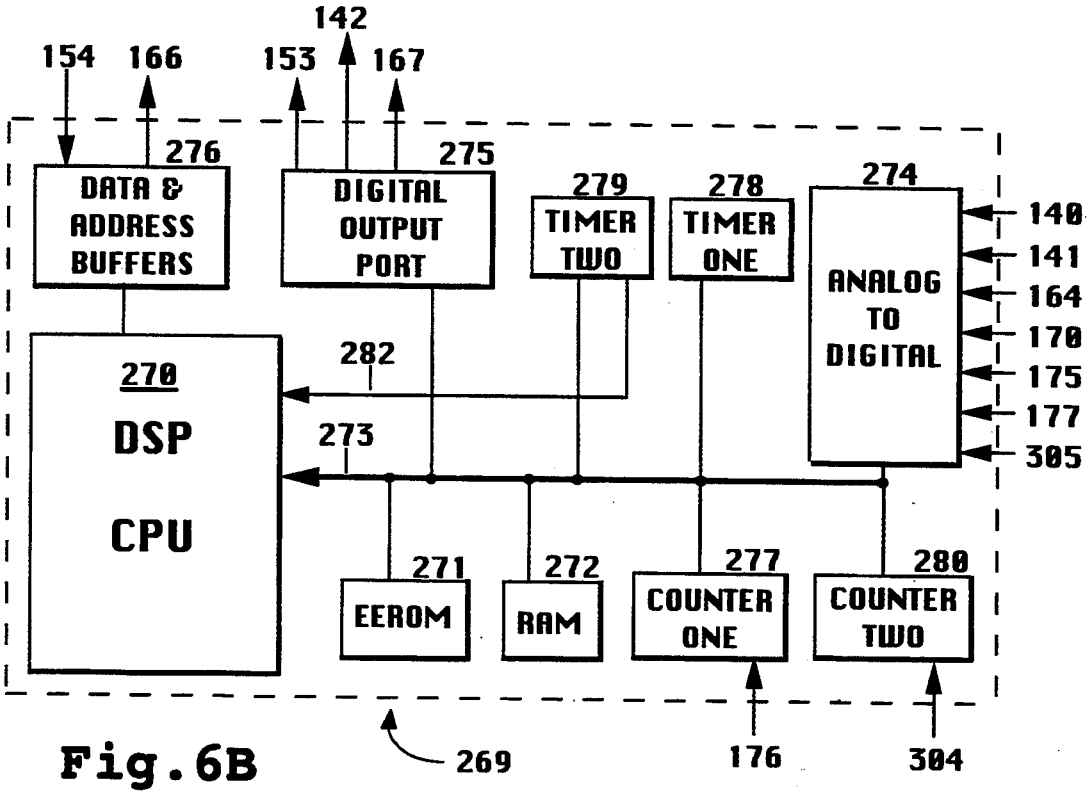
Fig.6B

139

321
170
322
328
142
320
318
326
319
325
335
327
76
140
DC
323
324
329
336
332
141
330
333
331
334
168
341
49
36
340
342
338
137
343
144
114
344
143
345
346
339
110
169
37

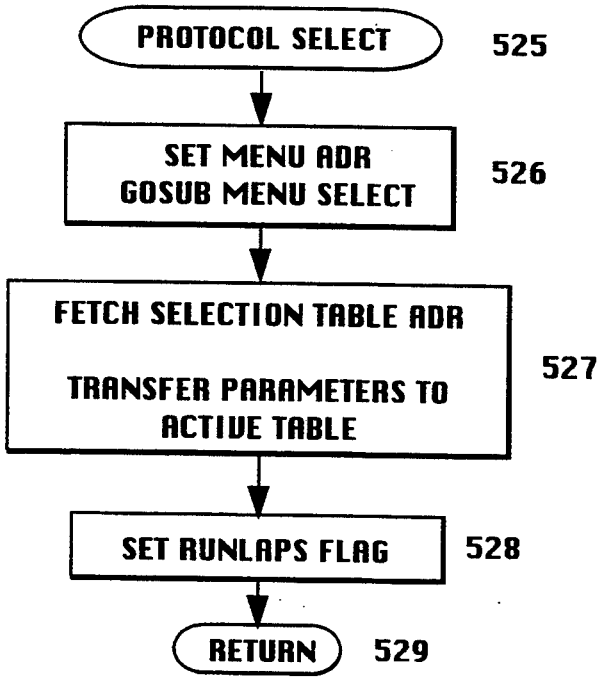
FIG. 10G
FIG. 10H
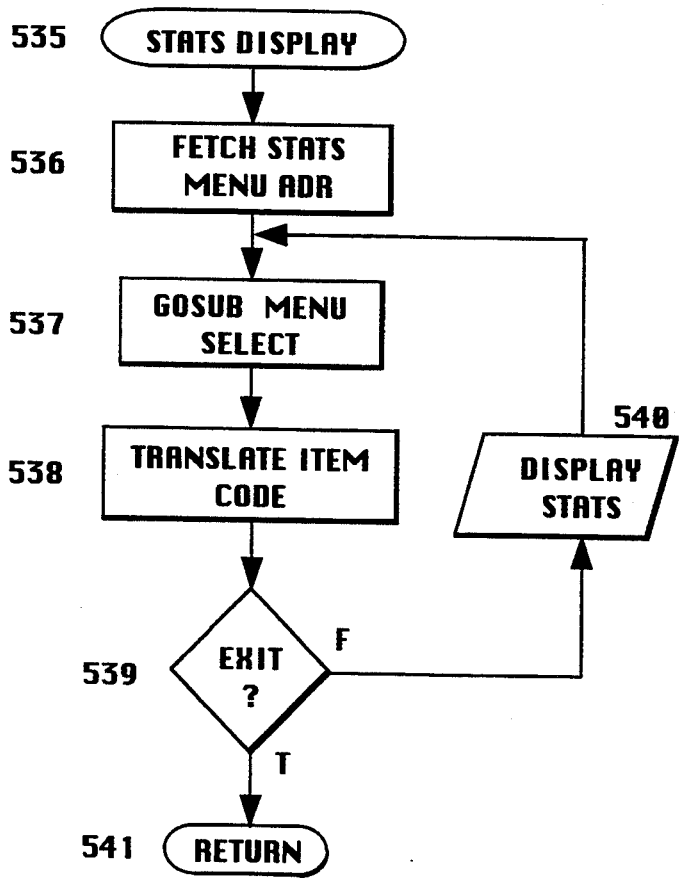

SWIM INSTRUCTION, TRAINING, AND ASSESSMENT APPARATUS

FIELD OF THE INVENTION

The present invention relates to instructional, training, assessment, and research devices for the activity of swimming and, in particular, to the control and monitoring of the application of positive and negative forces to the swimmer, via electrodynamic means under electronic controller means, as are necessary for the implementation of protocols associated with the aforementioned aspects of swimming.

BACKGROUND OF THE INVENTION

The ability to perform at the highest levels of swimming has been attributed to a number of factors including stroke mechanics, physical conditioning, and psychological factors. Therefore the key components of effective swim instruction and coaching programs include stroke mechanics instruction, training techniques designed to develop appropriate levels of physical conditioning, and the utilization of relevant assessment techniques for instructional diagnostics and feedback.

Stroke mechanics has only recently been supported by viable biomechanical theories and insights. Although previously propulsion was thought to be primarily related to the generation of drag forces or pushing against water, it is now believed that the fastest swimmers develop propulsive forces primarily derived from lift or Bernoulli effects. These forces are produced by the movement of the swimmers hand through the water in a lateral elliptical pattern. Two key elements in the completion of this pattern are hand angle relative to the direction of limb movement and the ability to accelerate the hand at appropriate positions throughout the range of this motion or swim stroke. In addition, the optimal stroke velocity may not necessarily be the maximal velocity that a swimmer is able to sustain. The utilization of the proper pull pattern is a function of neuromotor skill and limb strength. Given two swimmers with relatively equivalent pull patterns, the fastest swimmer will be the one who is able to generate the most power. However, to conclude that the strongest individual will be the fastest swimmer ignores the overwhelming importance of stroke pattern in determining swim velocity. In addition to the basics of hand angle and acceleration, a stroke pattern can be reduced to four components; outsweep, downsweep, insweep, and upsweep. Furthermore, strokes such as the backstroke and butterfly have other body components that are critical to proper technique including head and hip motion as well as multiple kick patterns.

Four measures of stroke mechanics known to be correlated with maximum swim velocity are stroke efficiency (distance per stroke), maximal stroke frequency, stroke balance, and stroke ripple. These four variables are inter-related, with power being an underlying influence of all four. In addition, the relationship of stroke propulsive efficiency to stroke velocity is influenced by the fact that drag increases to the cube of forward velocity, while forward velocity increases at a slower rate in proportion to stroke velocity. Elite swimmers take fewer strokes per pool length and yet maintain a stroke frequency equal to if not greater than lessor competitors. Balance of stroke reflects the contribution of each of the two arms. Stroke ripple provides an indication of the efficiency of power transfer to overall forward motion as well as the ability to moderate the effects of inertia. In addition to these basic measures of stroke mechanics, more advanced analysis is under development (Costill 1992). During the course of a stroke the time course profile of the various stroke components can provide valuable information for instruction and correction.

Both stroke efficiency and velocity are thought to be developed primarily through water based drills. Distance per stroke can be improved through emphasis of the elliptical pull pattern and hand entrance and hand exit exercises. Stroke frequency is improved by swim sprints at distances shorter than those of any of the competitive events. Sprint assisted exercise, the application of an assisting force, has been suggested as a means of improving both factors. Sprint-assist provides the opportunity to develop stroke velocity and efficiency at higher than maximum speed. A simple technique has been used by coaches to implement the sprint-assist technique via a line attached to the swimmer and the manual hauling of the line. Another method involves the use of a long bungi cord (surgical rubber cord) which is stretched the length of the pool. When the swimmer swims towards the anchor point, the cord contracts and applys an assistive force. Other systems, such as U.S. Pat. No. 3,861,675 which consists of a line, weights, and pulleys, can be used to apply a constant assistive force to a swimmer as well. An experimental system recently constructed at Stanford University employs a hydraulic motor and an overhead cable system which applys an assistive force to the swimmer. Similar methods have been utilized by track athletes. Runners have been pulled behind moving vehicles or have been trained to run on motorized treadmills at speeds above those which they are independently capable of achieving. These methods often result in improvements in stride length and stride frequencies. Floatation devices however, are the most prevalant training aid and are used to modify the bouyancy of the swimmer or of his limbs for the purpose of modifying movement and reducing the energy requirements necessary to sustain floatation. An example of this type of device is disclosed in U.S. Pat. No. 4,804,326.

Training to develop physical conditioning is an important component of swimming success. As is true for most athletic activities, natural ability has a strong influence as well. A high aerobic capacity appears to be a requirement for enhanced endurance in swimming as is the case for long distance running and cycling. A key contributor to strength is the cross- sectional area of primary limb muscles. Thus, it is not surprising to find that the ability to generate power is related to skeletal muscle mass. Several scientific reports exist suggesting a high correlation between competitive swim performance and the ability of the swimmer to produce power as measured by a dry land device. This relationship appears to be particularly true when swimming shorter distances, those accomplished in less than two or three minutes.

One of the key concepts of athletic training is specificity of training. To train for the marathon one must run long distances. To be competitive in cycling, one must cycle. Therefore, the training activity most appropriate to achieving optimal swimming performance is actual swimming. While a number of land based exercise devices have been developed as a means to improve the strength and or muscular endurance of the swimmer, their overall effectiveness has not been determined. Councilman states that high-resistance fast-speed protocols are important for competitive swimming, and are best accomplished by sprinting in the water. The consensus is that aquatic based activity is more appropriate in both the training and assessment of swimmers.

A second key concept of training is that of physiological "overload". An important element of physical adaptation to physical demands is that to achieve optimal results athletes need to train for various elements of the activity in excess of that faced when they compete. Thus in order to develop the strength needed to perform maximally it is argued that loads in excess of those encountered during the event must be experienced during the training phase. These training activities can be placed into four categories, isometrics, isotonics, isokinetics, and biokinetics.

Isometric exercise allows no external muscle shortening or rather changes in joint angle. While clearly improving strength, isometric exercises are of limited use in a dynamic sense and provide few benefits in terms of muscle recruitment patterns. Isotonic exercise utilizes a constant weight moved through a range of motion wherein skeletal muscle shortening and joint angle changes do take place. This is the most common form of "weight lifting" exercise. The criticism concerning this exercise mode is that once the weight attains inertia less effort is required to continue to lift the weight. Also, the limiting factor for lifting the weight is the strength of the weakest muscle required to move it through the entire range of motion. Isokinetic exercise devices use cams or elliptical arcs to overcome this problem. By moving the weights along predetermined arcs the effective weight changes as a function of mechanical advantage. The disadvantage of this exercise mode concerns limited acceleration throughout the range of motion and aforementioned problems with inertia. There has also been criticism of this exercise mode in terms of it's specialized nature and the lack of development of the stabilizers and antagonistic muscle groups.

Biokinetic exercise provides accommodating resistance and acceleration throughout the range of motion thereby obviating the problems of the previously described modes of exercise. Accommodating resistance refers to the fact that muscle fibers employed to move a limb through a range of motion can be numerous and varied. Because the strengths of these muscles differs, a device that can provide the appropriate maximal forces, regardless of the limb dynamics, promotes strength gains at all points throughout complex motions. In line with the complex nature of the ballistic movements associated with the activity of swimming, biokinetic devices will provide the most benefits as they most closely emulate appropriate athletic movements.

Many of the standard dry land exercise techniques are utilized to train swimmers. Isometric and isotonic exercises employed by swimmers are of the dry land variety. In addition to these, specialized dry land devices provide analogs of swimming motions and are classified as isokinetic and/or biokinetic. U.S. Pat. No. 3,731,921 reveals a bench for simulating and developing swimming movement. "The Swim Bench", model 26E from Fitness Systems of Independence Mo., attempts to duplicate the full range of stroke motion on dry land. This device employs a governor controlled frictional mechanism. Other such systems include the BioKinetic Swim Bench of BioKinetics Inc. and the Biokinetic Bench of Isokinetic Inc.. These latter two systems utilize an electromagnetic braking system. Dry land systems such as the various swim benches do not replicate the true stroke dynamics encountered while swimming the crawl nor do they duplicate the metabolic loads required during actual swimming exercise.

The application of resistive forces to the swimmer while swimming may be categorized into three classes. The first includes those techniques employing attachments to a free- swimming person and which utilize hydrodynamic frictional drag. The second category includes those that tether or connect the swimmer to a stationary portion of a pool or dry land. The third classification encompasses techniques which connect the swimmer to a device which permits full swimming motion over the distance of a pool length or lap while applying resistance to that forward motion.

Most swimming resistance devices fall into the first category. A commonly used technique involves the attachment of small tires or other readily available items to the feet or body of the swimmer. U.S. Pat. Nos. 3,517,930, 5,002,268, and 5,011,137 describe variable resistance swimmer training devices which provide various degrees of resistance by employing hydrodynamic drag appendages. In U.S. Pat. No. 4,302,007 Counsilman and Oprean describe a drag belt with drag pockets. In the second class, various ropes, bungi cords (surgical rubber cords), and other lines are employed to attach the swimmer to a stationary object. U.S. Pat. No. 3,988,020 is a swimming exercise and training apparatus which restrains a swimmer in both the forward and lateral directions. U.S. Pat. No. 4,524,711 provides for a tethering line which incorporates a limited amount of stretching. U.S. Pat. No. 4,529,192 alternatively restrains the swimmer with a pair of spring loaded shoulder pads.

The simplest variation of the third class is the use of bungi cords (surgical rubber cords) or lines by an assistant who follows the swimmer along the side of the pool or pays out the line while applying a degree of resistive force. Other more elaborate resistance systems attach to the swimmer via a line or rope and include weights and pulleys, and rotational frictional devices. U.S. Pat. No. 3,861,675 describes a swimmer training device consisting of a line, pulleys, and weights. U.S. Pat. No. 4,114,874 reveals a small, portable appliance which provides the swimmer with a resistive force via a line attached to a rotary frictional device, with a spring line recoil mechanism. The "Long Rope" (Fitness Systems model 65S) employed a mechanism similar to their Swim Bench, but permits the swimmer to exercise in the water. This device was said to provide improvements in stroke technique and resistance training. It was described as portable, isokinetic, variable speed, and possessing the ability to recoil 80 feet of rope. There are other exercise devices such as U.S. Pat. No. 4,934,694 which claim to be mechanically convertible to any sport, and therefore imply applicability to the sport of swimming. Specifics of such modifications are not revealed however, and no mention is made of modifications that would be necessary to the control system for use in swimming.

Assessment techniques require the measurement of various physical parameters during swimming and range from the trivial use of a stopwatch, to elaborate research installations. Measurement of speed is the primary variable of interest in competitive swimming, and is utilized by most swim instructors and coaches. One early device revealed in U.S. Pat. No. 2,825,224 described a spring-balance force scale for the purpose of indicating relative swimming stroke development, The swimmer swam tethered in a stationary position. Recently researchers have begun to investigate the contributions of various muscle groups to the swimming stroke mechanics (Bingham 1993) by employing techniques of electromyography. These investigations may lend insights into both stroke mechanics and muscle fatigue. Hull recently (Kelly 1993) developed a prototype system for the assessment of stroke mechanics in competitive swimmers. This system consists of a hydraulic motor, overhead pulleys and cable system that tows the swimmer through the water at high speeds. This permits the swimmer and coach to analyze differences in stroke at these speeds due to the lowered requirements of propulsion forces which are provided by the towing system rather than the swimmer. One technique for diagnostic measures of stroke mechanics is now commercially available. Bladimiro Mestre of Quebec, Canada, has developed four bio-feedback systems that analyze propulsive forces, resistances, stroke balance, and rhythms. These systems provide visual and auditory feedback based on measured swimming parameters.

The measurement of power production during swimming is one of the major goals of researchers in the field. Measurement of power in the arms has been used as a diagnostic in assessing swimming performance. Sharp (1982), demonstrated correlations between BioKinetic Swim Bench (BioKinetics Inc.) measures and times in the sprint free style. The direct measure of power produced while swimming would be useful, but is highly problematic due to the lack of adequate models of swimming hydrodynamics and bio- mechanics. Toussaint (1988) describes an elaborate system designed to measure power and drag forces during swimming. The method of U.S. Pat. No. 4,654,010 attempts to estimate relative power by the measurement of hydrodynamic pressures on the palm of the swimmers hand. This technique is problematic for theoretical reasons mentioned above.

A power related variable which has been commonly measured in the swimmer is termed excess force or excess power. By means of a tether, the velocity of the swimmer is controlled and the maximal force that can be generated by the swimmer at that set velocity is measured by use of a force transducer. Knowing the swimmer's displacement and the time interval, excess power can thereby be derived. This value, excess power, has been shown to be correlated to swim performance in shorter competitive swim events. A few researchers have developed systems for the measurement of excess force in laboratory. Costill (1986) assembled a computer based system for the measurement of excess force and power during front crawl swimming at one of several preselected speeds. This system utilized an electromagnetic braking system (The Biokinetic Bench of Isokinetic Inc.) adapted to accommodate a long line attached to the swimmer. The device of U.S. Pat. No. 4,082,267 describes the use of the simple voltage controlled generator means incorporated in the Bio-kinetic bench. A voltage signal representing speed and a force measurement derived from a load cell attached to a pulley on the line were supplied to a Personal Computer for recording and plotting. Klentrou (1991) utilizes an apparatus which measures force mechanically in conjunction with an electro-magnetic servo speed control system. This system is an adaptation of the CYBEX apparatus, U.S. Pat. No. 3,465,592. Ria (1990) employed a speed measurement system involving an overhead tethered pulley system. This was cumbersome, but provided an accurate instantaneous speed measure. For force measurement they employed a force transducer in a tethered swim configuration. These two values were multiplied to produce a measure termed "EMP" or External Mechanical Power. Another power measure that has been used for anaerobic power estimates by Rohrs (1991) involves the recording of maximal tethered force integrated over time. Recently, Fry (1991) incorporated aerobic and anaerobic power tests in a battery of tests designed to detect overtraining. Again it is clear that conducting such tests while swimming would be most appropriate for swimmers. The research systems and measures described above and others of generally similar capability are not commercially available.

Various physiological measures may also be used to estimate power production. The upper regions of the heart rate curve provide a somewhat linear indirect measure of the level of intensity of exercise from which relative estimates of swimming efficiency might be calculated. One technique of monitoring heart rate while swimming has been disclosed by U.S. Pat. No. 4,681,118. Dry-land systems such as U.S. Pat. No. 4,998,725 have also employed a direct feedback loop control of exercise resistance based on heart rate. Other physiological measures such as blood oxygen saturation, volumes of oxygen consumed and carbon dioxide expelled may be used as indirect measures of energy production or the metabolic intensity of exercise. Such indirect energy measures have typically been done only in controlled research experiments. Advanced research installations have recently employed swim flumes which permit the swimmer to remain stationary while the water flows around him. This permits researchers to attach various physiological monitoring devices to the swimmer.

It is quite apparent from the foregoing review and discussion that the application of current technologies for swimming instruction, training, and assessment is highly problematic. A review and critical analysis is now presented.

Advanced technology for the kinesthetic development of stroke mechanics during water based activities is not available. While a few commercial flotation, tethering and restraining systems claim to improve stroke mechanics, they provide only passive assistance under artificial conditions. Sprint-assist techniques employing a manual tow line or bungi cords are able to apply only uneven forces that vary over the course of a lap. Weight systems, such as U.S. Pat. No. 3,861,675 or the Power Rack provide constant forces, but only over limited distances, and at fixed force steps which are not practical for the precise individual adjustments which are necessary. The experimental systems such as the Stanford hydraulic towing device are cumbersome, can only be crudely adjusted for applied force, and are not commercially available. The commercial stroke mechanics assessment techniques which are available rely on auditory and visual bio-feedback. It is a well known principle that swimmers rely primarily on kinesthetic feedback ("the feel of the water"). This suggests that visual and auditory feedback are neither optimal nor appropriate for communicating with the swimmer. Any system that fails to provide kinethestic feedback to the swimmer circumvents the primary sensory system employed in the activity of swimming. Kinesthetic feedback-based stroke assessment systems are not commercially available.

Advanced biokinetic technology for training and physical conditioning while swimming is not available. Swimming-based training devices generally provide passive hydrodynamic drag resistance with little control. Mechanical friction devices or weight systems connected to a swimmer via a cable offer more resistance force, but are also passive and lack precise control. Although various dry land commercial devices claim to provide biokinetic exercise for swimmers, specificity of water movement and forces are difficult or impossible to replicate on dry land. Thus the dry land systems which simulate swimming motions are typically poor substitutes for water based drills. This has been supported in recent studies such as Roberts (1991) which failed to find any significant increase in benefit from dry land training that simulated swimming motions over other generic dry land training systems. Furthermore, generic exercise systems offer only restricted limb motions that inadequately provide for the complex muscle combinations encountered during swimming strokes.

Advanced technology for the quantified analysis and assessment of stroke mechanics is not commercially available, while commercial power analysis devices provide only passive measures of force and are incapable of active force measurement protocols. In addition, researchers developing power assessment protocols have had difficulty in adapting dry land biokinetic technology such as U.S. Pat. No. 4,082,267 (Costill 1992, page 179). Furthermore, the adaptation of such devices as the CYBEX provides only limited isokinetic control. Most stroke and power analysis research systems are extremely limited in scope, designed only to measure instantaneous speed and force. Finally, no single research system provides for the quantified analysis of a range of stroke mechanics measures such as stroke efficiency, balance, and ripple or the more advanced stroke component time course profile analysis.

It is also quite apparent from the foregoing review of prior art that no efforts have been made toward the development of a single device which would incorporate swimming instruction, training and assessment. Furthermore, no single device reviewed above incorporates any combination of instruction, training and assessment in further combination with advanced technology.

Many current research and commercial devices for swimming instruction, training and assessment require an assistant due to inadequate mechanical design, safety problems, or complex user interfaces. Clearly the requirement of an assistant limits the application of such devices in many circumstances.

Absent from the various devices and systems reviewed herein are control systems employing parametric biomechanical dynamic models or processing components. Biokinetic technology has relied primarily on the characteristics of analog control feedback loops. Such loops incorporate simple PID control algorithms and deal directly with a single sensor input and electric motor control variable such as voltage. Even devices incorporating microprocessor control provide only limited tragectory force/speed curves, and do not provide for modification of the feedback loop parameters. Other systems which incorporate physiological inputs, such as the aforementioned U.S. Pat. No. 4,998,725 employ a direct feedback loop control of exercise resistance. Such dry-land systems however are able to make simplifying assumptions due to the fact that power produced on a treadmill or cycle may be directly measured. The requirements of kinesthetic feedback and biokinetic motion systems include processing components which are able to dynamically adapt and respond to the complex loads and motions of swimming in real-time based on an indirect measure of activity. A biomechanic processing model accepts an ensemble of physiological and biomechanical inputs calculated from sensor signals and electrodynamic system variables, processes these input variables based on configurational parameters, and outputs a biomechanically based control signal which may then be converted into kinesthetic feedback or biokinetic motion.

Advanced control technology such as microprocessor based systems are not commercially available in swimming instruction, training and assessment devices. Current research systems for swimming instruction, training and assessment employ computers only in the data acquisition operations, and not for control functions. The adjustments of control parameters are performed manually. In addition to U.S. Pat. No. 4,934,694 and U.S. Pat. No. 4,998,725 described above, several generic dry-land exercise and training devices have been revealed recently, such as U.S. Pat. Nos. 4,778,175, 4,869,497, and 4,930,770, which incorporate microprocessors for improved exercise control precision. Other applications include U.S. Pat. No. 4,907,795 which utilizes a microprocessor for monitoring and storage of exercise activity measurements. Such systems however provide protocols of extremely limited complexity, and would not be adaptable to the requirements of swimming instruction, training and assessment. Furthermore, systems such as the aforementioned which employ microprocessors for control and/or monitoring do not provide for the capability of user programmed functions or protocols, but simply provide means for the programming of the parameters of fixed protocol programs. An additional limitation associated with various microprocessor controller systems that operate in conjunction with a personal computer systems is that the controller is either physically located within a personal computer, or is incapable of operating while disconnected from the computer.

In general, there is a lack of advanced technology in devices specific to swimming instruction, training, and assessment. Devices which provide for the techniques of sprint-assist and resistance training during swimming currently employ control and mechanical technology of limited sophistication and thus preclude accuracy and repeatability in their application. In particular, the application of forces to the swimmer during sprint-assist and resistance swimming must be accurately specified and controlled so that the resulting speed is close to the swimmer's natural speed. The greater the deviation from the natural speed, the greater the deviation in stroke mechanics. This requirement for fine percentage adjustment and control is particularly critical when dealing with young swimmers. Various dry-land controllers such as U.S. Pat. No. 4,778,175 rely on tables of values rather than to calculate control variables parametrically. This type of technique is inadequate where flexible complex algorithms are necessary. In order to implement appropriate biomechanical models as described above, advanced signal processing control technology would have to be employed. The requirements of real-time loop processing of complex control models and extensible programmable control models preclude the use of fixed analog or fixed logic control technologies.

Recently, advanced motor control technology such as that disclosed in U.S. Pat. No. 4,910,447 have improved the electric motor control capabilities of exercise devices. Such control methods however are inadequate for applications such as swimming instruction, training, and assessment devices. Swim training devices would require DC motor controllers which operate with very low voltages, over a wide range of currents and motor temperatures, and additionally provide dynamic braking. Furthermore, such devices must include reliable redundant overload and disabling circuits.

A further problematic area of current swimming technology is that of the user interface. For effective use, simple control panels are essential. Dry land exercise systems employing advanced technology often incorporate complex key pads and displays. Research systems, and in some cases generic exercise systems such as U.S. Pat. Nos. 4,869,497 and 4,934,694, employ personal computer systems to provide the user interface which include full alphanumeric keyboards and full page displays. Obviously it would be unfeasible for a swimmer to operate such systems from within a pool. The swimmer must be provided with a conceptually straightforward system that minimizes buttons and switches, as well as the quantity of displayed information.

The measurement of a swimmers physiological and biomechanical variables while swimming requires some form of telemetry. Various systems have been devised to transmit such variables as ECG and hydrodynamic pressure by way of radio telemetry. In consideration of the wide range of variables that may be required for swimming assessment, the problem of interference, available channels, channel bandwidth, and the simultaneous use of several physically adjacent devices, radio transmission becomes problematic. In addition, the size, shape, and location of a radio antenna must be considered as well. A more flexible and convenient system of transmission is clearly warranted.

Advanced technology for the statistical recording of quantified stroke mechanics and physical conditioning assessments for swimming is not commercially available. In addition, research systems providing such statistical summary information do so for only limited variables of interest.

Although various systems as mentioned above incorporate, or communicate directly or indirectly with personal computers, none fully utilizes the possibilities of such communication links. As discussed above, the major shortcoming of previous systems employing communication links is one wherein the personal computer is an integral component of the system. In other systems, the computer provides data collection and statistical functions. Given the complex functional, environmental, and logistic demands of swimming instruction and training in a team or institutional setting, considerable flexibility in the introduction of portable personal computers at pool side is warranted. The use of the external computer link should be complementary to the functions of a swimming device and optional. The data communications hardware interface employed should be generic, such as the RS-232 communications standard. In addition to the interchange of data and operational parameters, such an interface should provide for the downloading of protocol programs of machine language and provide as well for a remote override and replication of the pool side swimming device user interface panel.

The swimming pool environment itself presents several engineering challenges. Electrical safety considerations in a pool area preclude the use of devices that employ AC mains as a power source. In addition, battery powered devices require specialized efficient power control circuitry and dynamic braking techniques, some or all of which are absent in the devices reviewed herein. Another consideration is that of the logistics of installation and physical size. In a crowded pool situation, often with two or more people per lane during practice sessions and a wide variety of starting platform sizes and installation techniques, pool deck space is limited. Many of the commercial or research devices mentioned previously are cumbersome or present a safety risk due to the amount of floor space required adjacent to the pool. Any device for use adjacent to the pool must provide for a convenient and rapid removal. In addition to the above mentioned concerns, installation is often problematic. Due to the nature of tiled decks around institutional pools, the surface is generally slick and permanent installations require the use of specialized mountings.

A major problem in the application of electromechanical technology in a swimming pool environment is the harsh corrosive halogenated atmosphere and pool water. Most devices possess an inherent limitation in their ability to resist such environments. Electromechanical systems susceptible to the corrosive environment may degrade slowly. Electronic systems however will often fail abruptly and completely in these atmospheres. Even if existing dry land systems could be adapted mechanically to swimming, they would be impractical from an economic viewpoint to maintain in such a corrosive environment. Researchers employing technology such as Biokinetic swim bench U.S. Pat. No. 4,082,267, the CYBEX device, and personal computers subject such devices to only relatively brief and periodic exposures to the pool environment. Manufacturers who have adapted dry land systems, such as the aforementioned "Long Rope" have found it necessary to eliminate electronic display devices from their pool side products due to corrosion, and encountered early failures of mechanical friction resistance technology due to water related failures. These and other failures have led to the withdrawal of products from the market. Another problem confronted by most devices is the rapid deterioration of nylon and other readily available synthetic ropes when exposed to pool water over long periods.

It is quite clear therefore that a system incorporating precise and rugged technology, for use by swimmers in a pool environment, that provided kinesthetic feedback for instruction, biokinetic training, and physiological and biomechanical performance assessment, as well as providing programmable measurement and control of complex relationships of speed, force, power, distance, and time, would offer a substantial contribution to the field of swimming.

OBJECTS OF THE INVENTION

Accordingly an object of the present invention is to aid in the instruction and development of swim stroke mechanics with techniques such as sprint assist by the application of kinethestic bio-feedback to a swimmer during swimming.

Another object is to provide water based training with techniques such as overload swimming by application of biokinetic forces to a swimmer during swimming.

Another object is to provide diagnostic assessment of a swimmer's performance while swimming, with such basic measures as stroke efficiency, balance, and ripple, as well as complex procedural measures such as excess and anaerobic power estimates as fully automated procedures.

Another object is to provide an apparatus that combines instruction, training and assessment in a single precisely controlled programmable apparatus which provides for wide ranges of individual capabilities.

An additional object is to provide an apparatus which would permit a swimmer to operate the device without the aid of an assistant.

An additional object is to provide an apparatus which incorporates a programmable biomechanical processing model whose input included biomechanical and physiological measures and whose output consisted of kinesthetic feedback forces applied to a swimmer during swimming.

An additional object is to provide an apparatus which incorporates a programmable and extensible protocol logic controller.

An additional object is to provide an apparatus which incorporates an advanced programmable signal processor based motor controller.

A further object is to provide an apparatus which incorporates a low voltage battery compatible, high efficiency, pulse modulated, dynamically braked DC motor power switch circuit with a provision for an independent force overload and user shutdown capability.

A further object is to provide an apparatus which incorporates a simplified user interface readily available to the swimmer in a pool and which minimizes switch and display complexity.

A further object is to provide for the transmission of physiological and biomechanical data from the swimmer to the apparatus via inductive telemetry.

A further object is to provide for the recording and statistical description of biomechanical and physiological data obtained from the swimmer while swimming.

A further object is to provide an apparatus which incorporates an external portable computer interface link for the transfer of protocol programs to the apparatus, the transfer of data to said computer, and to provide for the remote control of the apparatus from said computer.

A further object is to provide an apparatus which is housed in a convenient portable low profile enclosure.

A further object is to provide an apparatus which provides a high degree of resistance to an environment containing corrosive halogenated water vapor and spray.

SUMMARY OF THE INVENTION

In the present invention, apparatus and methods are revealed for use by swimmers which provide for the several and various protocols associated with kinesthetic feedback based instruction, biokinetic training, and for physiological and biomechanical performance assessment. The swimmer, a coach, or a trainer selects an instructional protocol, training regimen, or assessment paradigm and enters configuration parameters. Once initiated, the specified combination of operations and parameters determine the application of forces to the swimmer during the course of one or more laps in a pool or other body of water. Said forces are applied under the control of a signal processing system as appropriate for kinesthetic feedback or biokinetic resistance. During the course of said laps, various physiological and biomechanical measures are monitored and recorded. Prior to, during, or subsequent to the run of the selected function, data and operational information may be exchanged between the apparatus and an external portable personal computer through a data communications link.

In accordance with the present invention, an instructional, training, and assessment apparatus for swimming is comprised of mechanical means, coupled to controller means, which are further coupled to interface means, telemetry means, and data communication means. Said mechanical means includes a harness means, coupled to cable means, which pass through guide pulley means and force sensor means, coupled to cable drum means and revolution sensor means, coupled to speed conversion means, and coupled to electric motor means. Said controller means includes battery power means, coupled to power switch means, coupled to signal processing means, and coupled to programmable logic and data storage means. Said signal processor means includes a biomechanical model processing means. Said interface means includes a multiplicity of switch means, alphanumeric data display means, audible warning means, and visual warning means. Said telemetry means includes physiological and biomechanical data transmission means mounted on the swimmer, coupled through said cable means, coupled to receiving means and coupled to said controller means. Said data communication means couples said controller means to external general purpose computer means.

The contemplated embodiment of the electronic controller component of the present invention includes various features which provide programmed sequences of events for the implementation of the various instructional protocols, training regimen, or assessment paradigms, as well as monitoring the status of all systems for proper operation, and storing data. Features of the extensible programmable controller include three primary modes of operation; menu mode, remote link mode, and immediate mode. The menu mode includes provisions for the entering of parameters, selection of training or assessment protocols, display of accumulated statistics, automated parameter setup, and automated system calibration functions. An additional feature of the menu system is the provision for the retrieval of configuration parameters and procedural routine pointers, as well as manual entry of parameters. Said parameters and pointers are then entered into tables which are implemented in the run mode of operation. The remote link mode provides for the downloading of protocols, parameters, or commands, and the uploading of data. The immediate mode is a variation of the run laps mode with a default protocol that combines the functions of parameter modification, training, and instruction. This immediate mode is the mode the system powers up in. Another feature of the controller is a recovery mode whereby any halt of operation due to a system error or user halt request is handled. This feature provides for a low force, low speed return of the swimmer and line to the apparatus. The run lap process provides for the implementation of the various training and assessment protocols as previously specified during the menu mode of operation. The run lap process first performs any protocol specific setup procedures, then performs a lap out, a lap in, and a data recording sequence for a previously specified number of cycles. After the completion of these cycles, any final protocol specific procedures are performed. Finally, any statistical summations of recorded data are calculated.

An additional feature of the electronic controller includes the ability to employ complex relationships of speed, force, power, and distance in both open and closed loop control of the dc motor. The electronic controller includes a signal processor for the monitoring and processing of various electrodynamic and sensor signals and to employ such signals in the control of the electrodynamic mechanism. Features of the signal processor include a time course control parameter function, a biomechanical model, a feedforward path, a feedback path, and an electromechanical model.

Another feature of the electronic controller is that of an unique FET power switch circuit whereby, in conjunction with relays and switches, the mode of operation may be transferred from positive motive force to negative resistive force. Said switches include the user halt push button, and a force sensing cutout switch actuated from the pulley guide means and electrically connected to a relay for immediate change to neutral mode during the condition of overlimits of force on the line or user actions. A key feature of this independent cutout system is that it is able to reliably over-ride the programmable controller functions at any time.

The contemplated embodiment of the user interface component of the present invention includes various features which provide a simple user friendly interface for the selection of various functions and for the entering of parameters and configurational information. One of these features provides for a clearly visible, compact alphanumeric display. Proximal to this display are a multiplicity of pushbutton switches featuring excellent tactile feedback and discernibleness. Said pushbutton switches provide such functions as RUN and HALT. The selection of operational mode and parameter entry via increment and decrement are provided by switches of the rocker type. Another feature is the provision of an audible alarm to alert the swimmer or instructor to various situations requiring attention. In addition to, and in conjunction with, the audible alarm is the provision for a multicolored visual alarms. Said lights would enable the user to distinguish the identity of the unit in multiunit installations, as well as discern additional information as to the nature of the alert. Another feature of the user interface is the mounting of the display panel, switches, lights, and audible alarm proximal to the pool deck edge and oriented towards the swimmer.

The contemplated embodiment of the physiological and biomechanical telemetry component of the present invention includes a novel telemetry means which employs an inductive coupling over the swimmer's line which includes an electrically conductive component. Said line means thereby provides both motive force coupling and telemetry coupling to the main apparatus. The telemetry means further features multiple channels of analog and periodic pulse signals.

The contemplated embodiment of the data communications interface means features standard personal computer interface specifications such as an RS-232 communications port. In addition to the interchange of data, operational parameters and programs, the interface would provide for remote over-ride of the user interface panel. This remote control function would replicate the functions of the main assembly's user interface on the external personal computer.

The contemplated embodiment of the mechanical assembly of the present invention includes the use of teflon coated stainless steel aircraft wire which provides a strong and flexible cable for the transmission of motive forces. Other features include the use of a lightweight plastic cable drum which is synchronously driven from the bailer worm via a chain driven from the transmission which in turn is powered by a permanent magnet DC motor. A novel feature of the worm driven bailer is the use of a pulley to reduce frictional losses on the cable. An additional feature is the configuration of the pulley guides, worm driven bailer pulley, and cable drum wherein said bailer is mounted towards the center of, and internal to the main enclosure in a manner which provides for a compact profile. In addition, said cable mechanism configuration, in conjunction with the aforementioned characteristics of the pulley bailer, permit the optimization of space requirements. Another feature of the mechanical system includes a single mounting bolt means for securing the apparatus housing to the pool deck.

Other features of the mechanical assembly provide for reliable operation in a wet environment. The corrosion resistant teflon coated aircraft cable possesses inherent water repellant characteristics. In addition, the cable passes through a water shedding brush means to remove a majority of residual water from the line before it passes into the apparatus. Another feature is fabrication of the main enclosure from hi-impact chemical resistant plastic. In order to ensure proper operation, the main enclosure has a water condensation sensor located within it to monitor for possible leaks. Within the main enclosure, a plastic cable drum and stainless steel bailer worm drive also add to the corrosion resistant design. The gear and chain transmission is housed in a sealed enclosure featuring sealed bearings. In addition, the overall mechanical layout isolates the bailer and other mechanical systems from direct contact with the external environment. Another protective feature is the placement of the electronic controller within a water tight enclosure which includes sealed connectors to prevent contact failure. Finally, the battery power source enclosure is separate from the main apparatus enclosure to avoid the possibility of acidic fumes reaching any electromechanical systems.

Additional objects, features, and advantages of the present invention will become apparent to those skilled in the art upon consideration of the following illustration of the contemplated embodiment presented in the detailed description and accompanying drawings.

BRIEF DESCRIPTION OF THE DRAWINGS

The detailed description of the contemplated embodiment makes reference to the accompanying figures in which:

FIG. 2C is a detailed side view of the bailer carriage.

FIG. 3 illustrates a front view of one possible embodiment of the user interface panel in accordance with the disclosures of the present invention.

FIGS. 6A and 6B are block diagrams of a microprocessor based controller as one possible embodiment of the electronic controller and motor controller hardware in accordance with the disclosures of the present invention.

FIG. 10A is a Task executive procedure wherein the main task control and interface loop is managed.

FIG. 10G retrieves the protocol configuration information in preparation for running laps.

FIG. 10H provides the user with a simple interface with which to display various statistical data.

FIG. 10T is the Lap Error recovery procedure.

DETAILED DESCRIPTION OF THE PRESENT INVENTION

Referring now more particularly to the figures, diagrams, and logic flow charts enumerated as numbers 1 through 12, the following detailed description of mechanical drawings, block diagrams, schematics, and logical flow diagrams shall serve to illuminate various particulars of an illustrative embodiment of the disclosures and teachings of the present invention. Throughout the following description are several references to specific mechanical and electrical components which serve to clarify various aspects of the invention. It will be obvious that these specific component references are not limitations and that the teachings and disclosures of the present invention may be practiced with alternative components. In other instances, structures well known and obvious to those skilled in the art have been omitted or have not been described in detail in order to avoid unnecessary complexity which would tend to obscure the teachings and disclosures of the present invention.

Figure 1:
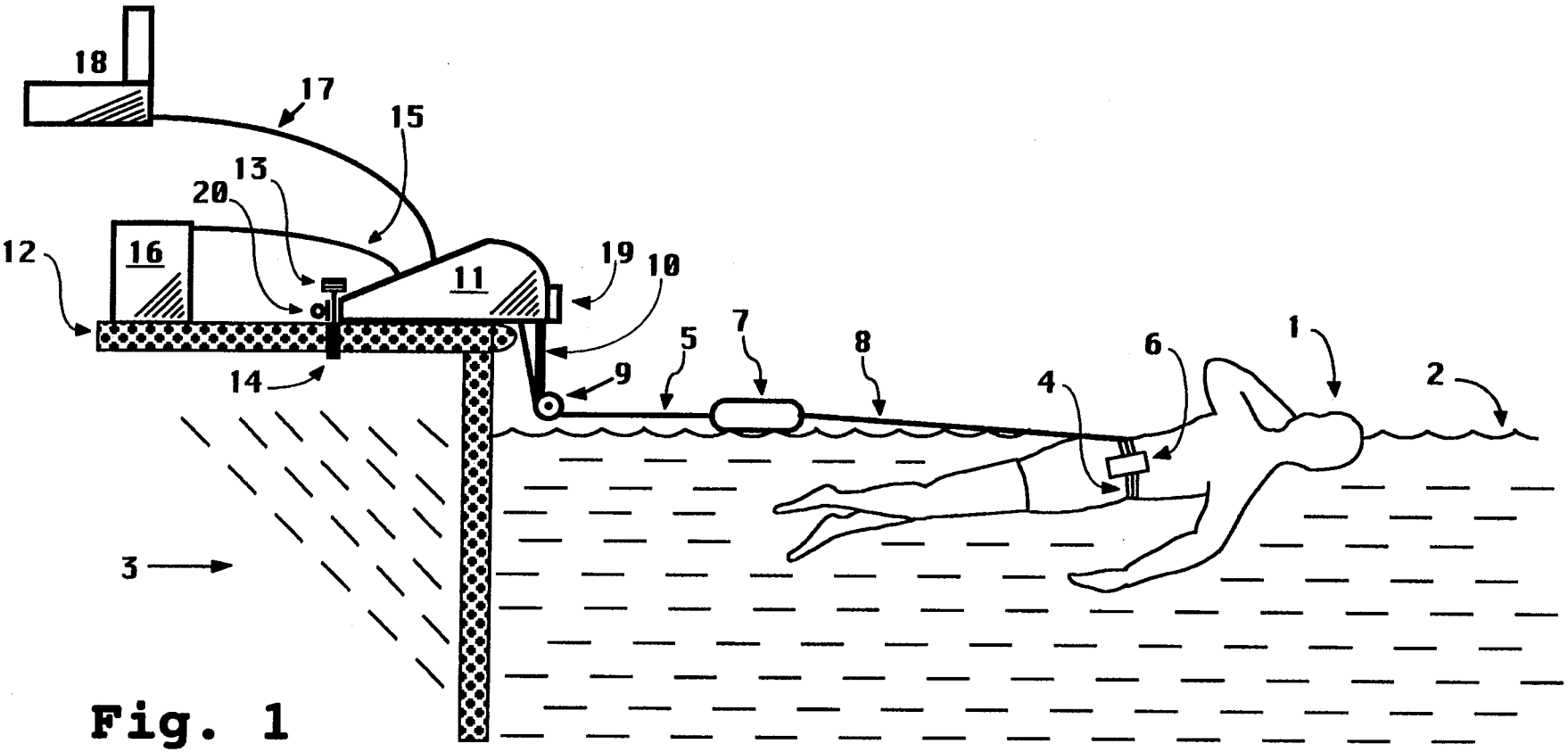
FIG. 1 depicts an embodiment of the present invention mounted at poolside, accompanied by battery pack and portable personal computer, and attached to a swimmer via a line and harness assembly.

Referring now to FIG. 1, a swimmer herein referred to by the numeral 1 is depicted on a surface 2 of a body of water in a pool or other containment 3 and is attached at the waist via a harness 4 to a teflon coated stainless steel aircraft cable 5. In addition, the harness 4 provides for the attachment of a telemetry transmitter 6 to the swimmer. A float 7 is attached to the cable 5 just before the swimmer and for that length of cable a synthetic rubber jacket 8 encases the cable 5. Subsequently, the cable 5 is directed upwards from the water surface 2 by a pulley 9 mounted to a pulley arm 10 which extends from the main assembly 11 mounted on the deck surface 12 of the pool 3 and secured with a mounting bolt 13 to a threaded deck mount 14. A power conductor cable 15 connects the main assembly 11 to a battery assembly 16. A data cable 17 provides a communication link from the main assembly 11 to a portable personal computer 18. A user interface panel 19 is mounted facing the pool 3 on the main assembly enclosure 21. Handle 20 is attached to main enclosure 21.

Figure 2A:
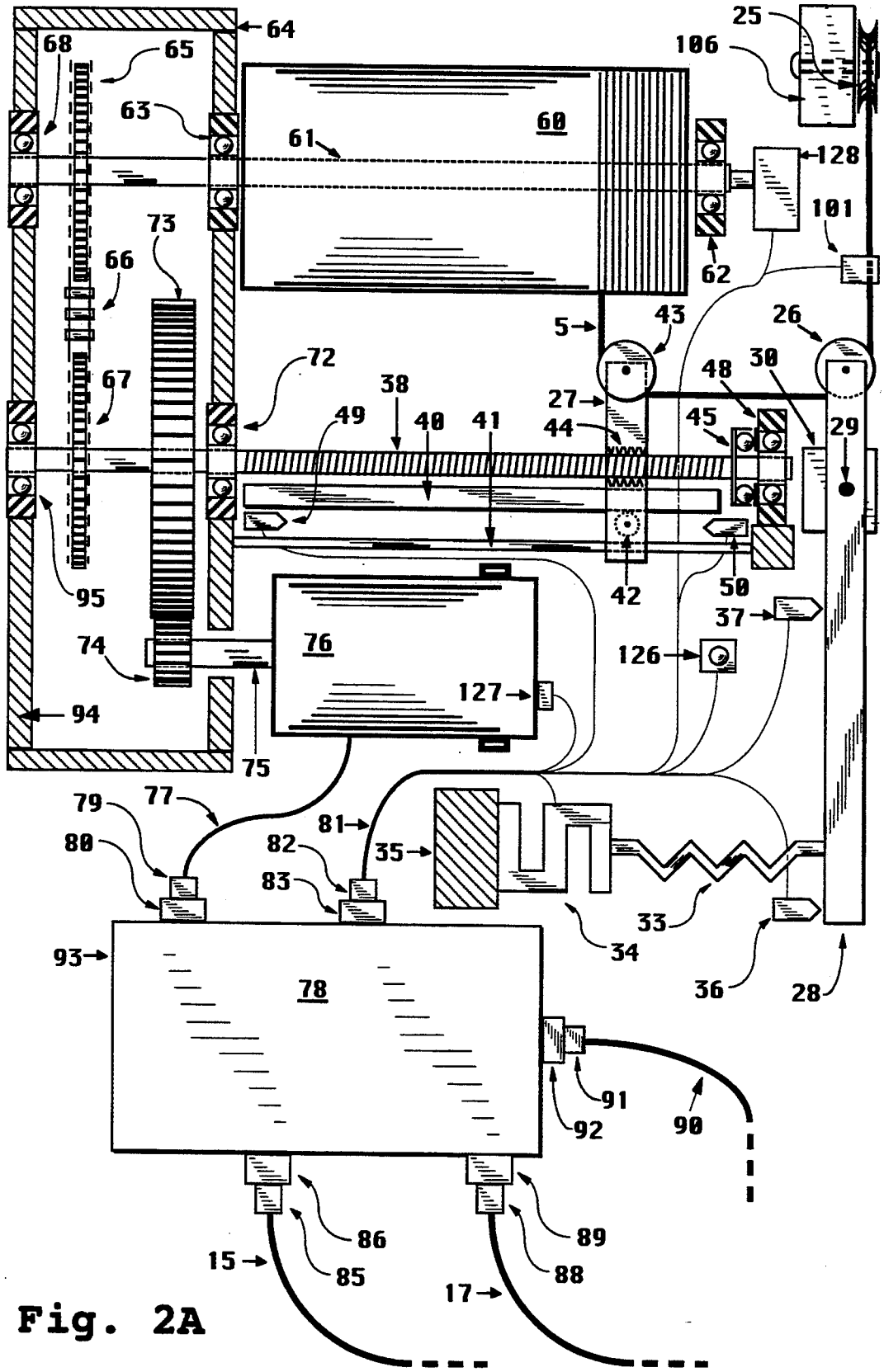
FIG. 2A is a top view of one possible embodiment of the present invention illustrating several of the principle mechanical features including the line guides, force monitor, bailer, drum, drive mechanism, and DC electric motor.

Referring now to FIG. 2A, the coated steel aircraft type cable 5 enters from below the main assembly 11 and is guided to a horizontal direction by a pulley 25 attached to mounting 106. From pulley 25, the cable 5 is routed through inductive pickup 101 and subsequently ninety degrees around a force arm pulley 26 towards a bailer 27. The force arm 28 transfers the load force via a pivot shaft 29 and mounting 30 to a stainless steel spring 33 and subsequently loadcell 34. The loadcell 34, which is to be rated at 50 pounds load, and possesses an environment rating equal to, or exceeding a NEMA Type 4X or an IP67 rating, is fastened to a mounting 35. Force arm 28 is fabricated from stainless steel or other corrosion resistant materials. The force arm 28 engages in turn a high force switch 37 and subsequently a low force switch 36, both of which possess an environment rating equal to, or exceeding a NEMA Type 4X or an IP67 rating. Bailer 27 is comprised of a stainless steel right hand acme threaded worm drive screw 38, an acme threaded nut 44, a bailer track 40, and a bailer counter torque stainless steel rod 41. The rod 41 stabilizes the bailer 27 in conjunction with a bailer track roller 42 positioned against the bailer track 40. The rod 41 provides counter torque to that transferred to the bailer 27 by the worm drive screw 38 while track roller 42 provides a force vector opposing that produced by the cable 5 upon a bailer pulley 43 which is mounted in the same plane as the track roller 42 and to the front of bailer track 40. Pulleys 25, 26, and 43 should all be fabricated from CPVC, DELRIN, stainless steel, or other corrosion resistant materials. The right hand acme thread nut 44, through which the bailer acme worm drive screw 38 transmits lateral force to the bailer 27, should be of a Delrin or similar composition. Said lateral force is opposed by a worm screw bearing 45 adjacent to a shaft bearing 48 on the worm screw 38. A reel-in limit switch 49 and a reel-out limit switch 50 are actuated by the bailer 27. The above mentioned switches 49 and 50 must have a rating equal to, or exceeding a NEMA Type 4X or an IP67 rating. A cable drum 60 receives the cable 5 and rotates via a drum shaft 61 on drum bearings 62, 63, and 68. The drum shaft 61 is coupled to an optical quadrature rotary encoder 128. The cable drum shaft 61 is driven by a transmission 64 comprised of a sprocket 65 mounted on the drum shaft 61, and coupled by a chain 66 to a second sprocket 67 mounted on the worm drive screw 38. Transmission 64 is further comprised of two sets of worm shaft bearings 95 and 72 which support the worm shaft 38 and are mounted in transmission housing 94. Drive power is transferred to a worm shaft gear 73 by a motor pinion 74 mounted on a motor output shaft 75. A sealed DC electric permanent magnet motor 76, possessing an environment rating equal to, or exceeding a NEMA Type 4X or an IP67 rating drives the motor shaft 75. A temperature sensor 127 is mounted on the motor 76, and is connected to a cable harness 81. The motor power cable 77 is connected to the electronic controller 78 via a plug 79 and mating socket 80 mounted on an electronics enclosure 93. Enclosure 93 is to possess an environment rating equal to, or exceeding a NEMA Type 4X or an IP67 rating, as well as provide for RFI shielding. Adjacent to motor 76 is a condensation detector 126 which in turn is connected to cable harness 81. The sensor and switch cable harness 81 is connected to the electronic controller 78 via a plug 82 and a mating socket 83 mounted on the electronics enclosure 93. The battery power cable 15 is connected to the electronic controller 78 via a plug 85 and a mating socket 86 mounted on the electronics enclosure 93. An external computer link cable 17 is connected to the electronic controller 78 via a plug 88 and a mating socket 89 mounted on the electronics enclosure 93. The user interface panel 19 is connected via a cable 90 to the electronic controller 78 via a plug 91 and a mating socket 92 mounted on the electronics enclosure 93. All above mentioned plugs and sockets are to possess an environment rating equal to, or exceeding, a NEMA Type 4X or an IP67 rating and having exposed areas fabricated of PVC and stainless steel or equivalent corrosion resistant materials. Main enclosure 21, pulley mounting 106, force arm mounting 30, bailer 27, cable drum 60, transmission housing 94, and loadcell mounting 35 are all fabricated from a chemically resistant plastic such as PVC, CPVC, TEFLON, or similar material. All mechanical and electrical components in general, and switches 36, 37, 49 and 50 in particular should not have any exposed NYLON or aluminum material. Such materials may be present within housing 94, or enclosure 93 however. In general, all exposed metals should be fabricated from stainless steel, and all exposed plastic components should be PVC, CPVC, TEFLON or DELRIN where appropriate.

Figure 2B:
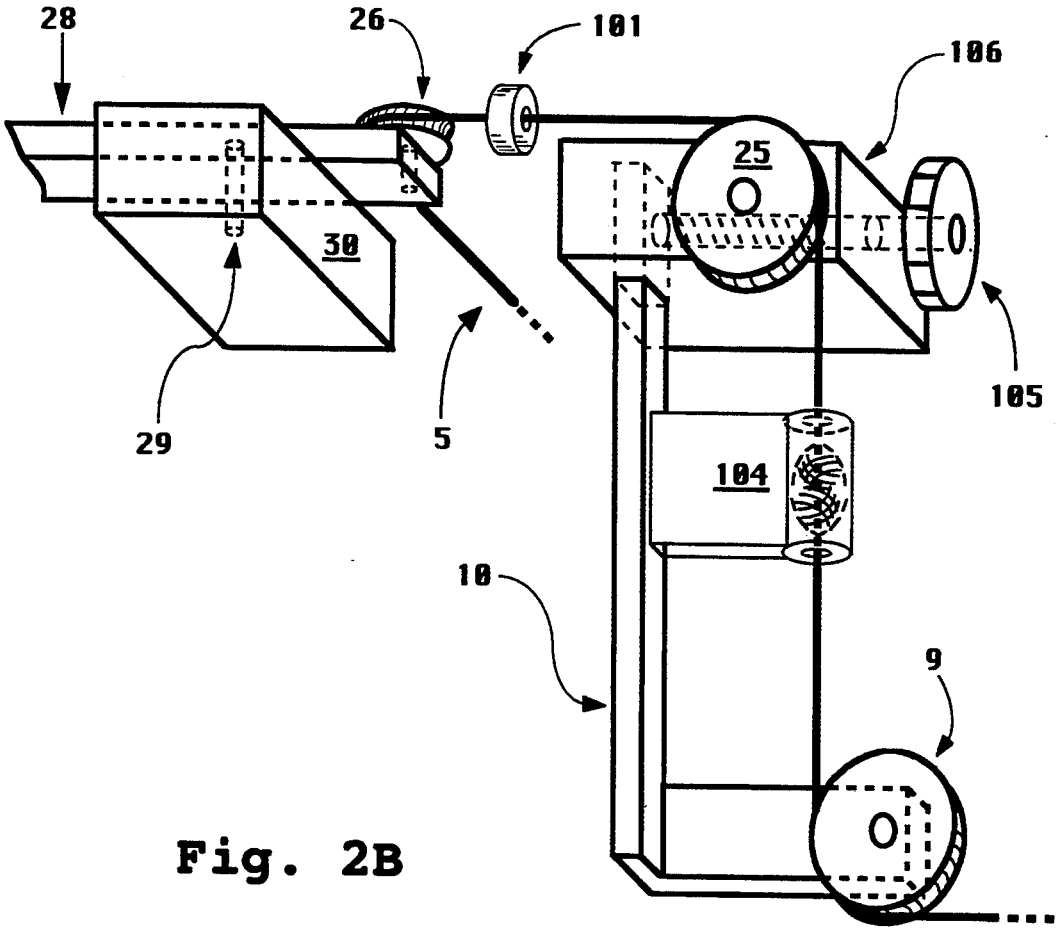
FIG. 2B is a front view of the front and lower guide pulleys and water shedding brush.

Referring now to FIG. 2B, the force arm 28 mounted on the force arm pivot 29 guides the cable 5 throughout a ninety degree turn around the force arm pulley 26 affixed to mounting 106, through an inductive pickup ferrite core 101, over the upper guide pulley 25 through a ninety degree turn, through a water shed brush 104, and finally through a ninety degree turn around a lower pulley 9 mounted on a removable attachment arm 10. Pulley 9 should be fabricated from CPVC, DELRIN, stainless steel, or other corrosion resistant materials. The attachment arm 10 is locked in place by a thumb wheel screw 105 in the mounting 106. Attachment arm 10 should be fabricated from stainless steel or other corrosion resistant material. Note that a base for the main assembly enclosure 21 is not displayed in the figure in order to depict the cable route more clearly.

Referring now to FIG. 2C and generally to the bailer 27, a bailer counter torque rod guide bore 100 is shown on a side view of a bailer body 39. Below and perpendicular to the bailer body 39 is the bailer track 40 which is engaged by the bailer track roller 42 which transfers the load force from the bailer body 39 to the track 40. The acme threaded worm nut 44 which runs through the bailer body 39 is located behind and above the bailer pulley 43.

Referring now to FIG. 3, the user interface panel 19 is comprised of halt push button switch 110, a display interface rocker switch 111, and an alphanumerical display 112. The user interface panel is further comprised of a second display interface rocker switch 113, and, lastly, a start push button switch 114. All of the four above mentioned user interface switches are to possess an environment rating equal to, or exceeding a NEMA Type 4X or an IP67 rating. Display 112 is enclosed in a housing which possesses an environment rating equal to, or exceeding a NEMA Type 4X or an IP67 rating. The user interface is further comprised of a series of visual displays above the alphanumeric display 12. These displays from left to right consist of a red warning alert visual display 115, a yellow caution visual display 116, and a green ready alert display 117. In addition, the user interface is comprised of an alert sound transducer 118 positioned below and to the center of alphanumeric display 112, and the interface cable 90 which connects the user panel components to the electronic controller 78.

Figure 4:
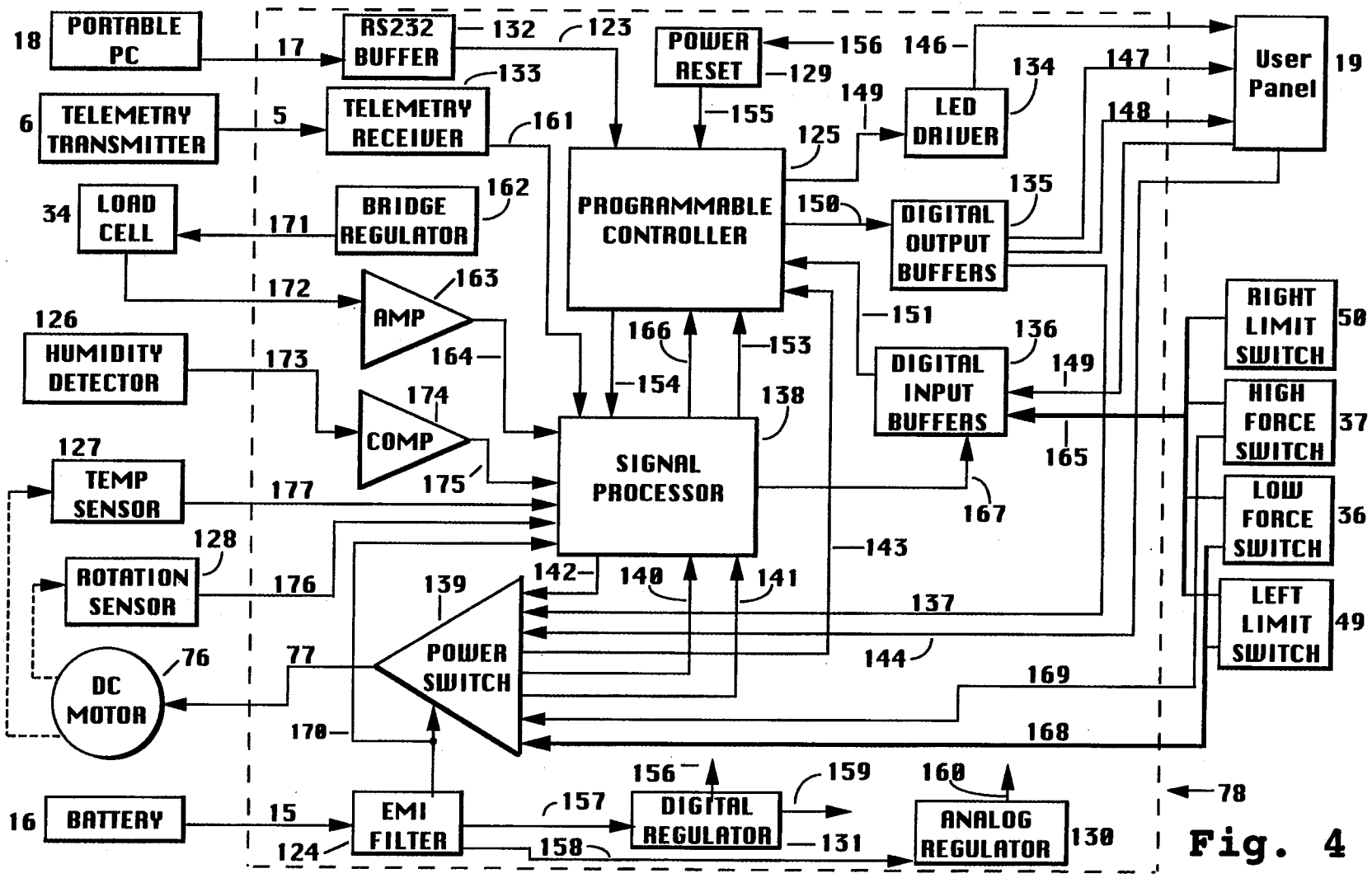
FIG. 4 is a block diagram summary of the electronic components and systems in accordance with the disclosures of the present invention.

Reference is now made generally to FIGS. 4 through 9 wherein various connections are represented by double width lines for convenience and clarity of illustration. That they represent a number of parallel or related paths will be obvious to .one skilled in the art. Referring first to FIG. 4 the electronic controller 78 is comprised of a programmable controller 125, which performs the functions detailed further which is more completely depicted in FIG. 6A and in the flow diagrams of FIGS. 10A through 10T, and an IEEE RS-232 communication cable 17 which interfaces to the external portable computer 18 through a serial communication interface buffer 132 such as a MAXIM Integrated Products model 233 to the programmable controller 125 over signal line 123. An EMI filter 124 through which power from the battery assembly 16 via power cable 15 is fed has output line 158 coupled to an analog voltage regulator 130 with output 160, a line 157 couples to a digital voltage regulator 131 with an output 159, and a line 170 which couples power to all circuits requiring unregulated battery voltage. A powerup reset device and monitor 129 such as a MAXIM Integrated Products model 695 monitors the digital voltage regulator 131 via signal line 156 and sends a reset signal to the programmable controller 125 over signal line 155. The controller 78 is further comprised of a bank of LED drivers 134 whose input is a group of signal lines 149 from the programmable controller 125 and whose output is a group of signal lines 146 which drive user interface 19 LEDs 115, 116, 117, and sound transducer 118. A digital signal output buffer 135 has as inputs a group of twelve signal lines 150 from the programmable controller 125. Buffer 135 has twelve outputs which include a group of signal lines 147 which provides display data to the user panel 19, a group of signal lines 148 which provides display control signals to the user panel 19 and an enabling signal line 137 which controls the operation mode of a power switch 139. Controller 78 is additionally comprised of a bank of twelve digital signal input buffers 136 whose outputs are a group of signal lines 151 connecting to the programmable controller 125 and whose inputs include a group of six switch signal lines 149 from the user panel 19, and signal line group 165 coupled to portions of mechanism switches 36, 37, 49, and 50. Input buffer 136 additionally receives an input from a Lapend signal line 167 of Signal Processor 138.

Figure 5:
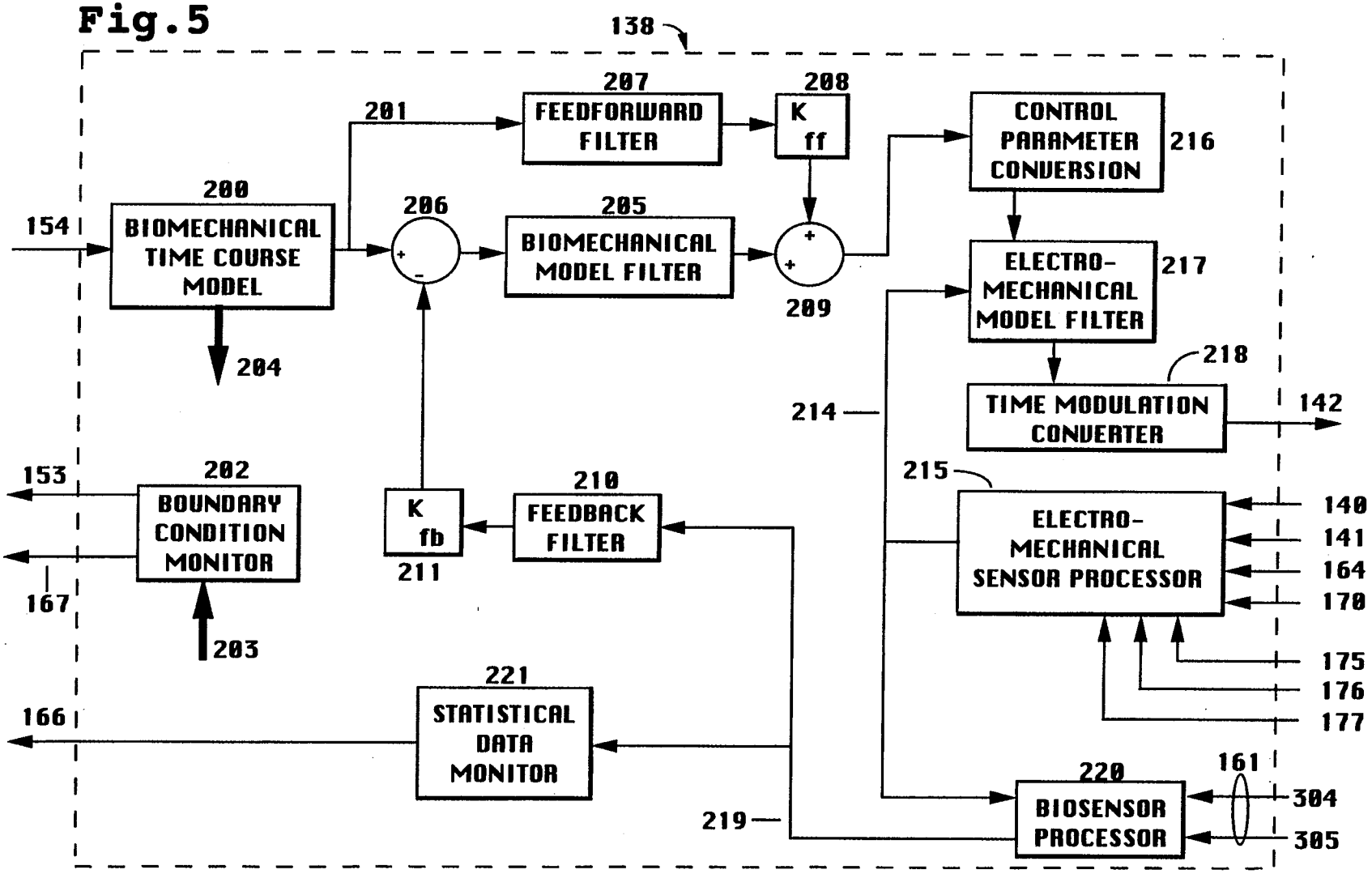
FIG. 5 depicts a block diagram of an illustrative motor controller which would function as one possible embodiment of a motor controller in accordance with the disclosures of the present invention.

Electronic controller 78 is additionally comprised of a signal processing circuit which performs the functions detailed in FIG. 5 and which is further depicted in FIG. 6B. Interconnecting programmable controller 125 and Signal Processor 138 are configuration parameter data pathway 154 transferring data from controller 125 to processor 138, variable data pathway 166 transferring data from processor 138 to controller 125, and interrupt signal 153 with which processor 138 signals controller 125 that an exception condition exists. Controller 78 is further comprised of a telemetry receiver 133, connecting to the Signal Processor 138 via multiple signal path 161 and receiving telemetry signal over cable 5 from transmitter 6. Additionally, electronic controller 78 is comprised of a bridge excitation supply 162 which connects to loadcell 34 via lines 171, bridge amplifier 163 which amplifies loadcell 34 signals coupled via lines 172, and which provides amplified output signal 164 to Signal Processor 138. Electronic controller 78 is further comprised of condensation sensor 126 which consists of a metal film pattern with an insulation gap between two conductors of two signal lines 173 which serve as inputs to comparator 174. The output 175 of comparator 174 is connected to Signal Processor 138 via a line 175. Motor shaft rotary pulse encoder 128 and motor temperature sensor 127 are coupled to Signal Processor 138 via signal line groups 176 and 177 respectively. Electronic controller 78 is further comprised of a power switch circuit 139 which drives motor 76 through lines 77. Motor current and voltage signals from power switch 139 are routed via lines 141 and 140 respectively to Signal Processor 138. A drive signal input line 142 connects from Signal Processor 138 to power switch 139 and power switch disable warning line 143 connects from power switch 139 to controller 125. Additionally, power switch 139 receives input signal line group 144 from interface panel 19, and input line groups 168 and 169 from low force switch 36 in series with left limit switch 49 and high force switch 37 respectively.

Referring now to the functional block diagram of FIG. 5, Signal Processor 138 is comprised of a Biomechanical Time Course Model 200 which is configured via coefficients and parameters over data path lines 154 from the programmable controller 125. The output 201 of the Time Course Model 200 drives the Biomechanical feedforward filter 207 and a positive input of summation block 206, the output of which is fed into a Biomechanical model filter 205. The output of feedforward filter 207 is multiplied by a summation coefficient 208 and subsequently summed in a summation stage 209 in conjunction with the output of the Biomechanical Model filter 205. The summation stage 209 output drives a Control Parameter Converter 216 which drives an Electromechanical Model filter 217 which in turn drives a Modulation Converter 218. The output 142 of converter 218 subsequently drives power switch 139. Electrical and mechanical signal lines 140, 141, 164, 170, 175, 176, and 177 are processed by an Electromechanical Sensor Processor 215 whose output 214 is connected to a Biosensor Processor 220 along with the Biotelemetry signal lines 304 and 305. Sensor processor output 214 is also fed to modulation converter 218. The output 219 of Biosensor Processor 220 is connected to a Statistical Data Monitor 221 and a Biomechanical Feedback filter 210. The Biomechanical Feedback filter 210 output is multiplied by a summation coefficient 211 and the result fed to the negative input of summation stage 206. The output of the Statistical Data monitor 221 is connected to the programmable controller 125 via data path lines 166. A Boundary Condition monitor 202 receives input lines 203 from all stages of the processor 138, and outputs the Lapend signal 167 and the error interrupt line 153 to the programmable controller 125. All of the above described blocks 205, 207, 208, 210, 211, 216, 217, 218, 215, 220, 221, and 202 of processor functional diagram 138 are configured by the Control Parameter data path lines 204 which connect the Biomechanical Time Course model 200 to all said blocks. Time Course model 200 provides configurational filter and polynomial coefficients, parameters, and boundary criteria obtained from controller 125, or calculated by model 200. As mentioned previously, the data path lines are comprised of multiple pathways, typically 8 or 16 lines for data and various control and handshaking lines as are obvious to one skilled in the art. In addition, the signal paths 201 and 219 represent multiple biomechanical control signals including typically velocity, torque, power, and various derivations thereof.

Figure 10A:
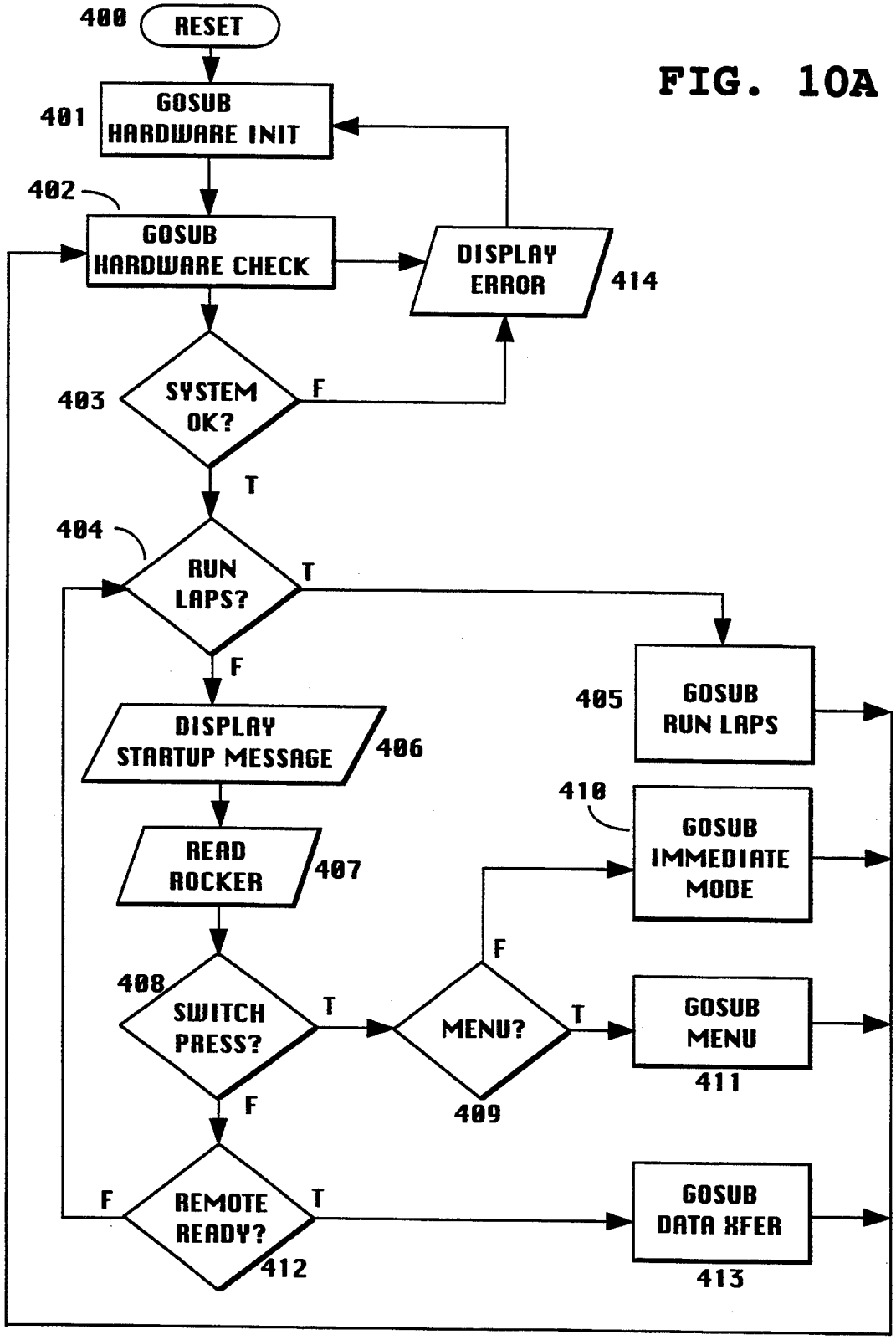
FIGS. 10A through 10T serve to illustrate procedures logic, and algorithms that, when implemented in logic hardware or coded into machine language, would provide the control functions disclosed in teachings of the present invention. More specifically.
Figure 10B:
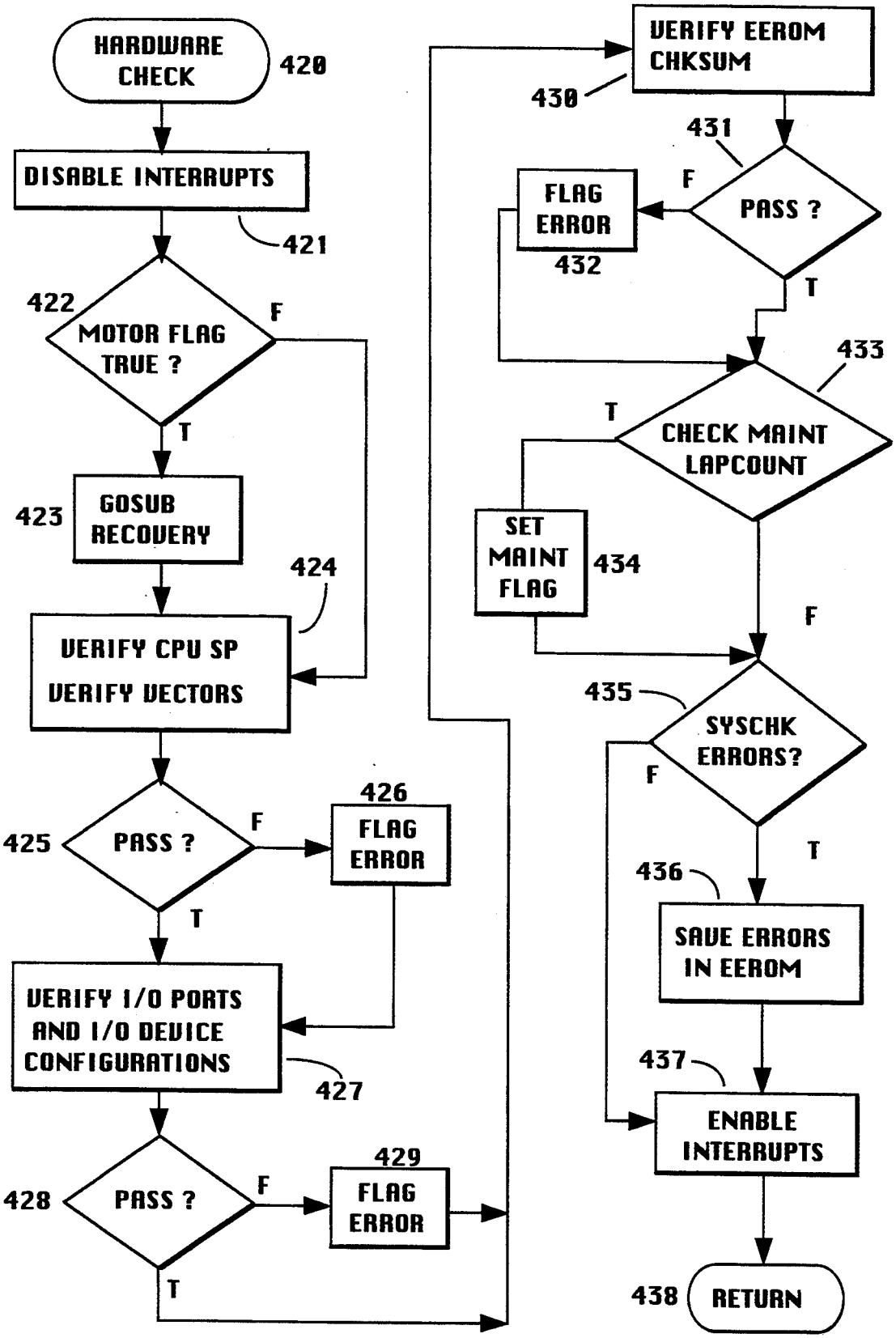
FIG. 10B is a Hardware Check procedure which verifies the operational status of all systems.
Figure 10C:
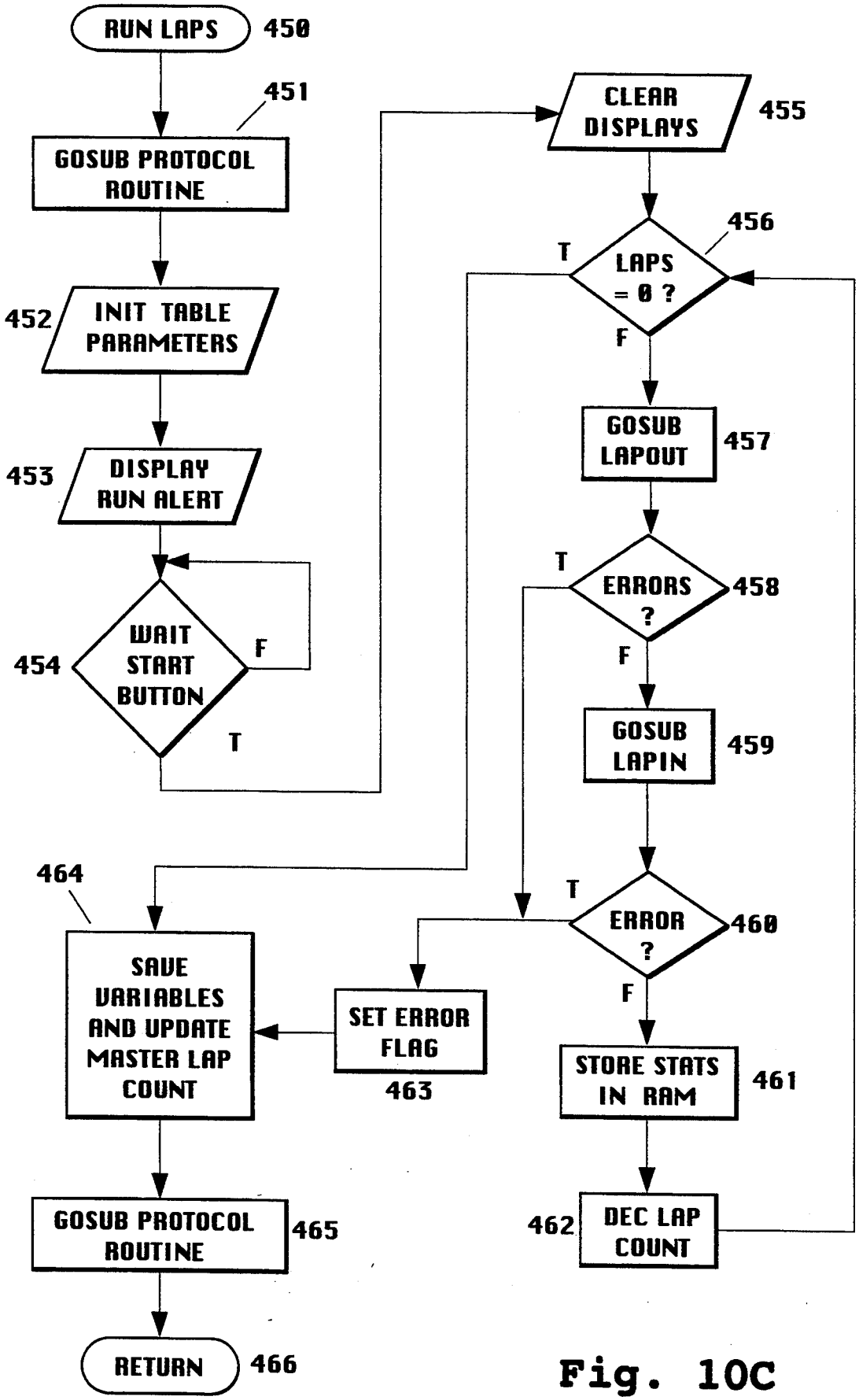
FIG. 10C is the lap operations management procedure wherein the various protocols are run.
Figure 10D:
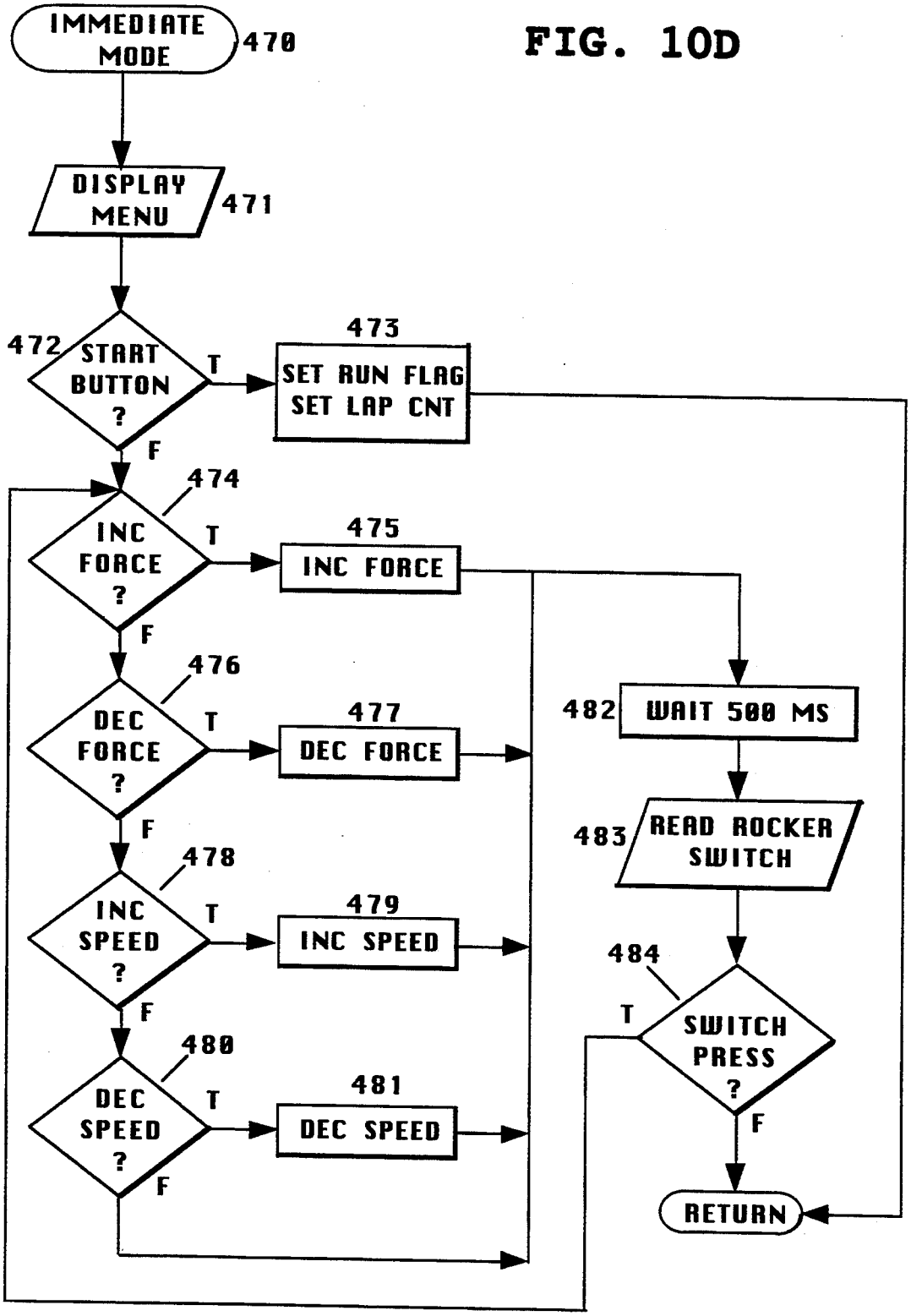
FIG. 10D is the Immediate or "default" mode of operation which provides a basic level of operation.
Figure 10E:
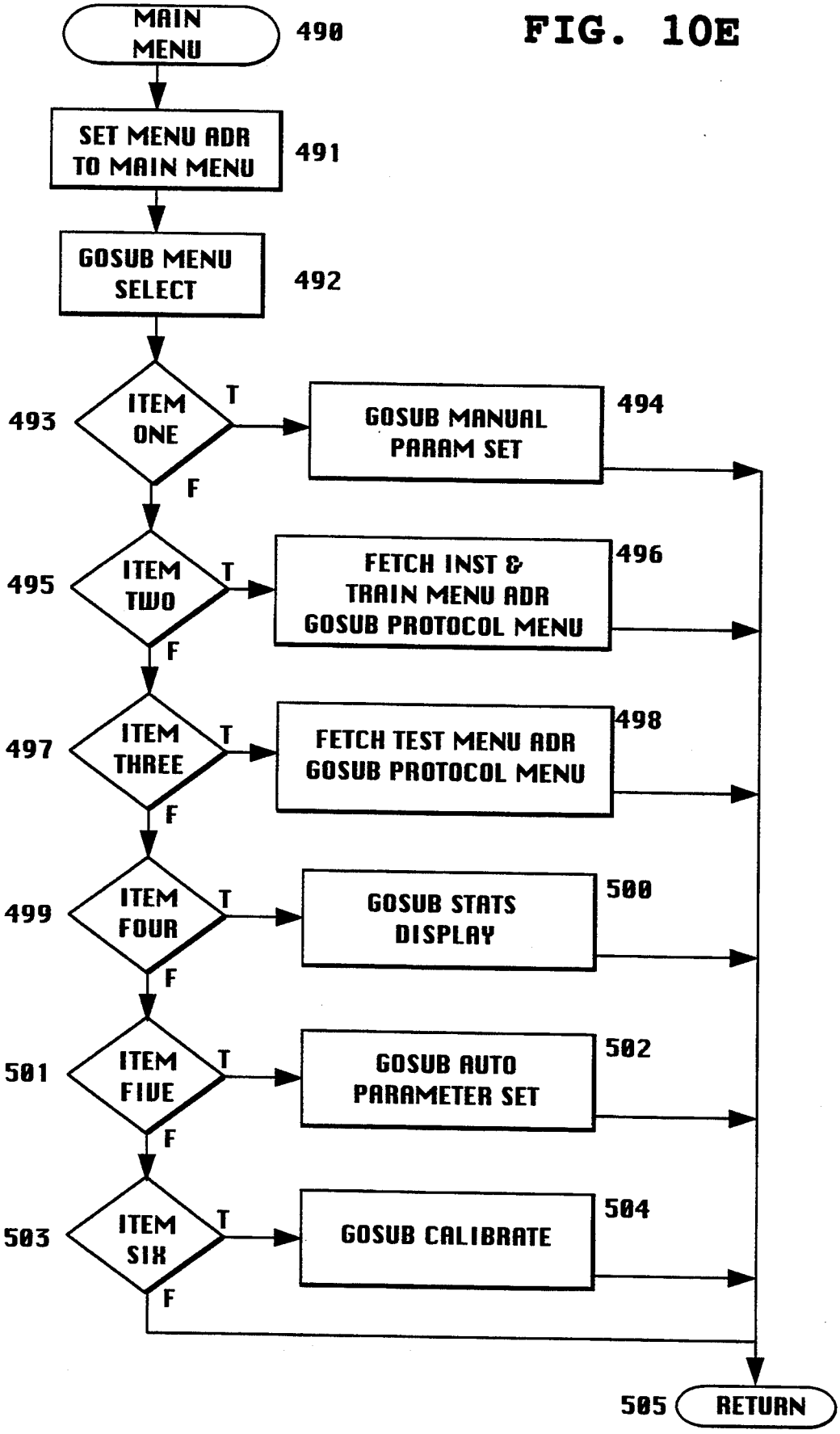
FIG. 10E is the Main menu from which the protocols and other functions are selected by the user.
Figure 10F:
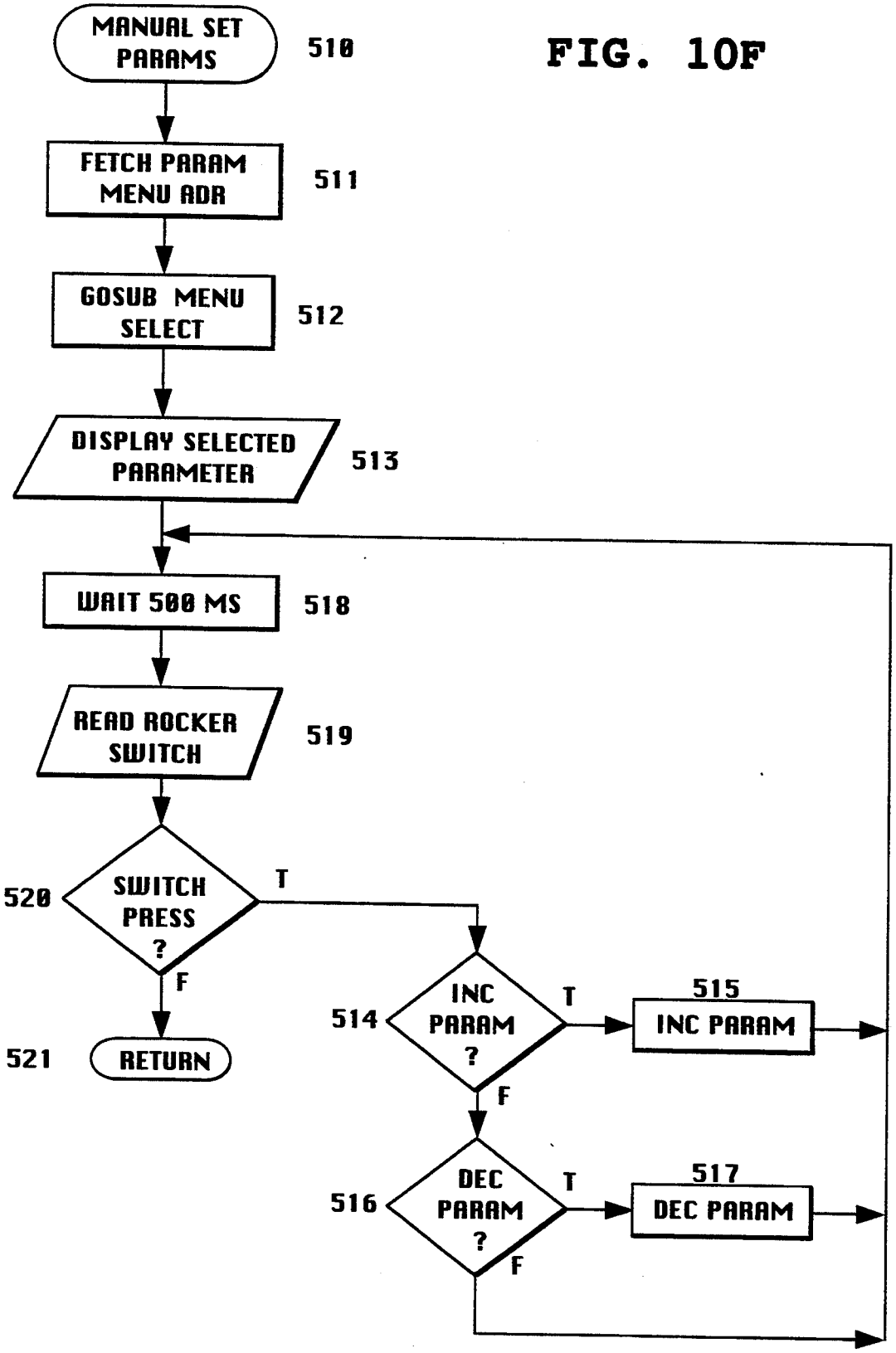
FIG. 10F provides for the Manual setting of various protocol parameters by the user.
Figure 10I:
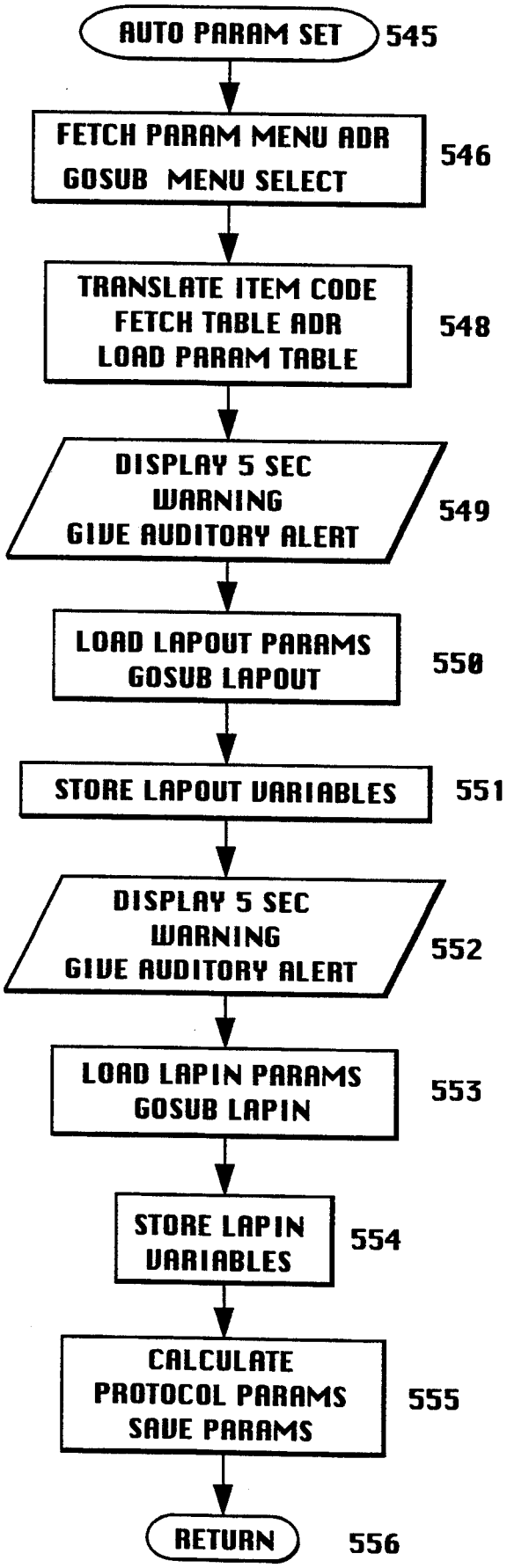
FIG. 10I is an automated parameter configuration procedure which runs special laps for that purpose.
Figure 10J:
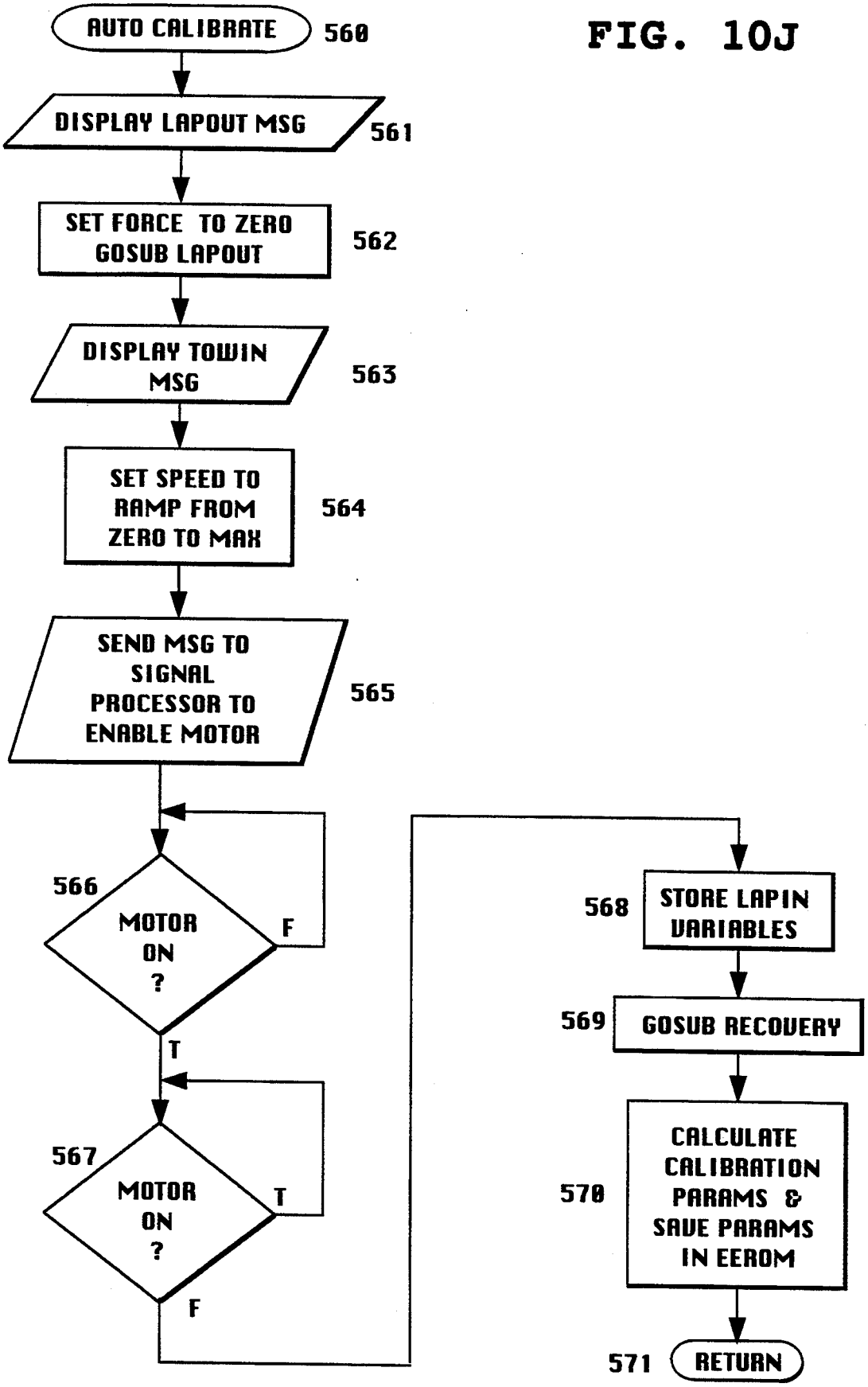
FIG. 10J is a hardware calibration and verification procedure in which special laps are run as above.
Figure 10K:
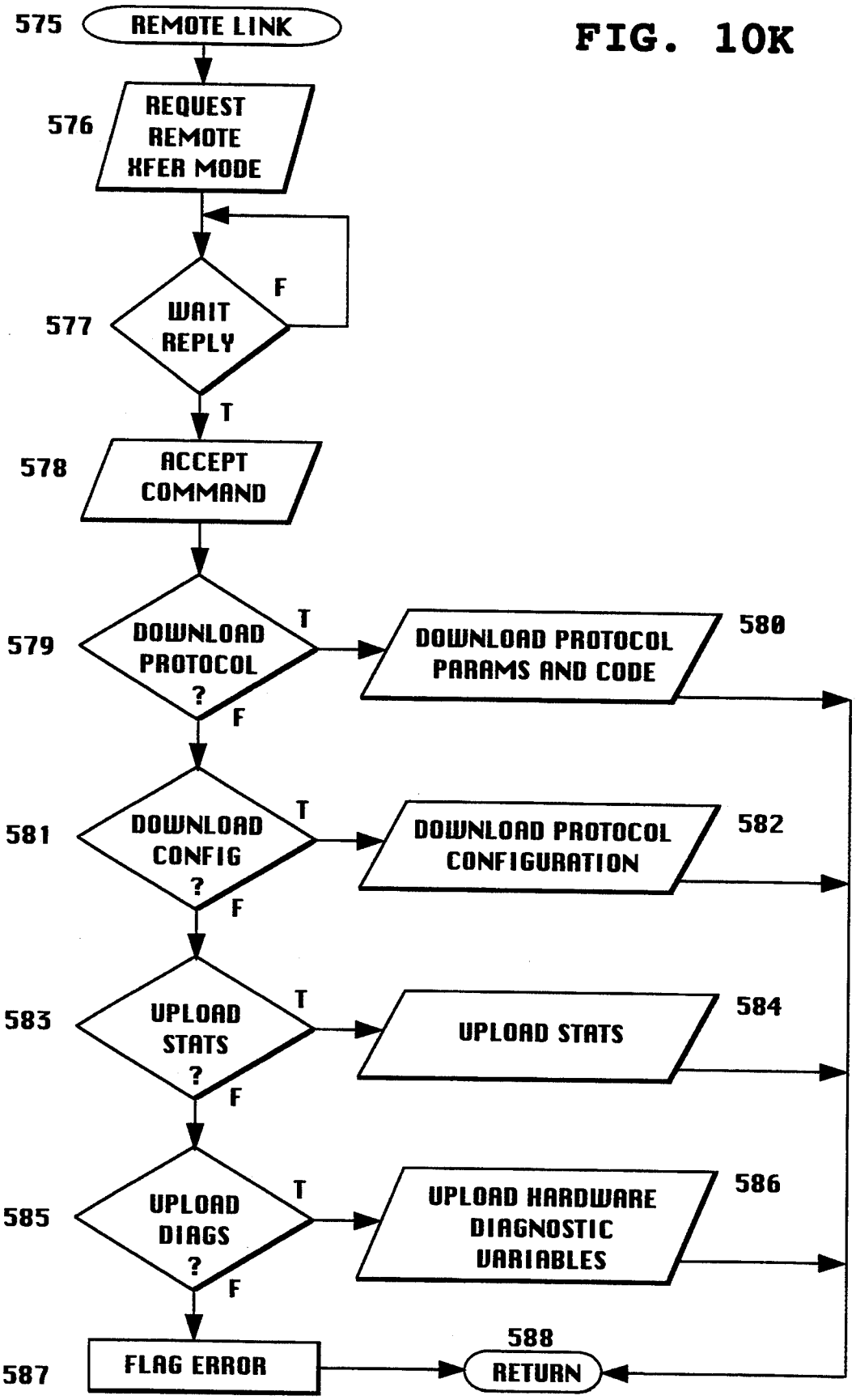
FIG. 10K is a communication link to an external computer for the purposes of transferring data.
Figure 10L:
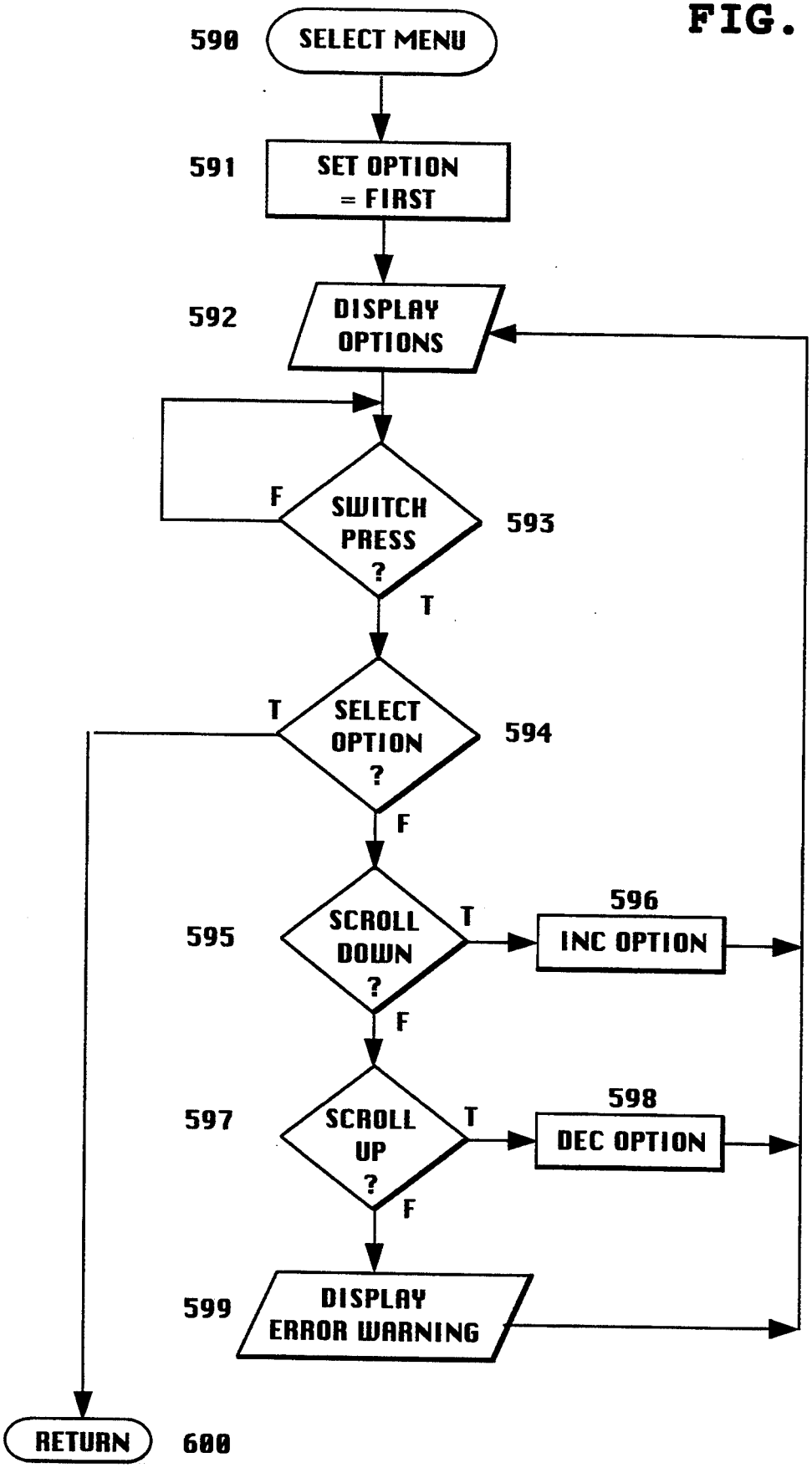
FIG. 10L performs the generic menu operations via utilization of text tables and address vectors.
Figure 10M:
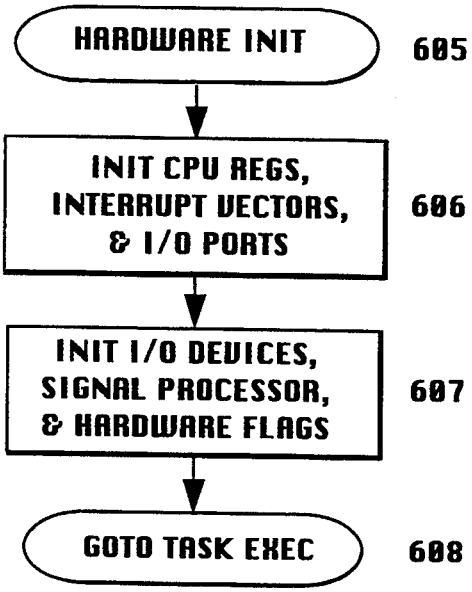
FIG. 10M is the hardware interrupt initialization procedure.
Figure 10N:
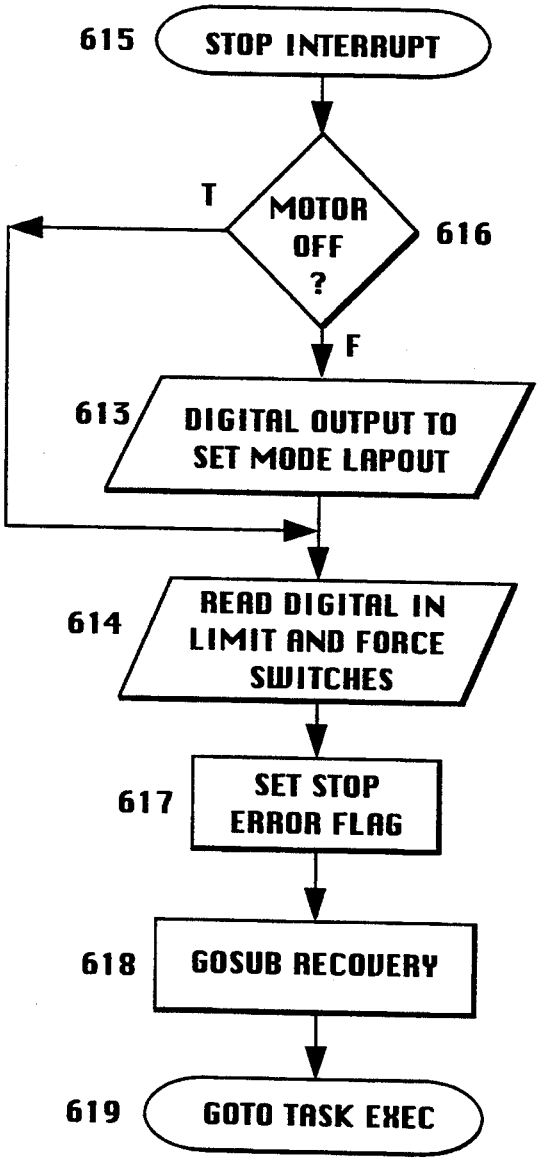
FIG. 10N is the stop and high force interrupt handler procedure.
Figure 10O:
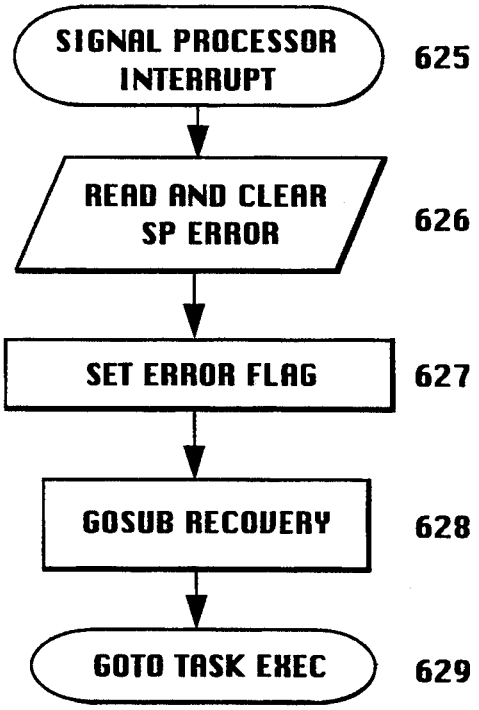
FIG. 10O is the signal processor error interrupt handler procedure.
Figure 10Q:
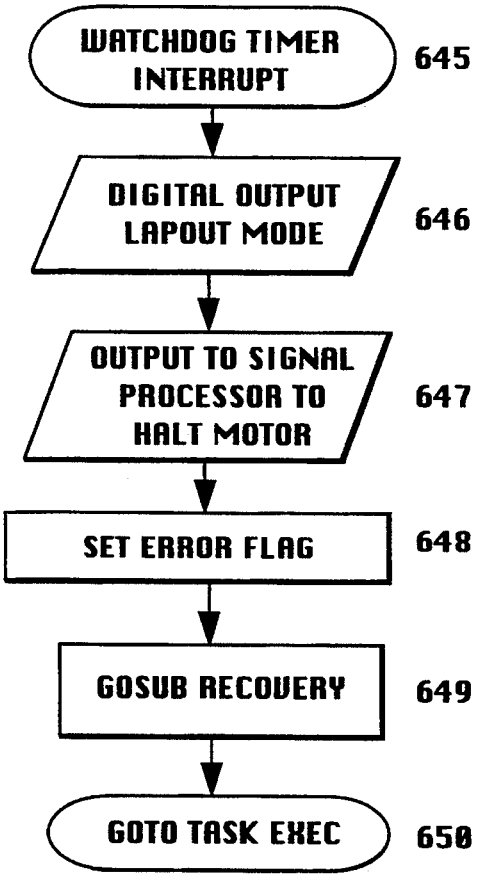
FIG. 10Q is the watchdog timer interrupt handler procedure.
Figure 10P:
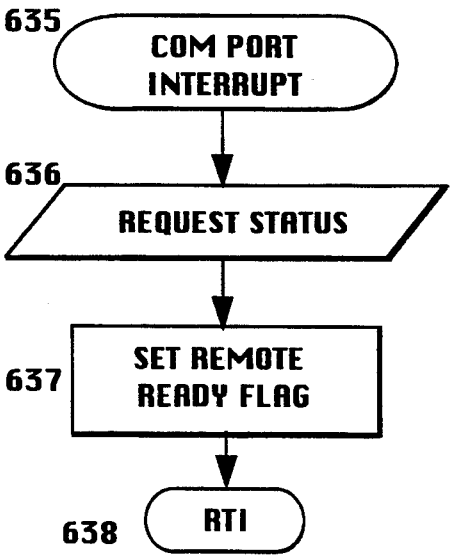
FIG. 10P is the serial communications interrupt handler procedure.
Figure 10R:
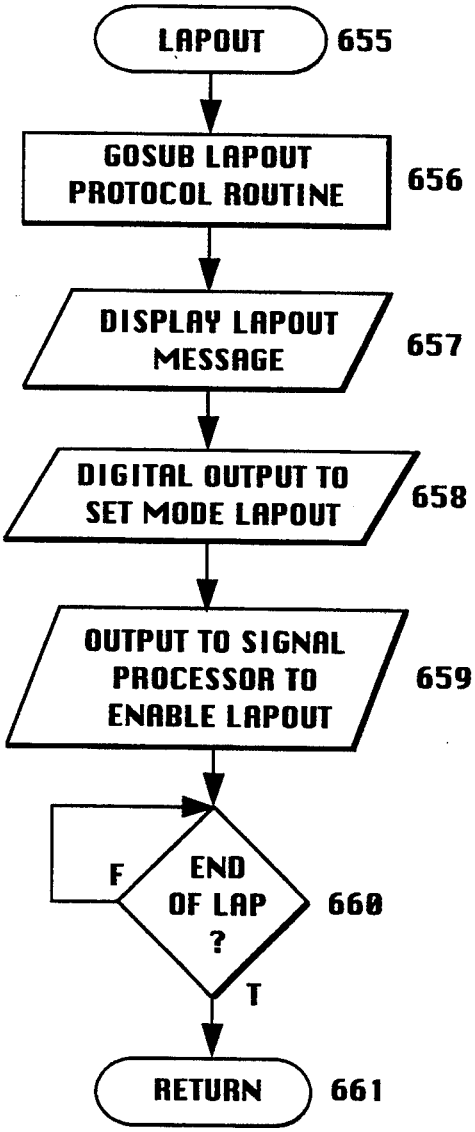
FIG. 10R is the Lapout management procedure.
Figure 10S:
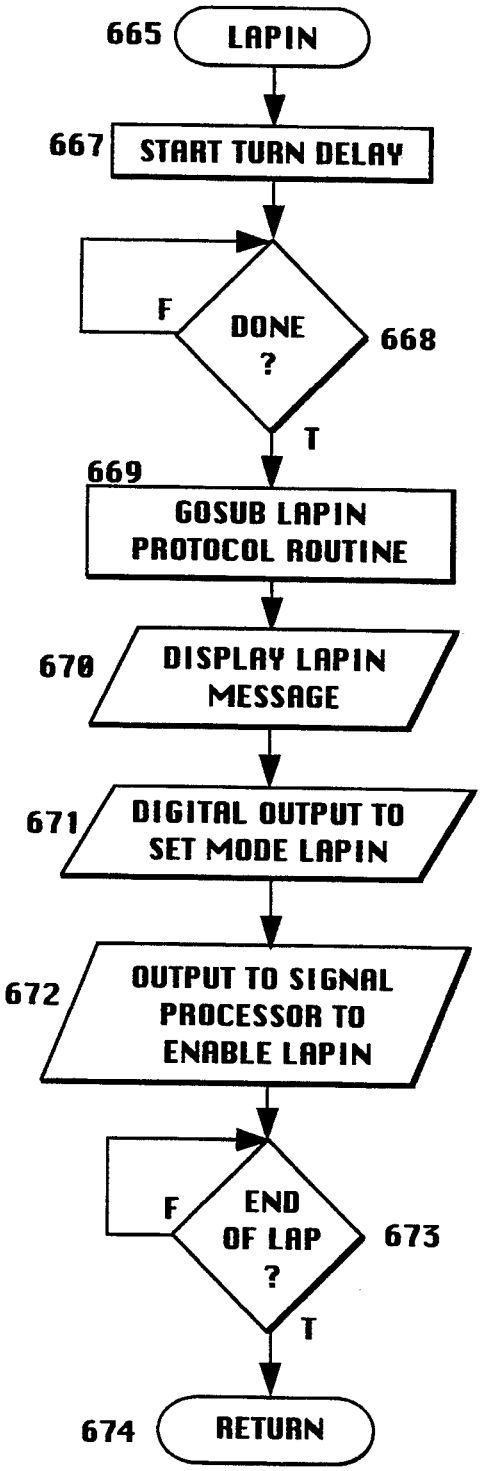
FIG. 10S is the Lapin management procedure.
Figure 10T:
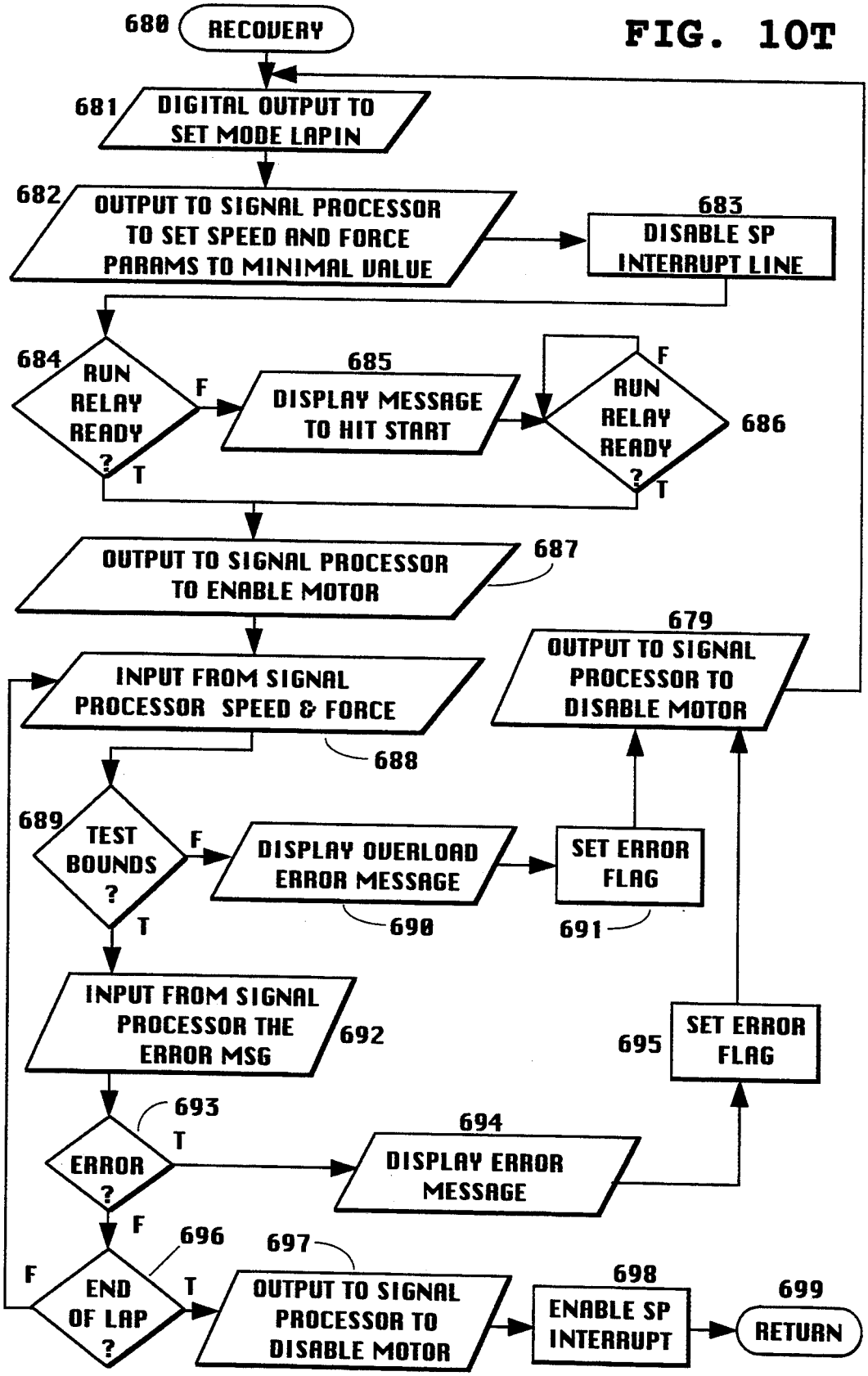

FIG. 6A depicts an illustration of a programmable controller 125 which provides for the implementation of the various global control functions as described in the flow diagrams of FIGS. 10A through 10T. Controller 125 is comprised of a central processing unit 250, data RAM 251, program and nonvolatile data and program storage EEROM 252. Controller 125 is further comprised of a UART 253, a real-time clock 254, a watch-dog timer 255, a digital input port 256, a digital output port 257, and a data and address buffer 258. Data, address, and control path 261 interconnects the above mentioned components for purposes of control and data transfer. Processor interrupt lines include a watchdog timer line 262, a clock line 260, a UART line 259, a Signal Processor line 153, and a power switch STOP line 143. Data buffers 258 connect via output data path 154 to the Signal Processor 138, and via input data path 166 from the Signal Processor 138. Digital path 151 connects to digital input port 256, and digital output port 257 provides outputs to digital path 150. Microcomputers such as MOTOROLA 68HC11 or a MOTOROLA 68HC811E2, which incorporate several of the aforementioned functions within a single device, might be employed advantageously to this purpose. Various other combinations of microprocessors and support components from other manufacturers might also be utilized, as would be evident to one skilled in the art. The particular choice of processors would depend most importantly upon the complexity of the various protocols and measurements one wished to implement on the present invention and their related speed and processing requirements.

FIG. 6B depicts signal processing means 269 which provides for the implementation of the various control functions as described in the diagram of figure 5. Signal processing means 269 is comprised of a digital Signal Processor CPU 270, a data and control bus 273, a program storage EEROM 271, a program and data storage RAM 72, a multiplexed analog-to-digital converter 274 with input lines 140, 141, 164, 170, 175, 177, and 305, programmable timers one 278 and two 279, and programmable counters one 277 and two 280. Programmable timer two 279 is coupled to the Signal Processor CPU 270 interrupt via a line 282. Counter one 277 is coupled to signal line 176, and counter two is coupled to signal line 304. Signal processing means 269 is further comprised of digital output port 275, and data and address buffers 276. Digital port 275 outputs the Lapend signal 167, the controller interrupt line 153, and the power switch drive line 142. Data buffers 276 receive input data on signal lines 154, and output data on signal lines 166. Various versions of the Texas Instrument TMS320Cxx series of signal processors may be utilized in this capacity or alternatively other signal processors may be used as are generally known in the art (for reference see Dote 1990). As noted previously, the complexity of the various protocols and measurements which might be implement on the present invention and their related speed and processing requirements would determine the choice of processor. One skilled in the art might also realize the potential for the combining Signal Processor means 269 and the aforementioned programmable controller 125 for implementation on a single processor device.

Although the illustration of the programmable controller 125 of FIG. 6A employs microcomputer or microprocessor to implement the various functions of the present invention, there are other various logic implementation such as programmable gate arrays available to one skilled in the art which might be employed to carry out the tasks required. In a corresponding fashion, the functions of the Signal Processor means 269 might be implemented with other forms of digital logic and specialized filter integrated circuits, and furthermore the signal processing might be accomplished by analog processors or mixed logic/analog devices such as those utilizing switched capacitor technology among others. The illustrative embodiments in FIGS. 6A and 6B only serve to implement the logic and processes outlined in FIGS. 4, 5, 10A through 10T, 11A through 11E, 12, and elsewhere in the teachings and disclosures of the present invention.

Figure 7:
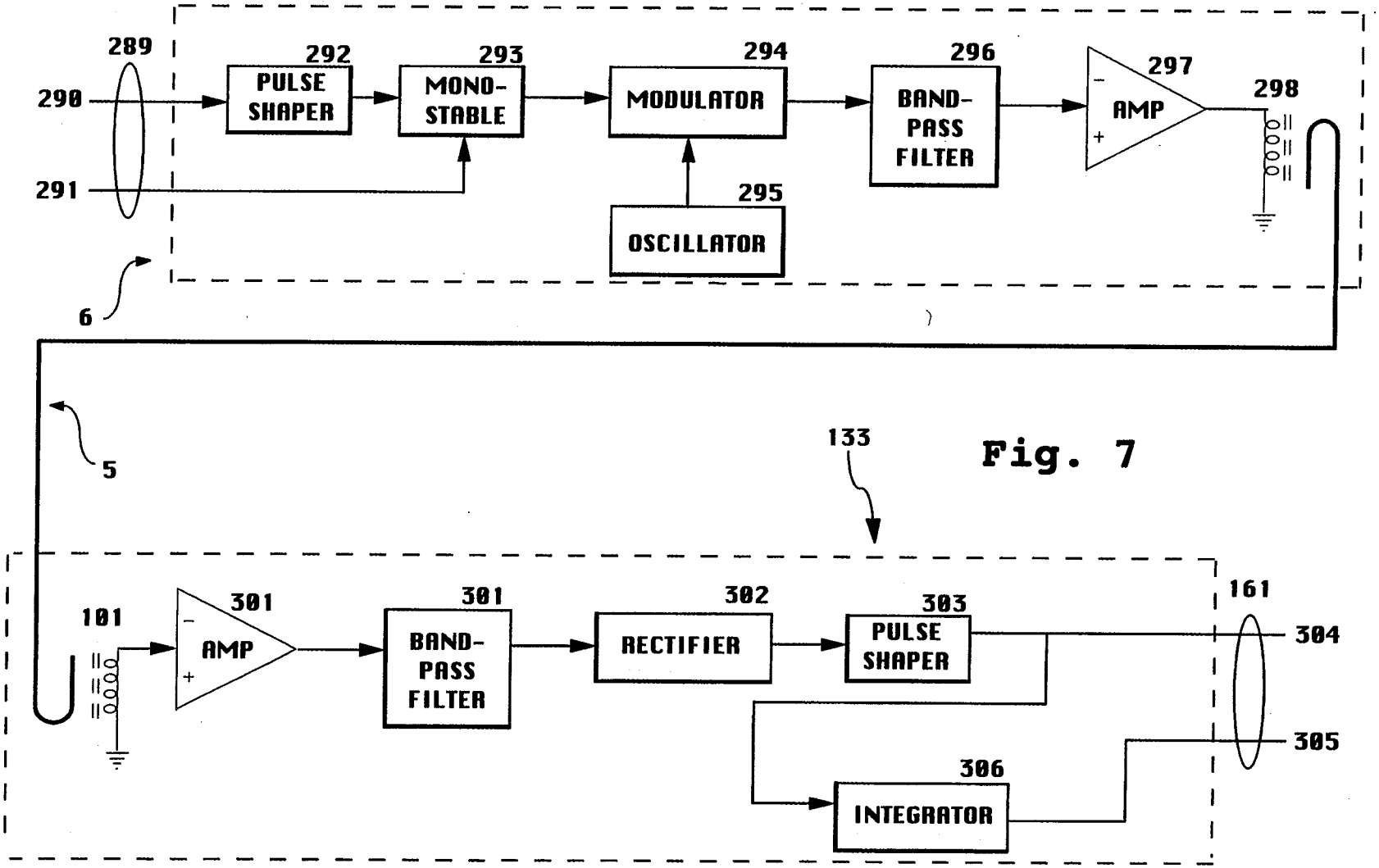
FIG. 7 is a block diagram illustrating one possible embodiment of a telemetry system in accordance with the present invention.

Referring now to FIG. 7, and the telemetry transmitter 6, where physiological and biomechanical signals of source 289 of the pulsatile type 290 are normalized by a pulse shaper 292 and used to trigger a monostable multivibrator 293 whose pulse width is proportional to signals 291 of the aforementioned source 289 which are of a continuous analog nature. A pulse train output of monostable 293 in turn modulates a VLF signal from an oscillator 295 in a modulator 294 whose output is fed through a bandpass filter 296. The filter 296 output is then amplified by amplifier 297 and used to drive a ferrite core inductive coil 298 coupled to the swimmer's harness cable 5. The signal in cable 5 is then transducted by an inductive coil 101 coupled to the cable 5 in the main assembly 11 and fed to a telemetry receiver 133. The signal from coil 101 is amplified by an amplifier 300 while output signal is bandpass filtered in a filter 301, rectified by a rectifier 302, and shaped by a pulse shaper 303. The resulting pulse train 304 is integrated by an integrator 306 to provide an analog output 305. The analog channel 305 and the pulsatile channel 304 are connected to the Signal Processor 138 via a signal line group 161. A multiplicity of such telemetry channel pairs 289 and 161 may be provided through the same inductors 298 and 101, transmitter 6, receiver 133 and cable 5.

Figure 8:
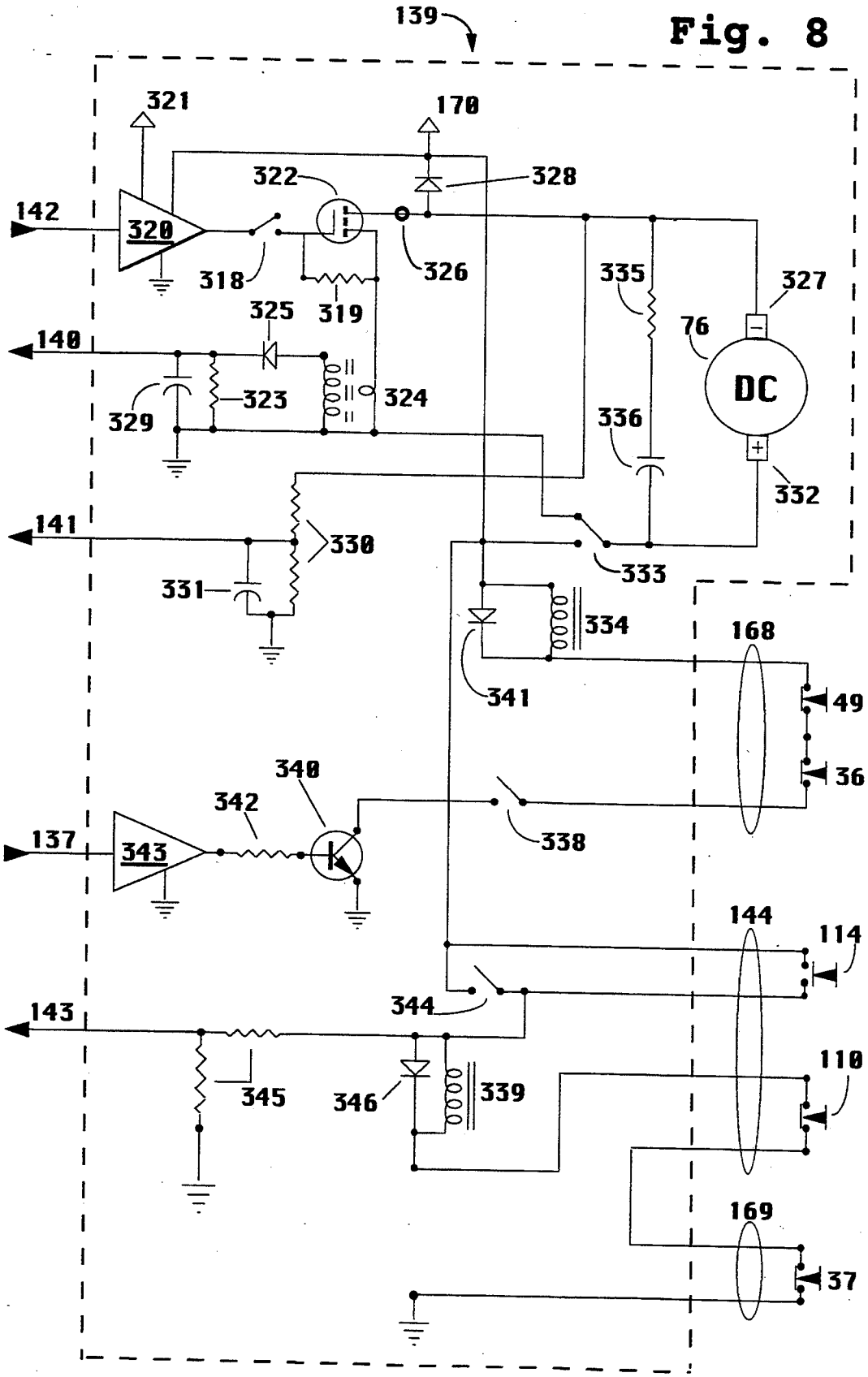
FIG. 8 is a electronic schematic diagram of the motor power driver circuit, switches, and sensors detailing various teachings and disclosures of the present invention.

Reference is now to made to the schematic of the power switch circuit 139 depicted in FIG. 8. Power switch circuit 139 is comprised of a signal line 142 from the Signal Processor 138 which switches MOSFET driver 320 such as the Texas Instruments SN75372 device which is provided with both a logic supply voltage 321 and a power driver supply voltage 170 for voltage level conversion. MOSFET driver 320 connects to the gate of a semiconductor switching device 322, such as MOTOROLA MTM60N05 TMOS type power MOSFET, through the normally open relay contacts 318 of a dropout relay 339. The gate of MOSFET 322 is bypassed to the source through resistor 319. The MOSFET 322 source passes through a single turn primary of a current transformer 324, such as Coilcraft D1871, and to battery common. The drain of MOSFET 322 is coupled through a ferrite snubber bead 326 to the DC motor 76 negative terminal 327 through cable 77 as well as to the anode of an ultrafast recovery rectifier 328, such as a MOTOROLA MUR1520, which in turn passes reverse inductive spikes back to the battery positive voltage supply 170 in the manner of a flyback diode. The secondary of the current transformer 324 is rectified by diode 325, and bypassed by a low resistance 323 which serves as a reflected load for the primary of the current transformer 324. The resistor 323 is bypassed with a capacitor 329 and connected to the Signal Processor 138 by signal line 140. The drain of MOSFET 322 is also coupled to a resistor divider 330 which is bypassed with a capacitor 331 and connected to the Signal Processor 138 via signal line 141.

Power switch circuit 139 is further comprised of a positive terminal 332 of the DC motor 76 connected through cable 77 to the pole of a SPDT contact set 333 energized by a direction relay coil 334 which couples motor terminal 332 to either battery common or battery positive 170 through normally closed and normally open contacts respectively. A resistor 335 in series with a capacitor 336 shunts the DC motor 76 to act as a snubber network. Direction relay coil 334 is coupled to the battery positive voltage 170 at one side, and on the other side is coupled through a normally closed contact pair of the low force switch 36 in series with a normally closed contact pair of left limit switch 49 which in turn is coupled through a SPST contact 338 of the dropout relay 339, which is further coupled through a transistor switch 340, such as type 2N2222A, to battery common. In addition, the relay coil 334 is shunted with a flyback diode 341 and relay coil 339 is shunted with a flyback diode 346. The digital control output line 137 from the programmable controller 125 connects to the input of a voltage level conversion driver 343, such as the second half of the dual unit SN75372 described previously, whose output connects to the base of the aforementioned transistor switch 340 through a current limiting resistor 342. The coil of the aforementioned dropout relay 339 is coupled on one side through a parallel combination of one of its' normally open SPST contacts 344 and a normally open contact pair of the START pushbutton switch 114, and is also connected to a divider network 345 which in turn connects to the programmable controller 125 via digital line 143 for monitoring. The other terminal of relay coil 339 is coupled to battery common through the series combination of a pair of normally closed contacts of STOP pushbutton switch 110 and a pair of normally closed contacts of the high force cutout switch 37. Both the START 114 switch and the STOP 110 are coupled through line group 144 to user panel 19. The limit switch 49 and the low force switch 36 are coupled through line group 168, while the high force switch 37 is coupled through line group 169.

Figure 9:
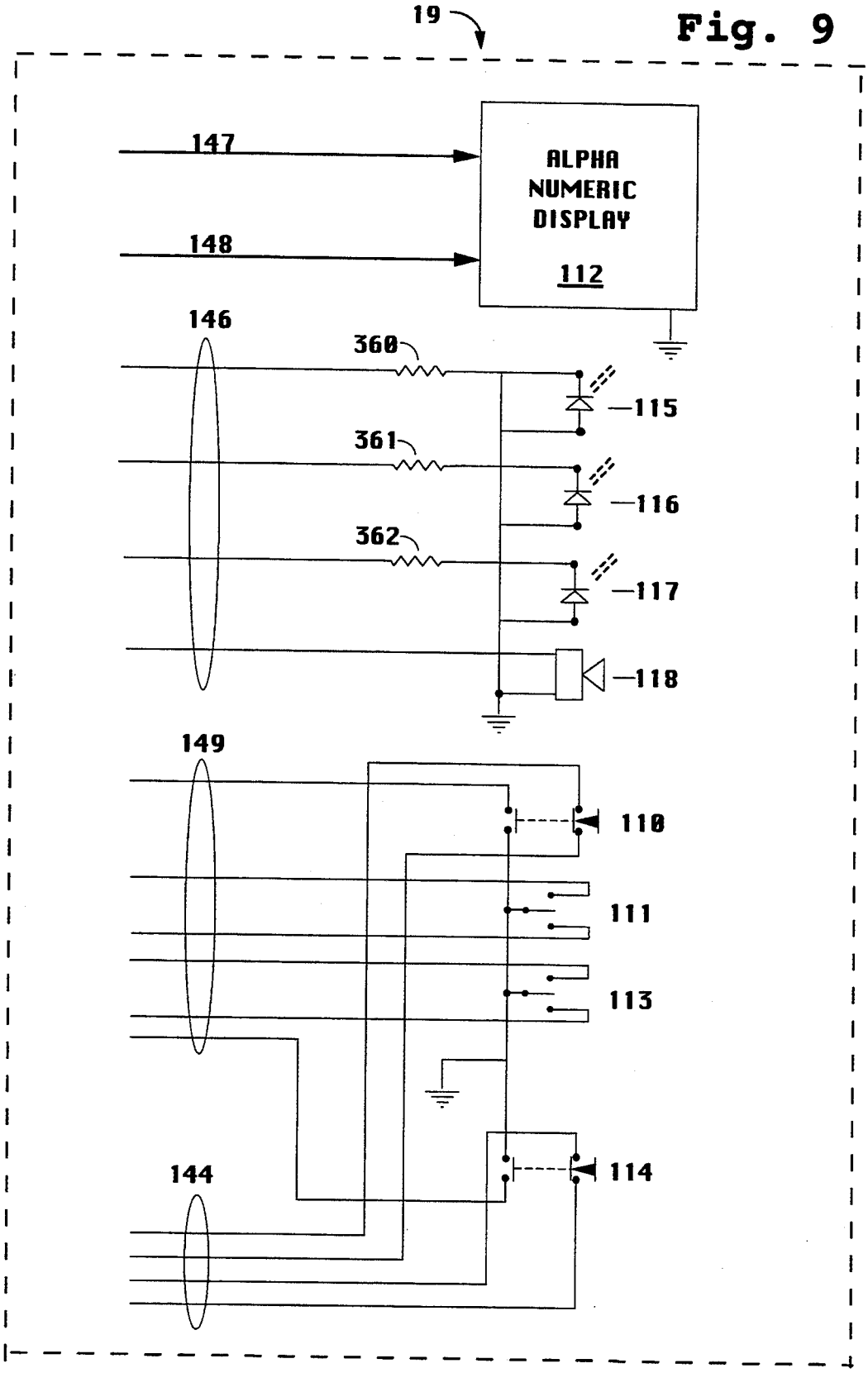
FIG. 9 is a electronic schematic diagram of the user interface panel in accordance with the present invention.

Reference is now to made to the schematic of the user interface panel 19 depicted in FIG. 9. The circuit of panel 19 is comprised of an alphanumerical display 112, such as OPTREX model DMC20261NY-LY LED backlit liquid crystal display or an industry equivalent. The display 112 is coupled to the electronic controller 78 via the group data paths 147, and the group line 148 which consists of control signals and logic voltage power conductors. The user interface is further comprised of a series of visual displays consisting of a red warning LED 115, a yellow caution LED 116, and a green ready LED 117, all of which are in series with current limiting resistors 360, 361, and 362. In addition, the user interface is comprised of an piezo sound transducer 118. The above mentioned LED resistors 360, 361, and 362 as well as transducer 118, are connected to the electronic controller 78 through the group paths 146, and their cathodes are returned to battery common.

The user interface is further comprised of a series of switches including a DPDT halt push button switch 110, a SPDT display interface rocker switch 111, a second SPDT display interface rocker switch 113, and a DPDT start push button switch 114. All of the four above mentioned user interface switches are coupled to the electronic controller 125 via the group signal path 149. In addition, the second poles of switches 110 and 114 are coupled to the power switch 139 via the group signal path 144.

Reference is now made to the flow diagrams of FIGS. 10A through 10T.

The Task Executive procedure 400 of FIG. 10A is entered after power up through a processor RESET interrupt signaled by line 155 to processor 250. Said interrupt causes an address vector fetch and branch which passes control on to a block 401 wherein a subroutine for Hardware Initialization 605 is called. Upon return from said subroutine, control is passed on to a block 402 which calls a subroutine for performing a Hardware Check 420. Following return from Check routine 420, control passes to a decision element 403 which tests for System OK whereupon a false condition transfers control to an output block 414 where an alphanumeric display 112 displays an error Message, and Auditory Alert 118 and a Light Alert 115 are output. Following said alert display, the block 401, which calls the subroutine for Hardware Initialization 605, is once again entered. Referring again to the System Check decision element 403, a true condition passes control on to a decision element 404 testing a Run Laps flag which is first set to false in the above mentioned Hardware Initialize subroutine 605. A true condition at said Run Laps decision element 404 passes control to a block 405 which calls a Run Laps subroutine 450 whereupon return control passes back to block 402 which calls the Hardware Check subroutine 420. Referring again to the Run Laps decision element 404, a false condition passes control on to an output block 406 which presents a Startup message on an alphanumeric display 112 which requests the user to select a menu operation or an Immediate mode operation following which control enters an input block 407 which queries the status of the right user interface rocker switch 113 and subsequently passes control to a decision element 408 to test for a press on said switch. A true condition at said decision element 408 causes control to pass to a further test of the status of said rocker switch in the Menu switch decision element 409 whereupon if false, control passes to a block 410 which calls an Immediate Mode subroutine 470 or, if true, passes to a block 411 which calls a Menu subroutine 490. After return from either of the two aforementioned subroutines 410 or 411, control again passes to block 402 which calls the Hardware Check subroutine 420. Referring once again to said rocker switch press decision element 408, if a false condition results, control passes to another decision element 412 which tests the status of the Remote serial interface UART 253. If true, control passes to a block 413 which calls Remote link subroutine 575 which returns to pass control back to block 402 which calls the Hardware Check subroutine. If the Remote decision element test 412 is false, control passes back up to the previously described Run Laps flag decision element 404.

The Hardware Check procedure 420 of FIG. 10B begins with a block 421 which disables all processor 250 interrupts from lines 259, 153, 143, and 260 after which control passes to a decision element 422 which tests for a Motor 76 running condition or a Recovery flag condition. When said test 422 results in a true condition, a block 423 which calls the Recovery subroutine 680 is entered. Upon return from the subroutine, control then passes to join with the above decision element 422 false path to enter a block 424 which compares and verifies the stack pointer and other processor 250 address vector registers. Control then proceeds to a decision element 425 which tests the results of the previous verify operation block 424, and, if false, sets an error flag in block 426 after which and along with the true condition path of decision element 425 passes control on to a block 427 which verifies the digital ports 256 and 257, UART 253, and buffer 258 registers and status. Control then passes on to another decision element 428 to test the results of said verification 427, which, if false, passes control to block 429 which sets an error flag. Control then joins with the above decision element 428 true path and continues to the EEROM 252 checksum verification block 430. From the EEROM verification block 430, control passes on to a decision element 431 which tests the result of verification block 430 whereupon a false condition causes control to pass to a block 432 wherein an error flag is set, after which and along with the true condition path from decision element 431 passes control on to a decision element 433 which tests the status of the maintenance lap count flag. If the test is false, an error flag is set in block 434 after which, and along with the true condition path from decision block 433 passes control on to a decision element 435 which tests for the presence of error flags. If the test is true, then control is passed on to a block 436 which stores the error flags in the EEROM 252 storage and then continues on to join with the false condition path of decision element 435 and passes control on to a block 437 which once again enables the processor interrupts. After block 436 control passes on to the subroutine return 438.

The Run Laps procedure 450 of FIG. 10C begins with a block 451 which calls a protocol specific subroutine whose address is retrieved from a protocol table. Said routine performs various operations that characterize said protocol which are to be coded and stored in program EEROM storage 252 by the user and therefore are not detailed herein. After control returns from said routine, it then passes on to a block 452 wherein various protocol specific parameters and coefficients are sent to the Signal Processor 138 to initialize various tables. Control then passes on to an output block 453 which displays a "Ready to start" message on the alphanumeric display 112 , an Auditory Alert on sound transducer 118, and a Visual Alert on green light 117. Following said alert displays, control passes on to a decision element 454 which tests for a press of the START switch 114. A false condition for said test passes control back to decision element 454 creating a wait loop, while a true condition passes control to an output block 455 which clears the previous output block displays, whereupon control then passes to a decision element 456 which tests for zero laps remaining in lap counter variable which was set by the calling procedure. If said test is false, control is passed on to a block 457 which calls a Lapout subroutine 655, and, upon return from the subroutine, passes control on to a Lap error flag test decision block 458. Said error flag is set via the interrupt procedure 625 and indicates the Signal Processor 138 status. If said flag test is true, control passes on to a block 463 which sets an error flag, and then passes control on to return 466. If said flag test is false, then control passes on to a block 459 which calls a Lapin subroutine 665 which, upon return from the subroutine, passes control on to a Lap Error flag test decision block 460. Said error flag is set via an interrupt procedure 625 and indicates the Signal Processor 138 status. If said flag test is true, control passes on to a block 463 which sets an error flag, and then on to subroutine return 466. If said flag test is false, control is passed on to a block 461 wherein statistical data is transferred from the Signal Processor 138 to RAM storage 251, after which control is passed to a block 462 wherein the lap counter variable is decremented. Control then passes back to the decision element 456 which tests for zero laps remaining in the lap counter variable. If said test is true, control is passed on to a block 464 which updates long term statistics in EEROM storage 252 by incorporating data acquired and stored by block 461 during the current lap sequence. From there, control passes on to a block 465 which calls a protocol specific routine as described previously for block 451, and then passes control to subroutine return 466.

The Immediate Mode procedure 470 of FIG. 10D begins with an output block 471 which displays the Immediate Mode menu, a force variable value, and a speed variable value. Control is then passed on to a decision element 472 which tests the status of the Start pushbutton 114. If the result is true, control passes on to a block 473 wherein the run flag is set, the lap counter variable is loaded with a lap count value and control is then passed to the subroutine return 485. If, however, test 472 is false, control is passed to another decision element 474 which tests for the right rocker switch 113 status. If the top switch is in a true condition, control passes on to a block 475 wherein the force variable is incremented and control is then passed to block 482. If, however, test 474 is false, control is passed to another decision element 476 which tests rocker switch 113 for the bottom switch in the true condition. If test 476 is true, control passes on to a block 477 wherein the force variable is decremented and then control is passed to block 482. If, however, test 476 is false, control is passed to another decision element 478 which tests the left rocker switch 111. If the top switch is true, control passes on to a block 479 wherein the speed variable is incremented and then control is passed to block 482. If, however, said test is false, control is passed to another decision element 480 which tests rocker switch 111 for the bottom switch in the true condition. If true, control passes on to a block 481 wherein the speed variable is decremented and then control is passed along with the false condition path from decision element 480 to block 482. Block 482 waits for a delay of 500 milliseconds and then passes control on to input block 483 which reads the status of the rocker switches 111 and 113. Control then passed on to a decision element 484 which tests for a switch press event, which if true passes control on to decision element 474. If test 484 is false, the control is passed on to subroutine return 485.

The Menu procedure 490 of FIG. 10E begins with a block 491 in which the Main Menu text table address is retrieved. Control then passes to a block 492 wherein a Select Menu subroutine 590 is called. Upon return from subroutine, control passes to a series of decision elements 493, 495, 497, 499, 501, and 503 which test the selected menu item for a match with one of a multiplicity of operations, of which six are illustrated herein. If a match results in a false condition, control is passed to each succeeding decision element in turn. If a test results in a true condition, control is passed on from the decision element to the corresponding operational block 494,496, 498, 500, 502, and 504. The first said block 494 calls a subroutine 510 which enables the manual setting of various parameters. The second said block 496 retrieves the instruction and training protocol menu address from a table and calls a subroutine 525 which enables the selection of a protocol. The third said block 498 retrieves the testing protocol menu address from a table and calls the subroutine 525 which enables the selection of a protocol. The fourth said block 500 calls a subroutine 535 which enables the display of various statistics of operation. The fifth said block 502 calls a subroutine 545 which enables an automated user parameter configuration. The sixth said block 504 calls a subroutine 560 which enables an automated calibration of various electromechanical parameters. When each operational block is completed, or all decision elements return false, then control passes on to subroutine return 505.

The Manual selection of parameters procedure 510 of FIG. 10F begins with a block 511 in which a Parameter Menu text table address is retrieved. Control then passes to a block 512 wherein the Select Menu subroutine 590 is called. Upon return from subroutine, control passes to an output block 513 wherein the selected parameter value is presented on the alphanumeric display 112. Control then is passed on to a time delay 518 of 3 seconds after which an input block 519 is entered which reads the right rocker switch 113 status. A decision element 520 is then entered which tests for a switch press, which if true, passes control on to a decision block 514 which tests for a top switch press of the rocker switch 113. If test 514 is true, a block 515 is entered wherein the parameter value is incremented and then control is passed back to the time delay block 518. If however test 514 is false, control is passed to another decision element 516 which tests for a bottom switch press of rocker 113. If true, control passes on to a block 517 wherein the parameter value is decremented and then control is passed back to the time delay block 518 along with the false path of test 516. If test 520 is false, then control passes on to the subroutine return 521.

The Protocol select procedure 525 of FIG. 10G begins with a block 526 in which the Menu text table address is loaded and the Menu Selection subroutine 590 is called. Upon return from the subroutine, control passes to a block 527 wherein the menu item selection is translated from the table into a configuration table address from which the various parameters, coefficients, and subroutine address vectors are loaded into the protocol configuration table. Control then passes to a block 528 which sets the Runlaps flag and then control is passed to the subroutine return 529.

The Statistics display procedure 535 of FIG. 10H begins with a block 536 in which the Statistical Menu text table address is retrieved. Control then passes to a block 537 wherein the Select Menu subroutine 590 is called. Upon return from subroutine, control passes to a block 538 wherein the selected menu item is translated into a variable address after which control passes to a decision element 539 which tests for a variable selection or an exit. If said test is false, control passes to an output block 540 wherein a display of the selected statistic variable is presented on the alphanumeric display 112. Control then passes back to the block 537 which calls the Select Menu subroutine. Referring again to the decision element 539, if the test for an exit condition is true, control passed on to subroutine return 541.

The Automated User Parameter Set procedure 545 of FIG. 10I begins with a block 546 in which the Set Parameter menu text table address is loaded and the Menu Selection subroutine 590 is called. Upon return from the subroutine, control passes to a block 548 wherein the menu item selection is translated into a configuration table address from which various parameters, coefficients and message text table addresses are loaded into the Set Parameter configuration table. Control then passes to an output block 549 in which a message indicating the required swimmer Lapout action for said selected parameter is presented on the alphanumeric display 112 and an Auditory Alert is presented on the Auditory Alert 118 for 5 seconds. Control then passes on to a block 550 wherein the Lapout parameters are set from the aforementioned configuration table and the Lapout subroutine 655 is called. Upon return from the subroutine, control is passed to a block 551 wherein the data variables from the lap are stored in RAM 251. Control then passes to an output block 552 in which a message indicating the required swimmer Lapin action for said selected parameter is presented on the alphanumeric display 112 and an Auditory Alert is presented on the Auditory Alert 118 for 5 seconds. Control then passes on to a block 553 wherein the Lapin parameters are set from the aforementioned configuration table and the Lapin subroutine 665 is called. Upon return from the subroutine, control is passed to a block 554 wherein the data variables from the lap are stored in RAM 251. Upon return from the subroutine, control is passed to a block 555 wherein the parameter or various parameters are calculated and updated in the EEROM storage 252 after which control is passed to the subroutine return 556.

The Calibration procedure 560 of FIG. 10J begins with an output block 561 in which a message indicating that the swimmer swim a Lapout is presented on the alphanumeric display 112. Control then passes on to a block 562 wherein the lap force parameter is set to a low level, the direct EIM coefficients are enabled via path 214, the Biomechanical Model coefficients are disabled, and the Lapout subroutine 655 is called. Upon return from the subroutine, control is passed to an output block 563 in which a message indicating that the swimmer permit himself to be towed is presented on the alphanumeric display 112. Control then passes to a block 564 wherein the speed curve parameters are set to produce a ramp from zero to maximum speed. Control then passes on to an output block 565 wherein the Signal Processor 138 is signaled to enable the motor 76 via data path 154. Control then passes on to a decision element 566 which tests for motor 76 operation by interragating Signal Processor 138 via data paths 154 and 166. If said test is false, decision element 566 is entered again thus forming a wait loop. When said test becomes true, control passes on to another decision element 567 which also tests for motor 76 operation. If the test 567 is true, decision element 567 is entered again thus forming a wait loop. Test 567 becomes false when the positive force exerted on the swimmer exceeds the low force cutout switch 36 threshold and direction relay 334 is disabled. When test 567 becomes false, control passes on to a block 568 wherein the data variables from the lap are stored in RAM storage 251. Control is then passed on to a block 569 wherein the Recovery subroutine 680 is called. Upon return from the subroutine, control is passed to a block 570 wherein various calibration parameters calculated from the aforementioned stored Lapin data and then updated in EEROM storage 252 after which control is passed to the subroutine return 571.

The Remote link procedure 575 of FIG. 10K begins with an output block 576 in which a request for transfer message is sent over the communication link 17 to the external portable personal computer 18. Control then passes on to a decision element 577 which tests for a remote command from external computer 18. If test 577 is false, decision element 577 is entered again thus forming a wait loop. When test 577 becomes true, control passes on to an input block 578 which accepts a remote command from external computer 18. Control then passes on to a series of decision elements 579, 581, 583, and 585 which test said remote command for a match with one of a multiplicity of operations, of which four are illustrated herein. If a match results in a false condition, control is passed to each succeeding decision element in turn. If a test results in a true condition, control is passed on from the decision element to one of a set of corresponding I/O blocks 580, 582, 584, and 586. The first said block 580 is an input block which downloads from the external computer 18 a protocol procedure including, but not limited to, parameters, variables, text tables and coded procedure instructions into RAM storage 251 and/or EEROM storage 252. The second said block 582 is an input block which downloads from the external computer 18 configuration parameters and variables into RAM storage 251 and/or EEROM storage 252 to configure protocols that previously exist in RAM storage 251 and/or EEROM storage 252. The third said block 584 is an output block which uploads to external computer 18 various operational and swimmer statistical parameters and variables from RAM storage 251 and/or EEROM storage 252. The fourth said block 586 is an output block which uploads to external computer 18 various hardware diagnostic parameters and variables from RAM storage 251 and/or EEROM storage 252. When I/O blocks 580, 582, 584, and 586 are complete, control is passed on to subroutine return 588. If all decision elements 579, 581, 583, and 585 return false, then control passes on to a block 587 in which an error flag is set, after which control is passed on to subroutine return 588.

The Menu Selection procedure 590 of FIG. 10L begins with a block 591 wherein the address of the first two menu items is retrieved. Control then passes on to an output block 592 in which the two items starting from the current address in the menu text table are displayed on the alphanumeric display 112. Control then passes on to a decision element 593 which tests for a press of either of the rocker switches 111 or 113. If test 593 is false, the decision element 593 is entered again, thus forming a wait loop. When the test 593 becomes true, control then passes on to another decision element 594 which tests for a press of the top of right rocker switch 113. If test 594 is true, control passes on to the subroutine return 600. If, however, said test is false, control is passed to another decision element 595 which tests for a press of the top of left rocker switch 111. If the test 595 is true, control passes on to a block 596 wherein the menu table address is incremented and then control is passed once again to the aforementioned output block 592 wherein a display of two menu items is presented. If, however, the test 595 is false, control is passed to another decision element 597 which tests left rocker switch 111 for a bottom press true condition. If true, control passes on to a block 598 wherein the menu table address is decremented and then control is passed once again to the aforementioned output block 592 wherein a display of two menu items is presented. If, however, test 597 is false, control is passed to an output block 599 which presents an error warning message on the alphanumeric display 112 and then control is passed once again to the aforementioned output block 592 wherein a display of two menu items is presented.

The Hardware Initialization procedure 605 of FIG. 10M begins with a block 606 in which initialization of the CPU 250 registers, hardware and software interrupt vectors registers, and I/O port registers. Control then passes on to a block 607 in which all hardware devices 253, 254, 255, 256, 257, and 258 connected to the CPU 250 are initialized and set to standby modes. Additionally, the Signal Processor 138 is initialized and placed in standby mode, following which various control flags and variables are initialized in RAM storage 251 and EEROM storage 252. Control then passes via an absolute jump 608 to the task executive procedure 400.

The STOP Interrupt handler 615 of FIG. 10N is entered when the STOP switch 110 is pressed or when the high force overload switch 37 is activated and causes an interrupt signal to be sent to the CPU 250. This procedure begins with a decision element 616 which tests the disable relay line 143 for a motor 76 off condition. If false, control then passes to an output block 613 wherein the direction relay is placed in Layout mode via the direction relay control line 137. Control then passes on to block 614 along with the true path of test 616. Block 614 reads the status of the force switches 36 and 37 as well as the status of the stop switch 110. Control then passes on to a block 617 wherein the Stop error flag is set to true in EEROM storage 252. Control then passes to a block 618 wherein the Recovery subroutine 680 is entered. Upon return from the subroutine, control then passes to a block 619 which resets the stack registers to point to the Task executive procedure 400 and executes a Return from Interrupt.

The Signal Processor Error Interrupt handler 625 of FIG. 10O is entered when the Signal Processor 138 sends a signal to a port input line 153 which causes a CPU 250 hardware interrupt. This procedure begins with an input block 626 in which the interrupt condition is cleared and error information is obtained from Signal Processor 138 via data paths 154 and 166. Control then passes to a block 627 wherein an error flag is set to true in EEROM storage 252. Control then passes to a block 628 wherein the Recovery subroutine 680 is entered. Upon return from the subroutine, control then passes to a block 629 which resets the stack registers to point to the Task executive procedure 400 and executes a Return from Interrupt.

The Serial Communications Port Interrupt Handler 635 of FIG. 10P is entered when the communications interface 17 sends a signal to the UART 253 which causes a CPU 250 hardware interrupt via the signal line 259. This procedure begins with an input block 636 in which the interrupt condition is cleared and status information is obtained from UART 253. Control then passes to a block 637 wherein the Remote Ready flag as described in the Task executive routine 400 is set to true in RAM storage 251. Control then passes on to a Return from Interrupt 638.

The Watchdog Timer Interrupt Handler 645 of FIG. 10Q is entered when the watchdog timer 255 sends a hardware interrupt signal to the CPU 250 via the signal line 262. This procedure begins with an output block 640 in which the interrupt condition is cleared and the direction relay 334 is placed in Layout mode via the direction relay control line 137. Control then passes to an output block 647 which sends a command via data path 154 to the Signal Processor 138 to halt the motor 76. Control then passes on to a block 648 wherein a Watchdog error flag is set to true in EEROM storage 252. Control then passes to a block 649 wherein the Recovery subroutine 680 is entered. Upon return from the subroutine, control then passes to a block 650 which resets the stack registers to point to the Task executive procedure 400 and executes a Return from Interrupt.

The Lapout procedure 655 of FIG. 10R begins with a block 656 wherein a protocol specific subroutine is called whose address is retrieved from a protocol table. Said routine performs various operations that characterize said protocol which are to be coded and stored in program EEROM storage 252 by the user and therefore are not detailed herein. After control returns from said routine, it then passes on to an output block 657 in which a message indicating a Ready condition for the start of the Lapout is presented on the alphanumeric display 112 and, additionally, an Auditory Alert 118, and a green Light Alert 117 display are presented. Control then passes on to an output block 658 in which the direction relay is placed in Lapout mode via the direction relay control line 137. Control then passes on to an output block 659 in which the Signal Processor 138 is signaled to begin a Lapout after which control then passes on to a decision element 660 which tests for an end of Lap condition signal obtained from Signal Processor 138 via digital input line 167. If test 660 is false, decision element 660 is entered again thus forming a wait loop until the test becomes true, whereupon control passes to subroutine return 661.

The Lapin procedure 665 of FIG. 10S begins with a block 667 in which a timer variable is initialized for a lap turn around delay period obtained from the protocol table and subsequently starts a timing operation. Control then passes on to a decision element 668 which tests for a time completion condition. If the test 668 is false, control passes back to the decision element 668 thereby forming a wait loop. When the test 668 becomes true, control then passes on to a block 669 wherein a protocol specific subroutine address is retrieved from a protocol table and the subroutine called. Said routine then performs various operations that characterize said protocol which are coded and stored in program EEROM storage 252 by the user and therefore are not detailed herein. After control returns from said routine, it then passes on to an output block 670 in which a message indicating a Ready condition for the start of the Lapin is presented on the alphanumeric display 112 and, additionally, an Auditory Alert 118, and a green Light Alert 117 display are presented. Control then passes on to an output block 671 in which the direction relay is placed in Lapin mode via the direction relay control line 137. Control then passes on to an output block 672 in which the Signal Processor 138 is signaled to begin a Lapin after which control then passes on to a decision element 673 which tests for an end of Lap condition signal obtained from Signal Processor 138 via digital input line 167. If test 673 is false, decision element 673 is entered again thus forming a wait loop until the test becomes true, whereupon control passes to subroutine return 674.

The Recovery procedure 680 of FIG. 10T begins with an output block 681 in which the direction relay is placed in Lapin mode via the direction relay control line 137 after which control passes to an output block 682 in which various parameters relating to speed and force are set to minimal values and the Lapin flag is set. Control is then passed on to a block 683 wherein the Signal Processor interrupt line 153 input to the CPU 250 is disabled after which decision element 684 is entered which tests for a run enabled condition on run relay signal line 143. If the result of test 684 is false, an output block 685 is entered which displays a "Ready to start" message on the alphanumeric display 112, an Auditory Alert on Auditory transducer 118, and a Visual Alert on green light 117. Following said alert displays, control passes on to a decision element 686 which tests for a press of the START switch 114. A false condition for said test passes control back to decision element 686 creating a wait loop, while a true condition passes control along with the true condition path of decision element 684 to an output block 687 in which the Signal Processor 138 is signaled via data path 154 to enable the motor 76. Control then passes on to an input block 688 in which the speed and force variable values are obtained from Signal Processor 138 via data paths 154 and 166. Control then passes on to a decision element 689 which tests the speed and force variables for maximum limits. If test 689 results in an unsatisfactory condition or false, control passes to an output block 690 wherein an "Overload" error message is presented on the alphanumeric display 112 and, additionally, an Auditory Alert 118 and a red Light Alert 115 display are presented. Control then passes on to a block 691 in which an error flag is set. Control then passes to an output block 679 in which the Signal Processor 138 is signaled via data path 154 to disable the motor 76 after which control passes back to the Lapin enable block 681. If the result of test 689 is satisfactory or true, control passes on to an input block 692 in which the error status is obtained from Signal Processor 138 via data paths 154 and 166. Control then passes on to a decision element 693 which tests for error messages. Said errors would include, but not be limited to a low force overload switch 36 closure, or an excessive temperature condition on the temperature sensor 127. If an error is detected, then control passes on to an output block 694 wherein a "Device Error" error message is presented on the alphanumeric display 112 and, additionally, an Auditory Alert 118, and a red Light Alert 115 display are presented. Control then passes to a block 695 wherein a Signal Processor error flag is set to true in EEROM storage 252 after which control is passed on to the output block 679 in which the Signal Processor 138 is signaled to disable the motor 76 via data path 154 after which control passes back to the Lapin enable block 681. Referring back to decision element 693, if the test reveals no error, control then passes on to a decision element 696 which tests for an end of Lap condition signal obtained from Signal Processor 138 via digital input line 167. If the test 696 is false, then block 688 is entered again thus forming a wait loop until error tests 689 and 693 detect errors or the end of lap test 696 becomes true. If test 696 is true, then control passes on to an output block 697 in which the Signal Processor 138 is signaled to disable the motor 76 via data path 154 after which control then passes to a block 698 which enables CPU 250 interrupts, and then on to subroutine return 699.

Reference is now to made to the flow diagrams of FIGS. 11A through 11E and FIG. 12 which depict an illustrative embodiment of the Signal Processor 138 detailed in the block diagram of FIG. 5 and implemented on the Digital Signal Processor CPU 270 as illustrated in FIG. 6B.

Figure 11A:
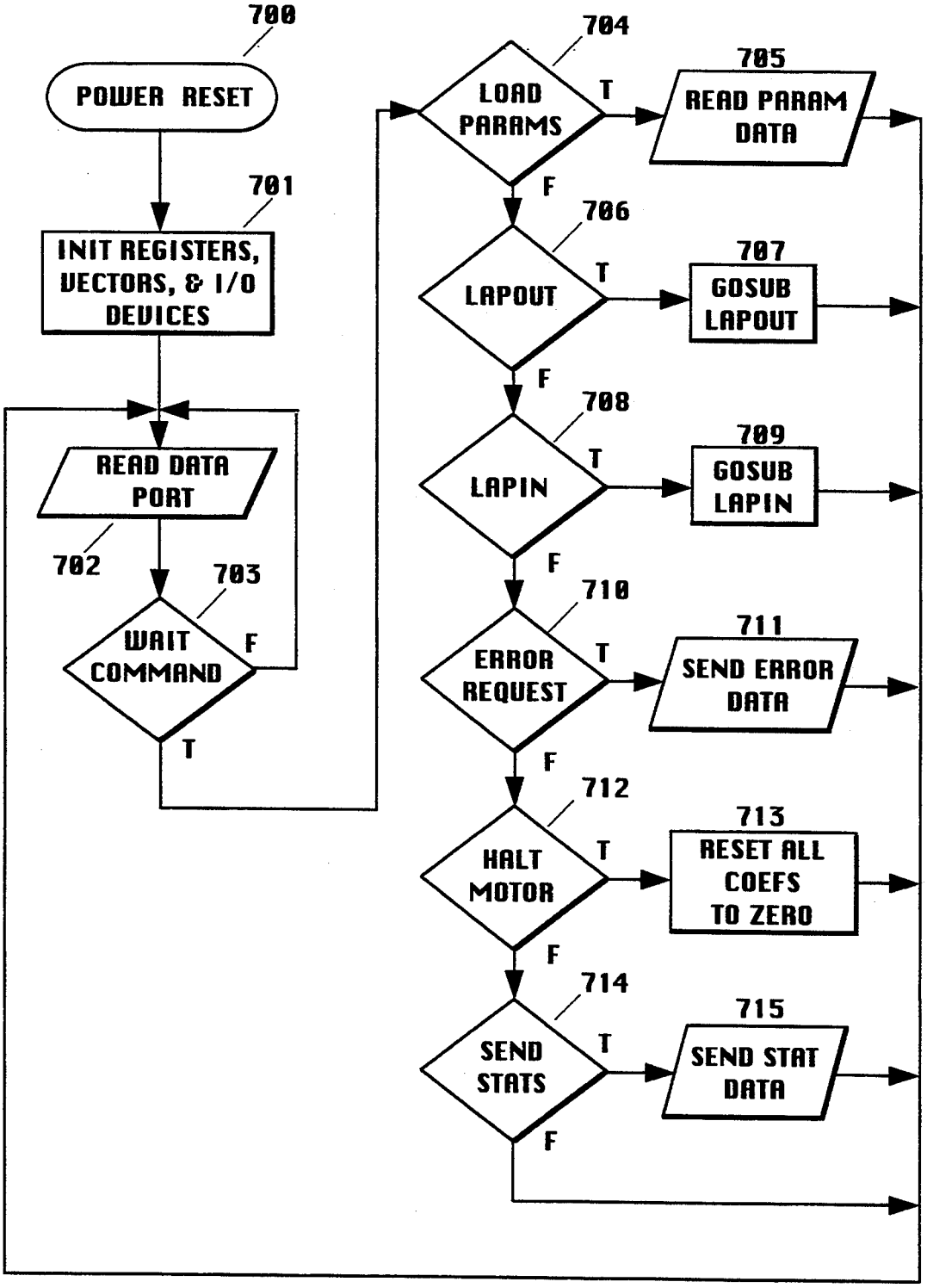
FIGS. 11A through 11E serve to illustrate procedures logic, and algorithms that, when implemented in logic hardware or coded into machine language, would provide the motor control functions disclosed in teachings of the present invention.

The signal processing executive procedure 700 of FIG. 11A is entered after power up through a processor power RESET interrupt. Said interrupt causes an address vector fetch and branch which passes control on to a block 701 wherein a hardware initialization is performed. Included in this block is an initialization of the control registers of digital port 275, the analog-to-digital converter 274, data buffers 276, timers 278 and 279, and counters 277 and 280, as well as the calculation and verification of a checksum for the EEROM 271. Control then passes on to an input block 702 wherein the input data port 154 is read after which control passes on to a decision element 703 which tests for the presence of a command from Programmable Controller 125. If test 703 is false, input block 702 is entered again thus forming a wait loop. When test 703 becomes true, control passes on to a series of decision elements 704, 706, 708, 710, 712, and 714 which test said controller command for a match with one of a multiplicity of operations, of which six are illustrated herein. If a match results in a false condition, control is passed to each succeeding decision element in turn. If a test results in a true condition, control is passed on from the decision element to a corresponding operational block 705, 707, 709, 711, 713, Or 715. The first said block 705 is an input block which reads parameter and coefficient data from the Programmable Controller 125 over the input data port 154, after which control passes back to input block 702. The second said block 707 calls subroutine LAPOUT 720 and, upon return, control passes back to input block 702. The third said block 709 calls subroutine LAPIN 730 and, upon return, control passes back to input block 702. The fourth said block 711 is an output block which sends error data to the Programmable Controller 125 over the output data port 166, after which control passes back to input block 702. The fifth said block 713 halts the motor by resetting all coefficients to zero, after which control passes back to input block 702. The sixth said block 715 is an output block which sends Lap statistical data to the Programmable Controller 125 over the output data port 166, after which control passes back to input block 702. If all decision elements return false, then control passes on back to input block 702.

Figure 11B:
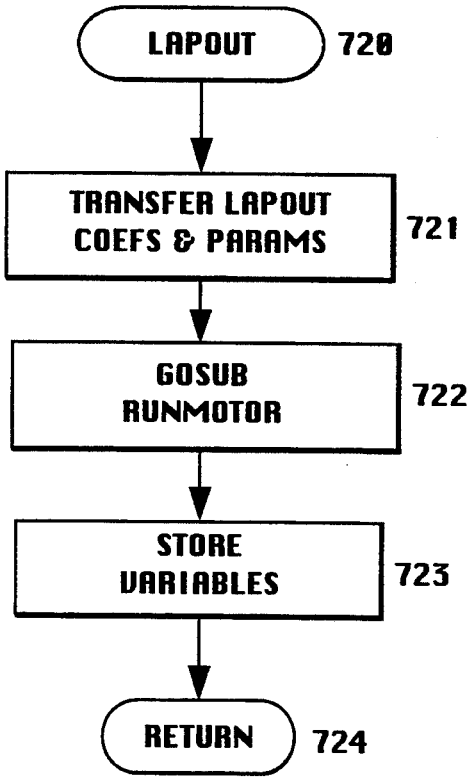

The Lapout procedure 720 of FIG. 11B begins with a block 721 in which the Lapout coefficients and parameters are transferred to the various filter variables in preparation for a Lap run. Control then passes on to a block 722 which calls the subroutine Runmotor 740 and upon return, passes control on to a block 723 wherein various Lap variables are stored in Lapout storage variables for later retrieval. Control then passes on to subroutine return 724.

Figure 11C:
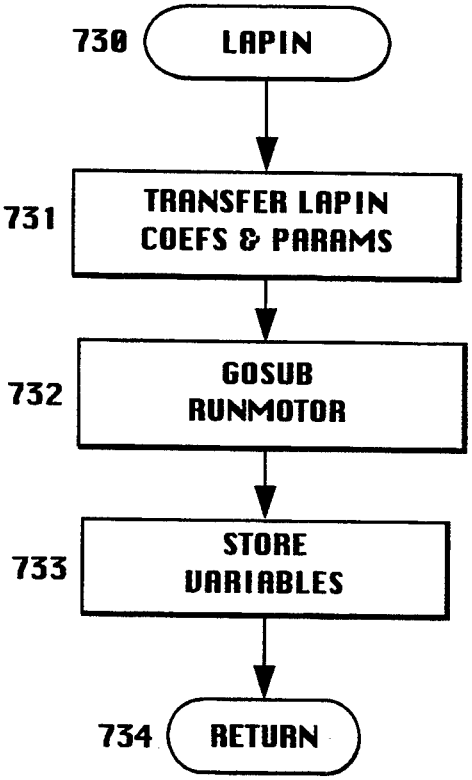

The Lapin procedure 730 of FIG. 11C begins with a block 731 in which the Lapin coefficients and parameters are transferred to the various filter variables in preparation for a Lap run. Control then passes on to a block 732 which calls the subroutine Runmotor 740 and upon return passes control on to a block 733 wherein various Lap variables are stored in Lapin storage variables for later retrieval. Control then passes on to subroutine return 734.

Figure 11D:
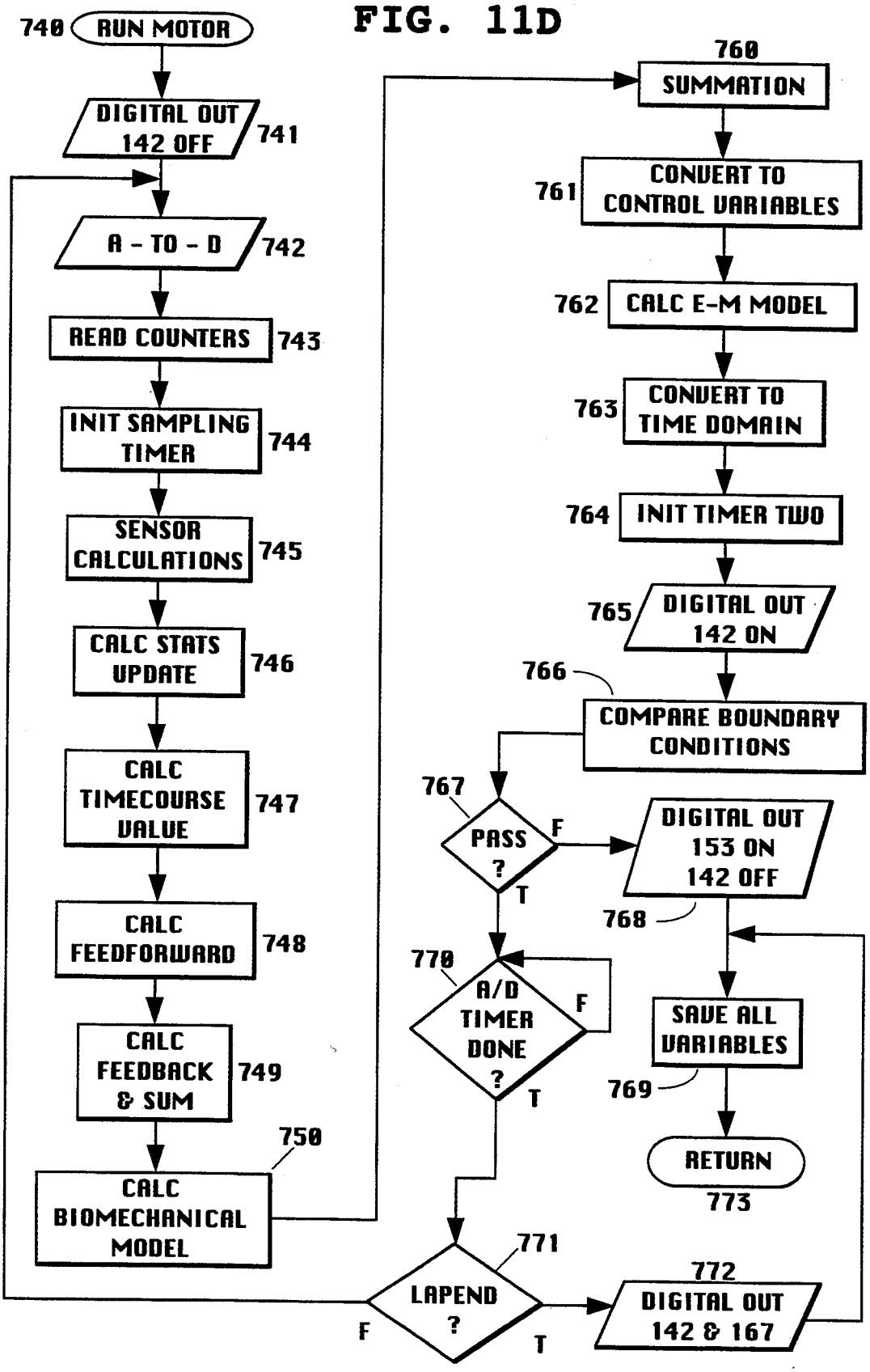

Referring now to FIG. 11D, the Run Motor procedure 740 begins with an output block 741 which outputs a low level on digital port 275 line 142 to ensure power switch 139 is in the off state. Control then passes on to an input block 742 wherein the various analog signals 140, 141, 164, 170, 175, 177, and 305 are read from the multiplexed analog-to-digital converter 274. Control then passes on to a second input block 743 which reads count register values of counters one 277 and two 278 which count pulses from signal lines 176 and 304 respectively. Control proceeds on to a block 744 wherein the sampling period delay is programmed into the timer one 278. Control then passes on to a block 745 which performs the various calculations which transform raw sensor signal values into the various variables of interest, including physiological, biomechanical, and electromechanical variables as necessary, for stages 215 and 220. Control then passes on to a block 746 wherein the statistical summation variables are updated with the results of the calculations of block 745 after which control is passed on to a block 747 wherein the Biomechanical Time Course model 200 calculations are performed to produce a new sample of the driving function. Control then passes on to a block 748 wherein the feedforward filter 207 calculations for the next sample are performed and the result multiplied by summation coefficient for stage 208. The details of this and the following filters are presented below in the discussion of FIG. 12. Next, control passes on to a block 749 which calculates the next sample of the feedback filter 210, multiplies the result by a summation coefficient 211, negates it, and subsequently sums the result along with the time course model output 201 sample for summation stage 206. Control then passes on to a block 750 wherein the calculations for the next Biomechanical model filter 205 sample are performed, after which control passes on to a block 760 which sums said result with the result of block 748 producing the output value for summation stage 209. Next, control passes on to a block 761 wherein the calculations to convert biomechanical variables to electromechanical control variables are performed for stage 216. Control then passes on to a block 762 which performs the calculations for the next electromechanical model filter 217 sample. Control then passes on to three blocks 763, 764, and 765 which comprise the series of calculations for stage 218. First, a block 763 converts the control variable output sample of block 762 to a switch time period. Next, control passes on to a block 764 which initializes timer two 279, to a count based on the calculated control period of block 762, after which control passes on to an output block 765 which outputs a high level on digital port 275 line 142, to enable the power switch 139. Control then passes on to a block 766 wherein the comparisons for Boundary Condition monitor 202 are performed after which decision element 767 is entered to test for a boundary comparison pass condition. If false, control passes on to an output block 768 which outputs a low level on digital port 275 line 142, to disable the power switch 139, and outputs a high level on line 153 which signals an error to the Programmable Controller 125. Control then passes on to a block 769 which saves all signal processor variables in reserved storage locations for future reference after which control passes on to subroutine return 773. If the result of decision 767 is true, then control passes on to a decision element 770 which tests analog sample period timer one 278, for a zero count. If the result of the test is false, decision element 770 is entered again thus forming a wait loop. When the test result becomes true, control passes on to a decision element 771 which tests for the end of lap count value in the register of counter one 277 which counts rotation pulses. If false, control passes back to block 742 creating a sample period loop. If the result of test 771 is true, control passes to an output block 772 which outputs a low level on digital port 275 line 142 to disable the power switch 139 and outputs a high level on line 167, which signals a Lapend condition to the Programmable Controller 125. Control then passes on to block 769 which saves all signal processor variables in reserved storage locations for future reference after which control passes on to subroutine return 773.

Figure 11E:
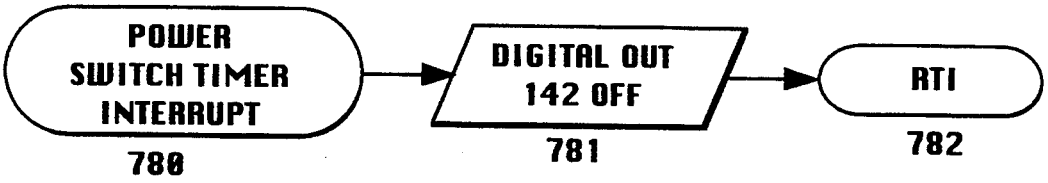

The Power switch timer Interrupt handler 780 of FIG. 11E is entered when the signal processor timer two 279, reaches zero and signals an interrupt over line 282. Control passes on to an output block which outputs a low level on digital port 275 line 142 to the power switch 139. Control then passes on to a Return from Interrupt 782.

Figure 12:
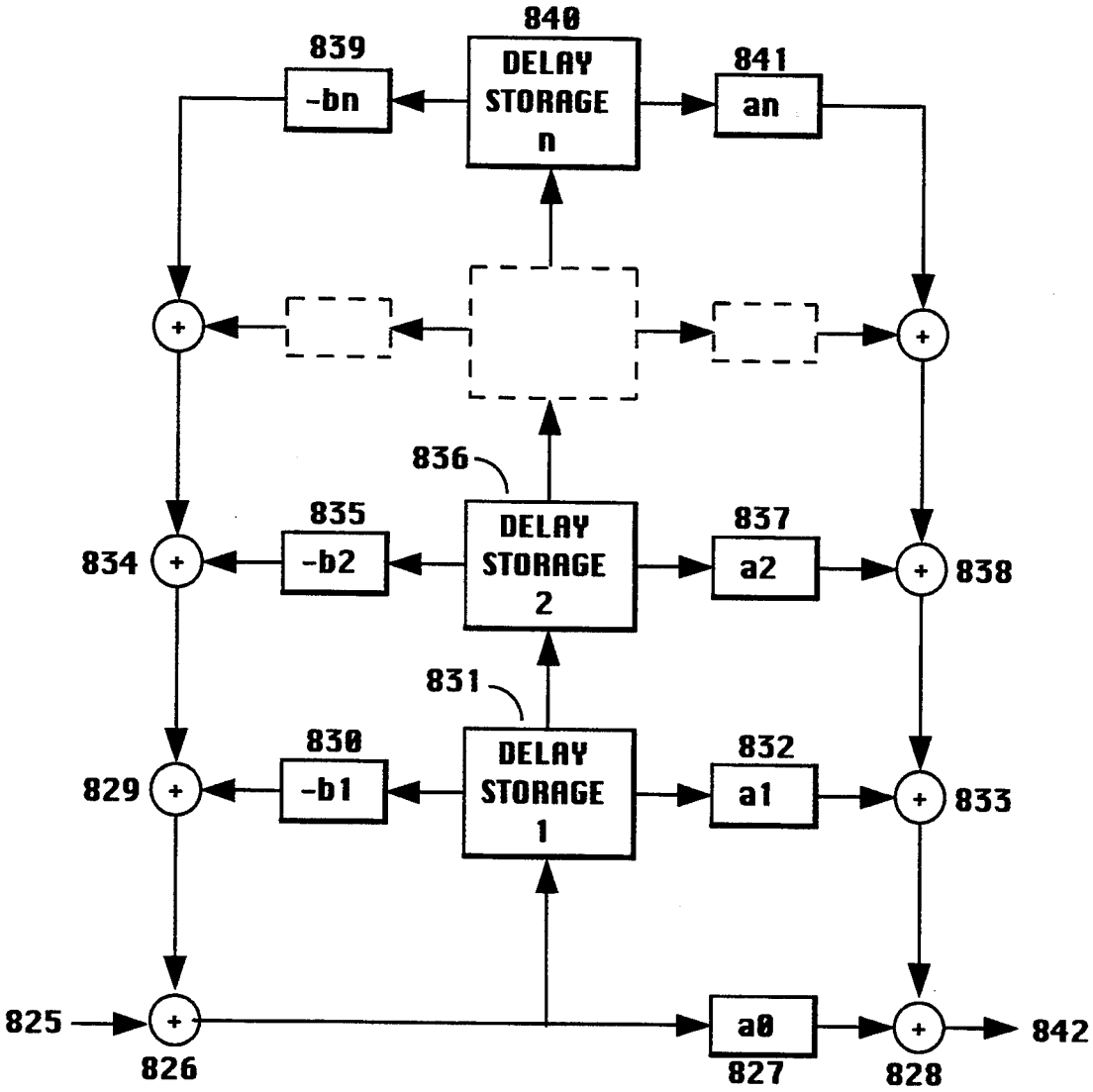
FIG. 12 illustrates a flow diagram of a digital filter algorithm which would provide filter functions for the motor controller processor as disclosed in the present invention.

Referring now to the digital filter flow diagram of FIG. 12, two numbered delays 831 and 836 represent the first two of a series of delay stages with undepicted intervening stages and stage 840 as the final for a total of N stages. It should be noted that the number of stages depends on the number of poles and zeros necessary for a given filter. Associated with each delay are "a" and "b" coefficients which determine the filter response characteristics. Working down from the stage N delay 840, the value in storage delay n is multiplied by a negative recursive coefficient b(n) 839, the result of which is forwarded to a series of summation stages below as depicted by the next stage 834. The value in storage delay n is also multiplied by a nonrecursive coefficient a(n) 841, the result of which is forwarded to a series of summation stages below as depicted by the next stage 838. Next, the value from a storage delay below, represented here by stage 836, is transferred to the current stage n 840 for use in the next sample period. The value in storage delay two 836, is multiplied by a negative recursive coefficient b(2) 835, the result of which is forwarded to the summation stage 834. The value in storage delay two 836, is also multiplied by a nonrecursive coefficient a(2) 837, the result of which is forwarded to the summation stage 838. The result of summation stage 834 is forwarded to a summation stage 829, and the result of summation stage 838 is forwarded to a summation stage 833. Next, the value from a storage delay one 831, is transferred to the current stage delay two 836, for use in the next sample period. The value in storage delay one 831, is then multiplied by a negative recursive coefficient b(1) 830, the result of which is forwarded to the summation stage 829. The value in storage delay one 831 is also multiplied by a nonrecursive coefficient a(1) 832, the result of which is forwarded to the summation stage 833. An input sample 825 is summed with the output of a summation stage 829 in a summation stage 826 and the result multiplied by a coefficient a(0) multiplier stage 827. The result of stage 827 is summed along with the output of a summation stage 833 by a summation stage 828 the result 842 being the output of the filter. The value resulting from the first summation stage 826 is then forwarded to storage stage 831. This process is repeated for each sample period as determined by block 744 for the timer one 278 delay period.

DESCRIPTION OF SYSTEM OPERATION

The following review of the general operation of the present invention is merely for illustrative purposes, and should in no way be considered either the sole or limiting view of the breadth and range of possible operational characteristics.

Referring now to the various modes of operation available, the Immediate mode 470 of operation provides for a simple and convenient default mode for the user which may be entered quickly and simply through the top level of the task executive 400. Though not required prior to Immediate mode operation 470, various control parameters, other than resistance level and lap speed, may be set and retained in the EEROM storage means 252 by way of the manual parameter configuration mode 510. In addition to the Immediate mode option 470, the user may select the Menu mode 490 in which several options are available, or select the Remote mode 575 which provides for the downloading of protocols and parameters from an external computer 18, and for the data transfer to said computer for processing and formatting at a later date. An additional function provides for the transfer of control from the user interface panel 19 to said remote computer. All operations and functions could then be controlled remotely.

The first Menu mode 490 option is the Manual Set Parameter mode 510 which provides for the manual manipulation of many of the control parameters, such as resistance level and lap speed, as well as other variables, and coefficients in the system. The parameters are simply selected from a menu and modified. The user interface operates with a simple set of rocker switches 111, 113 which are extremely user friendly in what is often a poorly lighted, damp, and even noisy environment. The menu selections or values of parameters are incremented or decremented by pushing on the top or bottom of the appropriate switch. The second menu option is the Instruction and Training mode 496 which consists of a set of protocols designed to improve stroke mechanics and swimming conditioning. Typically these protocols run multiple laps with the training characteristics remaining constant or gradually changing over the lap or over a series of laps. The Lapout is generally characterized by a load or negative force applied to the swimmer. This force may be constant, or could vary dynamically in a way to cause the swimmer to modify and improve his stroke characteristics.

The third menu option is the Test mode 498 which consists of a set of protocols designed to determine the capabilities and, more importantly, the characteristics of the swimmer's stroke and performance. Typically, test protocols consist of single laps which measure peak performance or performance curves over the course of the lap. These tests may include dynamic variations in the response of the system, much in the way the training protocols may be configured. The protocols are defined by a combination of parameters, variables, coefficients of filters, text table, and logic instructions which are stored in EEROM 252 or RAM 251 storage means. These various and several elements are retrieved and conveyed to appropriate locations within the protocol lap in/out control structure. The fourth menu option which is associated with the above described test option is the Statistical display mode 535 which provides the user with the capability to monitor and store all phases of the system operations and the swimmer's activities. The basic operation consists of selecting variables from a menu and having them displayed on the alphanumeric readout 112.

The fifth and sixth menu options provide for automatic parameter configuration 545 and automatic device calibration 560. The automated parameter configuration procedure is designed to measure such parameters or swimmer characteristics such as peak speed or peak force. The results of these simple one or two lap tests are directly stored in EEROM 252 or RAM 251 for immediate use by the various protocols. In conjunction with the swimmer's characteristics, the automated Calibration mode 560 determines certain characteristic parameters of the electromechanical system.

Installation procedures for the present invention consist of carrying the main assembly 11 via the handle 20 to a pool 3, positioning the device adjacent to the edge of a pool deck 12 as shown in FIG. 1, inserting mounting bolt 13 into the threaded deck mount 14, and tightening. Following this, the battery assembly 16 is placed behind the main assembly and the power cable plug 85 is connected to the socket 86 on the main assembly 11. The swimmer 1 then straps the harness assembly 4 and 6 around his waist and enters the water 2. The protective jacket 8 on the cable 5 provides for greater comfort while swimming. If required for control and monitoring purposes a portable computer 18 may be connected via the communications cable 17 by way of plug 88 and socket 89 to the main assembly 11.

The default protocols for purposes of this illustration consist of a training resistance Lapout, a Sprint-assist Lapin, and a subsequent fixed speed Excess Power measurement. Operation begins with a message on the alphanumeric display 112 requesting the swimmer to select the default Immediate mode 470, or the Menu mode 411. The swimmer then presses the right rocker switch 113, hears an auditory alert 118, and/or views the visual alert 117. Concurrent with the above displays, instructions are presented on the alphanumeric display 112 telling the swimmer to press the start button or to use the rocker switches to modify the resistance level and lap speed control parameters. When ready, the swimmer then presses the start button 114. The Programmable Controller 125 via line 137 then places relay 334 of power switch 139 into the resistance mode, and directs the Signal Processor 138 to enable the FET 322 drive signal 142. As the swimmer begins swimming an outgoing lap, the cable 5 takes up tension, travels down from around the lower pulley 9, over and around the upper pulley 25, engages the force arm pulley 26, passes around the bailer pulley 43 and, finally, rotates the cable drum 60. The rotating drum 60 engages the chain drive 65, 66, and 67, which rotates the worm screw 38 and the gear 73, which engages pinion gear 74, and shaft 75, which couple rotational power to the DC motor 76. The worm drive screw 38 concurrently engages the bailer nut 44 and carries the bailer 27 towards the right. This motion follows the unwinding of the cable 5 from the drum 60.

The motor 76 subsequently generates a voltage which in turn causes a current to flow through the power FET 322 under the control of the Signal Processor 138. Said current is proportional to a function of the user selected control parameters of resistance level and lap speed, and various configuration parameters as detailed below. Note that if during the Lapout the stop button 110 is pressed or the cable 5 tension exceeds the preset maximum value on spring 33 disengaging high force switch 37, then relay 339 drops out and the drive signal to the power FET 322 is removed. Furthermore, it should be noted that this action occurs independently of the Programmable Controller 125 and of the Signal Processor 138. Another aspect of this circuit is that the combination of the single 75 ampere rating advanced technology TMOS FET 322, the direction relay 334, the flyback diode 328, and the internal reverse diode in the FET avoids the necessity of multiple FETS and drivers configured in parallel and/or in various bridge arrangements as is common practice in the art when employing dynamic braking motor drivers.

During operation, various sensors provide electromechanical, physiological, and biomechanical signals for use by the Signal Processor 138. The mechanical measures include cable force obtained from the load cell transducer 34 coupled through spring 33 attached to the force arm means 28, revolution counts of the rotational detector 128, temperature from sensor 127, and condensation detection via sensor 126. The electrical measures include motor 76 current 140 derived from current transformer 324, motor 76 voltage 141 from bridge 330, and battery voltage 170. The physiological and biomechanical variables are obtained from the swimmer through the means of the biotelemetry system. The transmitter 6 induces magnetic pulses in the cable 5 in proportion to rate and intensity of the signals measured on the swimmer. Said pulses are then detected by an inductive coupling 101 in the main device and demodulated in the receiver 133 and coupled to the Signal Processor 138. Variables and signals of interest include cardiotach signals, body temperature, myographic signals, Camera sync pulses, accelerometer signals, and hydrodynamic pressure signals. In addition to the measured variables, several fixed parameters of operation are stored in the EEROM 271 and employed by the Signal Processor means 269 in various processing stages. These include parameters relating to the operation of the DC motor 76 such as nominal efficiency, inertia, resistive dampening factor, armature resistance, current-torque factor, voltage-speed factor, as well as such limits as maximum current, temperature, and speed. Other parameters are related to the mechanical components such as transmission 64 inertia, dampening factor, gear ratio, cable drum 60 inertia and dampening factor, drum circumference, drum length, and pool 3 length. Examples of the biomechanical parameters include maximum and minimum limits of such measures as cable 5 tension, speed, and acceleration. During the autocalibration mode 560, some of the electromechanical parameters may be altered as necessary. This is accomplished directly, comparing the Electromechanical sensor measures to the Electromechanical Model output. Each difference signal is averaged over time and employed to adjust the appropriate parameters. This is accomplished by employing coefficients which route the Electromechanical sensor signals 214 through the Biosensor processor 220, the feedback filter 210, and the Biomechanical model 205 unaltered. Some of the factors that necessitate such compensation include motor 76 brush wear, temperature changes in the motor 76 windings, and drive mechanism changes due to temperature and moisture.

The Electromechanical sensor processor 215 calculates several derived variables from the above mentioned input variables, including motor 76 RPM, power dissipation, armature resistance, back EMF, torque, and speed. Additional mechanical variables include cable drum 60 rotational speed and torque, as well as the cable 5 speed, acceleration, tension, power, and lap duration. Note that the motor current and back EMF voltage provide torque and speed estimates for the motor 76 which are independent of the direct cable drum force and speed measures. These various calculations are all well known in the art and are represented by simple linear equations. It will also be noted that the motor 76 armature resistance variable incorporated into the back EMF calculation for the purposes of this application will include a temperature measure 127 scaling factor to improve accuracy. The Biosensor processor 220 calculates various derived biomechanical variables including stroke count, ripple, magnitude, frequency, balance, and efficiency. Other biomechanical variables include the swimmer's lateral and vertical velocities and accelerations. Most of these calculations involve simple linear equations which are well known to those skilled in the art. The more advanced derived variables however, such as those involving frequency and ripple, require more complex processing. Various analog approaches to frequency conversion include frequency-to-voltage (V-to-F) converters. The illustrative embodiment depicted herein which employs digital signal processing provides the capability for not only digital implementations of analog V-to-F converters, but Discrete Fourier transform algorithms as well. Other algorithms for the analysis of force stroke ripple include rectification, peak picking, and labeling of alternate peaks in the stroke pattern. The results of these and other calculations are accumulated by the statistical data monitor 221 and checked by the boundary condition monitor 202 against the limit parameters described previously.

During the following operational discussion of additional components of the Signal Processor 138, it must again be noted that the block diagram FIG. 5 represents multiple channels of signals such as speed, force, frequency and the like. The number and type of signal channels will depend on the protocol requirements and are configured by the parameters and coefficients of a given protocol. The Biomechanical Time Course Model 200 generates a controlling parameter curve over the period of time during the protocol. In this illustration for a Lapout, the curve consists of an increasing level of drag resistance on the swimmer. The output of the Time Course model 200 consists not of a drag force, but of a scaling factor of proportionality relative to the normal function of drag which is a function of speed. It should be noted that in this example, the Time Course Model output 201 and the feedback filter 210 output are split into two separate channels whereby summation 206 represents two separate channels, one of a scaling factor, and the other of a speed value from feedback filter 210. In other protocols, the output 210 of the Time Course Model 200 might be a speed or force value which would be summed in summation stage 206 along with the Feedback Filter 210 speed value. The feedforward filter 207 path provides a direct path bypassing the Biomechanical Model 205, the degree of bypass being controlled by the multiplier 208. Filter 207 is typically characterized by a bandpass function and is used to augment rate of system response. In this illustration of Lapout, filter 207 is disabled, while in other protocols it may serve as the only control signal route while the Biomechanical Model is disabled. The Biomechanical Feedback Filter 210 in this Lapout illustration is characterized as a lowpass function whereby the stroke ripple component of the speed variable is reduced prior to use by the Biomechanical Model 205. Other protocols might incorporate a bandpass function which would pass changes in force over a stroke frequency range. In this illustration, the lowpass characteristics of the filter control the degree of accommodation during the stroke and therefore the degree of kinesthetic feedback to the swimmer. The output of the filter 210 is normally scaled by the filter coefficient 211 and summed at the negative input of a channel of the summation stage 206. In this Lapout illustration, the output of the Feedback filter 210 is presented directly to the Biomechanical model 205 by use of a negative unity coefficient 211. Thus the speed value is available to the Biomechanical Model Filter 205 directly. The Biomechanical Model Filter 205 consists generally of a bandpass filter which limits or enhances the control parameter rate of change to one which is in accordance with the capabilities of a swimmer's responses. In this illustration of a Lapout, however, the Biomechanical Model 205 consists of a drag augmentation polynomial equation whose input is the speed of the swimmer, and whose coefficients include the output of the Biomechanical Time Course Model 200. This provides the swimmer with kinesthetic feedback that simulates a hydrodynamic model wherein the drag function is greater than that encountered in normal swimming. This provides a greater degree of hydrodynamically valid accommodation than would be possible with other simplistic schemes. Other protocols, for example, might take advantage of a sinewave stroke speed generator function for the Biomechanical model. This type of function would provide kinesthetic feedback for adaptation of stroke frequency or balance. The feedback filter 210 value for such a function might consist of lap average stroke frequency, thereby providing accommodation to changes over time. The outputs of the biomechanical model 205 and the feedforward filter 207 and 208 are combined in the summation operation 209 and subsequently converted 216 into an equivalent electromechanical variable suitable for controlling the motor 76. In this illustration, a torque variable is processed by the Electromechanical Model Filter 217 which enhances the control signal to compensate for inertial and other characteristics of the motor 76, transmission 64, and cable drum 60. Other protocols might employ speed as the controlling variable. The characteristics of the filter 217 are typically those of a bandpass filter designed according to principles commonly employed by those skilled in the art. The output of the Electromechanical Filter 217 is transformed by the Time Modulation Converter 218 into a power equivalent time period for switch 139 which is then effectively integrated by the motor 76 inductance. The Modulation Converter obtains motor 76 operating values such as back EMF, voltage and current from the Electromechanical Sensor Processor 215 over signal path 214, and incorporates this information in the transform function. In this illustration, torque is converted to current, which in turn is converted into a power pulse period for output on signal line 142.

The Signal Processor means 269 of FIG. 6A and flow diagrams FIGS. 11A through 12 illustrate one possible embodiment of a signal processing means with which the functions of Signal Processor 138 may be implemented. A Digital Signal Processor implementation of analog circuits involves sampling various analog variables and counter circuits at a fixed sampling period equal to several times the highest frequency component of any sampled variable. This discrete representation of data is utilized as input to various filter and other algorithms and are updated each sample period to provide output samples which are subsequently converted back to analog signals. The various analog filter design parameters represented in the Laplace domain are readily transformed from the "s" domain to the "z" domain for use in discrete filters such as depicted in FIG. 12. In addition to the transformation of analog designs, the digital processing technique permits the utilization of the Discrete Fourier Transform for frequency analysis, and the discrete sinewave generator for signal generation. The analog methods and techniques known to those skilled in the art may be readily transformed into digital versions and implemented in software with programming techniques familiar to those in the art who currently employ microprocessors. The texts of Rabiner (1975) and Dote (1990) provide ample background in the specifics of such implementations. Operation of the Signal Processor means 269 begins at power-up 700 with a hardware initialization 701 and a read of the input data port 702. If a command request is present from controller 125, a series of decision elements 704, 706, 708, 710, 712, and 714 test for a match with the various commands provided. The first command performs a transfer 705 of configuration coefficients and parameters from the controller 125 to RAM 272 and EEROM 271 storage for use in the Runmotor 740 procedure. The second command provides for a Lapout 707, while the third provides for a Lapin 709 operation. The fourth command transmits error data from EEROM 271 storage to the Programmable Controller 125, while the fifth halts operations 713 by resetting all Signal Processor coefficients to zero. The final command transfers 715 statistical data collected during Lap operations to the controller 125. The Lapout 720 and Lapin 730 operations consist of configuring the various models and filters with the appropriate coefficients and parameters, calling the Runmotor subroutine, and subsequently storing the results of the lap in RAM 272 storage. The Runmotor procedure 740 provides for the implementation of the Signal Processor functions 138 by way of the Signal Processor means 269. The Signal Processor means 269 digitizes 742 the analog sensor signals as input variables through the analog converter 274, reads 743 counter values and transforms 215 and 220 the data into electromechanical, biomechanical, and physiological variables. The discrete sample rate period is set by a block 744 initializing the timer 1, 278. The processor then performs the various calculations for the processing stages of FIG. 5 in several operational blocks 746, 747, 748, 749, 750, 760, 761, 762, and 763. The calculations are followed by the initialization 764 of timer 2, 279, which is followed by a digital output 765 on signal line 142 to turn on power switch 139. This process represents the output portion of converter 218 and may be considered as equivalent to the function of a digital-to-analog converter. The end of the time period of timer 2, 279, is serviced by interrupt procedure 780 wherein a digital output on signal line 142 turns the power switch 139 off. If boundary conditions tests 767 result in an error condition, the power switch 139 is turned off, the values of variables are stored for future reference, and the error signal line 153 is activated. If all tests 767 pass, then a wait is entered pending the end of the sampling period on timer 1, 278. When the period ends, the test 771 for the Lapend is performed. If the lap has not ended, the process continues with another digitization 742. When the lap ends, the Lapend signal 167 is enabled, and the procedure terminates.

When the end of the Lapout is reached, the timer 254 is enabled, and a delay period is introduced. When said delay expires, the swimmer is notified by an Auditory Alert 118, and/or views the Visual Alert 117, and begins swimming an incoming lap. The Programmable Controller then enables the direction relay 334 for the Lapin mode and directs the Signal Processor 138 to enable the FET 322 drive signal 142, and, as a result, current flows through the motor 76 from the battery voltage source 170, through the FET 322, and back to the battery common. The above described mechanical operation of the Lapout is now reversed wherein the motor 76 provides a force which rotates the drum 60 in a direction opposite to that of the Lapout and thereby winds the cable 5 around it and applying a force on the cable 5. This force assists the swimmers efforts thereby increasing his speed. The operation of the Signal Processor 138 in the Lapin mode is generally similar to that of the Lapout mode. The characteristics of the biomechanical feedback filter 210 however are such as to filter out the variations in speed within the stroke, or stroke ripple, and to provide a smoothed or averaged speed feedback signal. The Biomechanical Time Course Model 200 provides a speed variable that increases over the course of the protocol. These two signals are combined in the summation 206 and transformed into a force variable by the Biomechanical model and subsequently converted 216, 217, and 218 into a power pulse period sequence which is applied to power switch 139 and subsequently the motor 76. The kinesthetic feedback force to the swimmer results in a reduction in the force of drag and is maintained at an averaged sprint assist velocity. As the cable 5 is wound, the bailer 27 travels towards the left in order to maintain an even single turn wind. Note that the cable 5 now passes up through the water brush 104 thereby shedding most of the residual water film. Note that if during the Lapin the stop button 110 is pressed, the dropout relay 339 is disabled and the drive signal to the power FET 322 is removed along with the mode relay 334 dropping into the Lapout mode. Also note that if the cable 5 force exceeds a preset maximum Lapin value on spring 33, the low force switch 36 disengages thereby dropping the mode relay 334 into the Lapout mode while maintaining the drive signal 142 to the FET 322, and finally resulting in the braking of motor 76. When the cable 5 is wound in completely, the Signal Processor means 269 detects a Lapend condition by way of a full count on the rotation counter 277 and halts the motor 76 by disabling the FET 322 drive signal 142. In addition, processor 138 signals a Lapend on line 167 to the programmable controller 125 which in turn places the direction relay 334 into the resistance mode. If during the Lapin operation the left bailer limit switch 49 is engaged, direction mode relay 334 drops out into Lapout mode and brakes the motor 76. The arrangement of the direction mode relay 334, low force cutout switch 36, dropout relay 339, high force switch 37, and stop button 110 permits direct shutdown of the motor under extreme and anomalous circumstances independently of the Programmable Controller 125 and of the Signal Processor 138.

The Excess Power test begins with a message on the alphanumeric display 112 requesting the swimmer to select the default Immediate mode 470, or the Menu mode 411. The swimmer then presses the left rocker switch 111, and menu options are presented on the alphanumeric display 112. The swimmer then presses the top of the left rocker switch 111 again. This results in the presentation of the next option on the display 112 which is the test protocol. The swimmer then presses the right rocker switch 113, hears an Auditory Alert 118 and/or views the Visual Alert 117, and an instruction to press the start button or to use the rocker switches to modify the speed parameter is presented on the alphanumeric display 112. When ready, the swimmer then presses the start button 114. The Programmable Controller 125 then places relay 334 of power switch 139 into the Lapout mode, and directs the Signal Processor 138 to enable the FET 322 drive signal 142. During the Lapout, motor 76 is maintained at the constant speed, selected as a control parameter, by the power switch 139 under the control of the Signal Processor 138. The operation of the Signal Processor 138 in this test mode Lapout is generally similar to that of the aforementioned training Lapin mode in that the characteristics of the Biomechanical Feedback Model 210 filters out the variations in speed within the stroke, or stroke ripple, and provide a smoothed or averaged speed feedback signal. The Biomechanical Time Course Model 200 provides a series of speed steps, while the Biomechanical Model 205 provides a speed-to-force conversion. The kinesthetic feedback to the swimmer that results will be that of maintaining a constant average velocity. The values of force for each speed step are stored at regular intervals by the Signal Processor means 269 during the test Lapout. When done, a delay is introduced, an alert given, and a low force Lapin is started as described above. The force values are then stored for future retrieval.

The present invention as described herein represents an extensible programmable tool which, with a unique combination of kinesthetic feedback instruction, biokinetic training and assessment capabilities, will assist the researcher, coach, and athlete in the task of improving a swimmer's skills and performance.

APPLICATIONS OF THE INVENTION

In the present invention, apparatus and methods are revealed that incorporate precise and rugged technologies which provide for the programmable measurement and application of positive or negative forces to a swimmer in a pool or aquatic environment while controlling complex relationships of the swimmer's speed, force, power, distance traveled, and elapsed time. A vital characteristic of this control is the feature of kinesthetic feedback which engages the primary sensory system employed in the activity of swimming. Those skilled in the art will recognize the wide diversity of protocols and applications in instruction and training as well as physiological and biomechanical performance assessment that can be supported by the capabilities of this technology. A review will now be presented of several diagnostic, instructional, and training applications pertaining to stroke mechanics and physical conditioning. The following discussion first addresses the development of skill through stroke mechanics, and then follows with a discussion of the development of limb strength through physical conditioning. Although these discussions attempt to address a wide range of applications, it must be noted that this is merely an illustration of possible applications of the present invention and should not be construed as exhaustive nor limiting.

Advanced swimming assessment techniques require the measurement of several physical parameters and may employ multiple protocols. The present invention is able to provide several descriptive and diagnostic variables pertaining to stroke mechanics including lap length, number of strokes per lap, average forward speed of the swimmer, stroke efficiency, stroke frequency, stroke ripple, and stroke balance. Additional diagnostic variables obtained from swimmer accelerometer data for instance could provide indications of vertical and lateral body movement due to lateral hand drag and hand angle and/or breath timing. These effects represent wasted and detrimental motion that contribute to a reduction in overall propulsive efficiency. Other more complex variables such as forward drag resistance can be estimated via various protocols involving the controlled application of positive force while swimming.

Referring now to the application of the present invention as an instructional aid employing kinesthetic feedback, the primary protocol is that of sprint assisted swimming. Sprint assist, the application of a controlled positive assisting force, provides the swimmer with the means with which he may develop stroke technique at higher than his maximum training speed. By off-loading the propulsive demands necessary to attain such a high velocity, the swimmer is able to focus on stroke mechanics. Sprint assist has been considered as a means of improving distance-per-stroke while maintaining or increasing stroke frequency. By contributing improvements to both of these factors, the sprint assist technique provides a substantial contribution to overall velocity.

It will be obvious to those skilled in the art that not only can the current manual methods be implemented in an improved fashion, but that new and diverse protocols will be possible with the advent of the present invention. Such protocols would utilize a wide range of physiological and biomechanical measures as input to the signal processing component which would subsequently provide output in the form of kinesthetic feedback via the application of forces. Diagnostic variables such as stroke ripple and stroke balance can be utilized in a kinesthetic feedback protocol wherein forces on the swimmer's line would effect a change in his stroke patterns. The aforesaid modification of stroke would improve the efficiency of the transfer of power into forward motion, effect improved control of the acceleration of the body mass and corresponding inertial effects, and additionally bring about a balanced contribution of power from both arms. Another area for kinesthetic feedback protocols is that of hand pattern during the stroke. The hand entrance, the so-called "catch", the various direction changes during the elliptical pull pattern and hand exit are all key in maximizing efficiency by the proper mix of force and velocity vectors. With the incorporation of the present invention into further research in search of appropriate optimal parameters, a protocol to modify the aforementioned hand pattern components dynamically during the course of the stroke would be possible.

Diagnostic protocols for the assessment of limb strength and levels of physical conditioning are problematic due to the absence of adequate models of swimming hydrodynamics and bio- mechanics. As discussed previously, speed is a function of the ability to convert strength via skill into force in the forward direction. Unfortunately, a great deal of power can be lost in extraneous motion and dynamic drag, all of which cannot be directly measured or even accurately estimated. With additional research and the aforementioned vertical and lateral body movement data obtained from an accelerometer, improved models of drag and propulsion might be incorporated into protocols which would enable the present invention to estimate these variables and factors. Alternatively, however, the previously discussed and well defined measures of excess force from Costill, the External Mechanical Power method of Ria, and the tethered anaerobic swim test of Rohrs could be implemented currently with the apparatus of the present invention. Another method of estimating the level of energy expenditure is a technique of monitoring heart rate while swimming. Above the level of 50% of maximum oxygen consumption, the heart rate and aerobic energy are approximately linearly related. This technique could be readily programmed for the present invention as an assessment protocol. Another measure for which an estimation protocol might be developed would be that of hydrodynamic drag of the swimmer's body while swimming. By employing a series of varying forces to a swimmer and monitoring the changes in velocity, drag estimates could be calculated.

Referring now to the application of the present invention to the task of physical conditioning, the primary technique to be employed will be that of physiological "overload". This is a methodology of athletic training wherein the swimmer trains at levels which surpass those faced during competition. This technique would also apply to the demands imposed on various emergency rescue services during the intense power requirements of the rescue operations. The implementation of a high-resistance fast-speed protocol as suggested by Counsilman has been described in the foregoing operations section. Such protocols can be extended to employ biokinetic techniques wherein accommodating resistance and acceleration would be provided throughout the ranges of motion during the stroke. An example of this would be to implement a resistance to speed relationship whose characteristic would be non-linear as are the properties of hydrodynamic drag. This technique would provide an "intensified" drag effect which would incorporate both "overload" and biokinetic properties. Another variation of accommodation or biokinetic exercise would be that of iso-power. Current exercise devices often employ a form of iso-kinetic training which maintains constant speed or force. Given the resources of the present invention, a more complex iso-power mode for example would provide a variable resistance whose relationship to the swimmers speed would be such that the swimmer's excess power would increased as his speed was reduced according to previously established norms of top swimmers. This linking of resistance inversely to speed would result in a constant power production by the swimmer. If the swimmer did not effectively transfer power into forward propulsion, his total power production would have to increase much more rapidly than necessary and he would be unable to reach even his own best speed.

One can envision more complex protocols which could be programmed utilizing the present invention. One such class would include the modification of various parameters of a training protocol over the course of a lap or over the course of a practice session. Examples of this would be to present a progressively increasing resistance towards the end of a lap, a group of laps, or over a practice session in order to simulate the enhanced stresses of competition or other high demand activities such as emergency rescue. Other resources of the present invention, such as the physiological and biomechanical measures, could be employed to monitor the swimmer's level of activity and subsequently provide kinesthetic or other feedback to encourage appropriate power levels. This failure to achieve an appropriate level of effort is termed "sandbagging" and an alert warning could be presented not only to the swimmer, but presented to a coach or trainer for further positive feedback. Another class of training protocols known as "eccentric" exercise would involve yet another operational variation of the present invention. This protocol would consist of applying a force to the swimmer of such a magnitude that the swimmer's direction would be reversed. This technique has been suggested as a way of developing the antagonist muscle groups.

Although one possible embodiment has been described to illustrate the teachings and disclosures of the present invention it will be obvious that the present invention is not limited to the specific foregoing illustrative embodiment or applications and that various and several modifications in design, arrangement, and use may be made within the scope and spirit of the invention as expressed in the following claims:

What is claimed is:

1. A swim instruction apparatus comprising:

a cable having a proximal end and a distal end;

means for coupling the distal end of the cable to a swimmer in a body of water;

means coupled to the proximal end of the cable for winding and unwinding the cable for applying positive and negative forces to the cable;

force sensing means coupled to the cable for generating an output signal responsive to the force exerted by the swimmer on the cable; and a controller coupled to the output signal from the force sensing means and to the winding and unwinding means, the controller being responsive to the output signal from the force sensing means for controlling the force applied through the cable by the winding and unwinding means to the swimmer as the swimmer swims in the water.

2. The apparatus of claim 1, wherein the controller includes means for selecting a value of a control parameter from a range of values, the controller being responsive to both the output signal from the force sensing means and to the value of the control parameter to control the force applied by the winding and unwinding means.

3. The apparatus of claim 2, wherein the selecting means selects values for at least two different control parameters, the controller being responsive to the output signal from the force sensing means and to the value of a first control parameter to control the positive force applied to the swimmer by the winding and unwinding means, and the controller being responsive to the output signal from the force sensing means and to the value of a second control parameter to control the negative force applied to the swimmer by the winding and unwinding means.

4. The apparatus of claim 1, wherein the controller includes means for deactivating the winding and unwinding means in response to the output signal from the force sensing means reaching a predetermined level to remove the forces from the swimmer.

5. The apparatus of claim 1, wherein the cable is a stainless steel aircraft cable coated with a flexible plastic material.

6. The apparatus of claim 1, wherein the cable is supported in the water by a float coupled to the distal end of the cable adjacent the swimmer.

7. The apparatus of claim 1, wherein the winding and unwinding means includes a drum coupled to the proximal end of the cable, a variable speedmotor coupled to the controller and coupled to the drum for rotating the drum selectively in opposite directions for winding and unwinding the cable from the drum, and a bailer coupled to the drum for aligning the cable as it winds and unwinds on the drum.

8. The apparatus of claim 7, wherein the bailer includes a pulley for guiding the cable.

9. The apparatus of claim 7, wherein the drum and the bailer of the winding and unwinding means wind only a single layer of cable on the drum.

10. The apparatus of claim 7, further comprising limit switches coupled to the controller add to the bailer which provide logic output signals in response to bailer positions at the extremes of travel of the bailer.

11. The apparatus of claim 7, further comprising a rotational motion sensor coupled to the drum for generating an output signal proportional to the rotational speed of the drum, and signal processing means responsive to the motion sensor output signal and incorporating physical parameters of the drum for providing an output signal proportional to the speed of the cable as it is wound and unwound on the drum.

12. The apparatus of claim 1, further comprising a housing surrounding the winding and unwinding means and means adjacent the housing through which the cable passes for removing water from the cable as the cable enters the housing to be wound.

13. The apparatus of claim 1, wherein the winding and unwinding means includes a moisture sensor coupled to the controller for deactivating the winding and unwinding means in response to the output signal from the moisture sensor reaching a predetermined level.

14. The apparatus of claim 1, wherein the winding and unwinding means includes a variable speed electric motor for providing positive and negative rotational forces to the winding and unwinding means and an electric power source coupled to the controller, wherein the controller controls the application of the power source to the motor during the winding of the cable and additionally controls the braking action of the motor during the unwinding of the cable.

15. The apparatus of claim 14, wherein the controller further includes a single semiconductor power switch having a pair of terminals, a first power switch terminal being coupled to a first motor terminal, and a direction relay, coupled to a second motor terminal, for firstly selectively coupling the second motor terminal through the relay to a first terminal of the power source, completing the circuit by returning from a second power switch terminal to a second power source terminal, whereby the supply of power to the motor while winding the cable is controlled through the semiconductor power switch and secondly selectively coupling the second motor terminal through the relay to the second power switch terminal whereby the power generated by the motor during unwinding of the cable is controlled to brake the unwinding means.

16. The apparatus of claim 15, wherein the controller further includes a time modulator, responsive to the force sensor signal, which provides a series of variable duration output pulses which switch the semiconductor power switch, thereby controlling the supply of power to the motor while winding the cable and additionally controlling the braking of the motor during the unwinding of the cable.

17. The apparatus of claim 14, wherein the power source is electrically isolated from earth ground and from any utility AC mains.

18. The apparatus of claim 1, wherein the controller includes means for automatically switching the direction of the winding and unwinding means at an end of each lap made by the swimmer as the swimmer swims laps in the water.

19. The apparatus of claim 18, wherein the controller includes means for imposing a selected time delay before switching the direction of the winding and unwinding means at the end of each lap.

20. The apparatus of claim 18, further comprising means coupled to the controller for providing a perceptible warning signal prior to the controller switching the direction of the winding and unwinding means at the end of each lap.

21. The apparatus of claim 1, wherein the cable includes a conductive component and the force sensing means is located adjacent the swimmer at the distal end of the cable, and further comprising additional means adjacent the swimmer for transmitting an electrical signal through the cable proportional to the output signal of the force sensing means and receiving means coupled to the cable at the proximal end near the winding and unwinding means for receiving the electrical signals from the cable.

22. The apparatus of claim 1, wherein the controller includes means for measuring, displaying, and storing data values of the force sensor output signal.

23. The apparatus of claim 1, further comprising means coupled to the force sensing means for generating a perceptible warning signal in response to the output signal from the force sensing means when the output signal is within a predetermined range of values.

24. The apparatus of claim 1, wherein the sensing means includes a load cell for measuring force on the cable.

25. The apparatus of claim 1, wherein the force sensing means includes a pulley, around which the cable passes, coupled to a lever arm which moves on a pivot shaft, and a switch in contact with the lever arm, the lever arm being spring loaded in a manner in which it opposes the force of the cable on the pulley, which provides a logic signal at a force threshold proportional to the location of the switch along the lever arm.

26. The apparatus of claim 1, wherein the winding and unwinding means includes a temperature sensor coupled to the controller and the controller including further means for deactivating the winding and unwinding means in response to the output signal from the temperature sensor reaching a predetermined level.

27. The apparatus of claim 1, further comprising a plurality of sensing means generating a plurality of output signals, each being proportional to one of a plurality of parameters, coupled to the controller, wherein the controller includes means for measuring, displaying, and storing values of the output signals.

28. The apparatus of claim 1, wherein the controller includes both digital logic and analog circuitry to control the force applied by the winding and unwinding means.

29. The apparatus of claim 1, further comprising cable speed sensing means coupled to the controller for generating an output signal proportional to the speed of the swimmer, the controller being responsive to the output signal from the force sensing means and to the output signal from the speed sensing means to control the speed of the swimmer by varying the force applied to the swimmer by the winding and unwinding means.

30. The apparatus of claim 1, wherein the controller is a programmable controller.

31. An apparatus for applying forces to a swimmer as the swimmer swims in a body of water, the apparatus comprising:

a cable;

means for coupling the cable to a swimmer in a body of water;

means coupled to the cable for applying a force to the swimmer through the cable as the swimmer swims in a body of water;

sensing means for generating an output signal responsive to a parameter as measured by the sensing means;

means for selecting a value of a control parameter from a range of values; and a programmable controller coupled to the output signal from the sensing means, the parameter selection means, and the force applying means, the controller being responsive to the output signal from the sensing means and to the parameter selecting means for controlling the force applied to the swimmer by the force applying means as the swimmer swims in the water.

32. The apparatus of claim 31, wherein the controller includes means for automatically switching the direction of force applied to the swimmer at an end of each lap by the swimmer as the swimmer swims laps in the water.

33. The apparatus of claim 31, further comprising means coupled to the controller for generating a perceptible warning signal in response to the output signal from the sensing means when the output signal is within a predetermined range of values.

34. The apparatus of claim 31, wherein the controller includes means for deactivating the force applying means in response to the output signal from the sensing means reaching a predetermined level.

35. The apparatus of claim 34, wherein the controller includes means for controlling the return of the cable towards a proximal end including means for controlling the repeated application of a low level positive force to the cable while monitoring the output signal from the sensing means and for deactivating the force if the output signal reaches a predetermined level.

36. The apparatus of claim 31, further comprising means coupled to the controller for storing operational protocol programs, means for displaying a menu of such programs, switch means for selecting a program, and wherein the controller includes means to perform calculations on the sensing means output signal to control the application of forces to the swimmer as the swimmer swims in the water as determined by such programs.

37. The apparatus of claim 31, wherein the controller includes means for automatically selecting a value for a controlling parameter by calculations based on the output signal of the sensing means which measures a parameter of the swimmers performance as the swimmer swims in the water, and means to store that value.

38. The apparatus of claim 31, wherein the controller includes means for automatically calibrating a characteristic parameter of the force applying means based on the output signal of the sensing means which measures a parameter of the force applying means as the swimmer swims in the water, and means to store that characteristic parameter value.

39. The apparatus of claim 31, wherein the controller includes means for automatically calculating a controlling variable as a function of time and a controlling parameter to control the application of forces to the swimmer by the force applying means as the swimmer swims in the water.

40. The apparatus of claim 31, wherein the controller includes frequency domain filtering means responsive to the output signal from the sensing means to control the application of forces to the swimmer as the swimmer swims in the water, and which filter means is configured by control parameters which are based on swimming biomechanics principles.

41. The apparatus of claim 31, wherein the cable includes a conductive component and the sensing means is located adjacent the swimmer at a distal end of the cable, and further comprising additional means adjacent the swimmer for transmitting an electrical signal through the cable proportional to the output signal of the sensing means and receiving means coupled to the cable adjacent the force applying means for receiving the electrical signals from the cable.

42. The apparatus of claim 31, further comprising means coupled to the controller for measuring the output signal generated by the sensing means and displaying a data value proportional to the output signal.

43. The apparatus of claim 31, wherein the controller includes means for measuring and storing a data value proportional to the output signal generated by the sensing means.

44. The apparatus of claim 43, wherein the controller includes means for processing the data value to calculate a derived data value from the data value proportional to the output signal generated by the sensing means, and storing the derived data value in the storing means.

45. The apparatus of claim 43, further comprising transmission means coupled to the controller and to a computer for uploading the data value from the storing means to the computer.

46. The apparatus of claim 31, wherein the controller includes both digital logic and analog circuitry to control the force applied to the swimmer as the swimmer swims in the water.

47. The apparatus of claim 31, wherein the controller includes a microprocessor to control the force applied to the swimmer as the swimmer swims in the water.

48. The apparatus of claim 31, wherein the controller includes a digital signal processing microprocessor to control the force applied to the swimmer as the swimmer swims in the water.

49. The apparatus of claim 31, wherein the controller includes data value storing means and program storing means and further comprising transmission means coupled to the controller and to a computer for downloading a program and a control parameter data value from the computer and to place the data value in the data value storing means and place the program in the program storing means.

50. The apparatus of claim 31, wherein the controller includes means for displaying a value of a control parameter and switch means for selecting a new value from a range of values, the controller being responsive to the output signal from the sensing means and to the value of the controller parameter to adjust the application of forces to the swimmer by the force applying means as the swimmer swims in the water.

51. The apparatus of claim 31, wherein the sensor generates an output signal proportional to a parameter of motion of the cable as the swimmer swims in a body of water.

52. The apparatus of claim 31, wherein the sensor generates an output signal proportional to a parameter of swimming motion of the swimmer as the swimmer swims in a body of water.

53. The apparatus of claim 31, wherein the sensor generates an output signal proportional to a parameter of physiological state of the swimmer as the swimmer swims in a body of water.

54. A swim assessment apparatus comprising:

a cable having a proximal end and a distal end, the cable including an electrically conductive component;

means for coupling the distal end of the cable to a swimmer in a body of water;

means coupled to the proximal end of the cable for applying a tension force to the cable as the swimmer swims at varying distances from the proximal end of the cable;

a sensor located adjacent the swimmer at the distal end of the cable for generating an output signal responsive to a parameter measured by the sensor;

a transmitter, located adjacent the swimmer, coupled to the sensor and to the distal end of the cable for transmitting an electrical signal proportional to the output signal from the sensor through the cable to the proximal end; and a receiver coupled to and located near the proximal end of the cable for receiving the electrical signal transmitted through the cable.

55. The apparatus of claim 54, where the cable is coated with an insulative material.

56. The apparatus of claim 54, wherein the transmitter and the receiver are inductively coupled to the cable for the transmission of the electrical signal through the cable.

57. The apparatus of claim 54, wherein the electrical signal transmitted through the cable is comprised of a plurality of output signals generated by a plurality of sensors, each being proportional to one of a plurality of parameters, which are received by the receiver at the proximal end of the cable.

58. The apparatus of claim 54, wherein the sensor is an accelerometer mounted on the swimmer.

59. The apparatus of claim 54, further comprising means coupled to the receiver for measuring the output signal generated by the sensor and transmitted through the cable to the receiver and displaying a data value proportional to the output signal.

60. The apparatus of claim 54, further comprising means coupled to the receiver for measuring and storing a data value proportional to the output signal generated by the sensor and transmitted through the cable to the receiver.

61. The apparatus of claim 60, further comprising means coupled to the measuring and storing means for processing the data value obtained from the sensor to calculate a derived data value, and storing the derived data value in the storing means.

62. The apparatus of claim 60, further comprising transmission means coupled to the measuring and storing means and to a computer for uploading the data value from the storing means to the computer.

63. The apparatus of claim 54, wherein the cable tension force means applies a force which is sufficient to modify the swimmer's swimming and includes means to control the magnitude of forces applied to the swimmer as the swimmer swims in the water.

64. The apparatus of claim 63, wherein the tension force magnitude control means is coupled to the receiver and is responsive to the output signal from the distal sensor for controlling the magnitude of force applied to the swimmer as the swimmer swims in the water.

65. The apparatus of claim 54, wherein the sensor generates an output signal proportional to a parameter of motion of the cable as the swimmer swims in a body of water.

66. The apparatus of claim 54, wherein the sensor generates an output signal proportional to a parameter of swimming motion of the swimmer as the swimmer swims in a body of water.

67. The apparatus of claim 54, wherein the sensor generates an output signal proportional to a parameter of physiological state of the swimmer as the swimmer swims in a body of water.

68. A swim instruction apparatus comprising:

a cable having a proximal end and a distal end;

means for coupling the distal end of the cable to a swimmer in a body of water;

means coupled to the proximal end of the cable for applying a positive force to the swimmer as the swimmer swims in a body of water;

speed sensing means for generating an output signal proportional to the speed of the swimmer;

force sensing means coupled to the cable for generating an output signal responsive to the force exerted by the swimmer on the cable;

means for generating a perceptible warning signal coupled to the output signal from the force sensing means, the warning signal generating means being responsive to the output signal from the force sensing means to generate a perceptible warning signal when the output signal from the force sensing means is within a predetermined range of values; and a controller coupled to the output signal from the speed sensing means and to the positive force applying means, the controller being responsive to the output signal from the speed sensing means for controlling the speed of the swimmer by varying the force applied to the swimmer by the positive force applying means.

69. The apparatus of claim 68, wherein the controller includes means for selecting a value of a control parameter from a range of values, the controller being responsive to both the output signal from the speed sensing means and to the value of the control parameter to control the positive force applying means.

70. The apparatus of claim 68, wherein the controller includes means for deactivating the force applying means means in response to the output signal from the sensing means reaching a predetermined level to remove the forces from the swimmer.

71. The apparatus of claim 68, wherein the positive force applying means includes a drum coupled to the proximal end of the cable, a variable speed motor coupled to the controller and coupled to the drum for rotating the drum selectively in opposite directions for winding and unwinding the cable from the drum, and a bailer coupled to the drum for aligning the cable as it winds and unwinds on the drum.

72. The apparatus of claim 71, wherein the bailer includes a pulley for guiding the cable.

73. The apparatus of claim 71, wherein the drum and the bailer wind only a single layer of cable on the drum.

74. The apparatus of claim 71, further comprising a rotational motion sensor coupled to the drum for generating an output signal proportional to the rotational speed of the drum, and signal processing means responsive to the motion sensor output signal and incorporating physical parameters of the drum for providing an output signal proportional to the speed of the cable as it is wound and unwound on the drum.

75. The apparatus of claim 68, further comprising a housing surrounding the winding and unwinding means and means through which the cable passes for removing water from the cable as the cable enters the housing to be wound.

76. The apparatus of claim 68, wherein the positive force applying means includes a variable speed electric motor coupled to a cable powering means and to the controller and an electric power source coupled to the controller, wherein the controller controls the application of the power source to the motor to control the application of positive force to the cable by the cable powering means.

77. The apparatus of claim 76, wherein the controller further includes a semiconductor switch and a time modulator, responsive to the output signal from the sensor, which provides a series of variable duration output pulses which switch the semiconductor switch, thereby controlling the supply of power to the motor.

78. The apparatus of claim 76, wherein the power source is electrically isolated from earth ground and from any utility AC mains.

79. The apparatus of claim 68, further comprising means coupled to the controller for measuring and storing a data value proportional to the output signal generated by the sensing means.

80. The apparatus of claim 68, wherein the force sensing means includes a load cell for measuring force on the cable.

81. The apparatus of claim 68, wherein the force sensing means includes a pulley, around which the cable passes, coupled to a lever arm which moves on a pivot shaft, and a switch in contact with the lever arm, the lever arm being spring loaded in a manner in which it opposes the force of the cable on the pulley, which provides a logic signal at a force threshold proportional to the location of the switch along the lever arm.

82. The apparatus of claim 68, further comprising a plurality of sensing means generating a plurality of output signals, each being proportional to one of a plurality of parameters, coupled to the controller, wherein the controller includes means for measuring, displaying, and storing a plurality of data values proportional to the plurality of output signals.

83. The apparatus of claim 68, wherein the controller includes both digital logic and analog circuitry to control the positive force applying means.

84. The apparatus of claim 68, further comprising a negative force applying means coupled to the cable and to the controller, whereby the controller, responsive to the output signal from the speed sensing means, controls the speed of the swimmer by varying the force applied to the swimmer by the negative force applying means.

85. The apparatus of claim 68, wherein the force sensor includes an accelerometer mounted on the swimmer.

86. A swim instruction apparatus comprising:

a cable having a proximal end and a distal end;

means for coupling the distal end of the cable to a swimmer;

means coupled to the proximal end of the cable for winding and unwinding the cable for applying positive and negative forces to the cable;

speed sensing means for generating an output signal proportional to the speed of the swimmer;

force sensing means coupled to the cable for generating an output signal responsive to the force exerted by the swimmer on the cable;

means for generating a perceptible warning signal coupled to the output signal from the force sensing means, the warning signal means being responsive to the output signal to generate a perceptible warning signal when the output signal is within a predetermined range of values; and a controller coupled to the output signal from the speed sensing means and to the winding and unwinding means, the controller being responsive to the output signal from the speed sensing means for controlling the speed of the swimmer by varying the force applied to the swimmer by the winding and unwinding means.

87. The apparatus of claim 86, wherein the controller includes means for deactivating the winding and unwinding means in response to the output signal from the sensing means reaching a predetermined level to remove the forces from the swimmer.

88. The apparatus of claim 86, wherein the controller is a programmable controller.

89. The apparatus of claim 86, further comprising an electric power source, electrically isolated from earth ground and from any utility AC mains, coupled to the controller and wherein the winding and unwinding means includes a variable speed electric motor coupled to the controller and the controller further includes a direction relay coupled to a single semiconductor power switch coupled to a time modulator and to the electric motor, responsive to a sensor signal, which provides a series of variable duration output pulses which switch the semiconductor power switch, thereby controlling the supply of power to the electric motor while winding the cable and additionally controlling the braking of the electric motor during the unwinding of the cable.

90. A swim training apparatus comprising:

a cable having a proximal end and a distal end;

means for coupling the distal end of the cable to a swimmer;

an accelerometer for coupling to the swimmer for generating an output signal responsive to a parameter measured by the accelerometer;

a transmitter coupled to the accelerometer for transmitting electrical signals proportional to the output signal from the accelerometer; and a receiver located near the proximal end of the cable for receiving the electrical signals from the transmitter.

91. The apparatus of claim 90, wherein the transmitter transmits the accelerometer output signal through the cable to the receiver.

* * * * *